US008618894B2

(12) United States Patent
Kim et al.

(10) Patent No.: US 8,618,894 B2
(45) Date of Patent: Dec. 31, 2013

(54) MULTI-MODE RESONANT FILTER

(75) Inventors: Duk-Yong Kim, Yongin-si (KR); Nam-Shin Park, Hwaseong-si (KR)

(73) Assignee: KMW Inc., Hwaseong-si (KR)

( * ) Notice: Subject to any disclaimer, the term of this patent is extended or adjusted under 35 U.S.C. 154(b) by 669 days.

(21) Appl. No.: 12/833,195

(22) Filed: Jul. 9, 2010

(65) Prior Publication Data

US 2011/0006856 A1 Jan. 13, 2011

Related U.S. Application Data

(60) Provisional application No. 61/224,523, filed on Jul. 10, 2009, provisional application No. 61/243,177, filed on Sep. 17, 2009.

(30) Foreign Application Priority Data

Jul. 10, 2009 (KR) ..... 10-2009-0063222

(51) Int. Cl.
*H01P 1/20* (2006.01)
*H01P 7/10* (2006.01)

(52) U.S. Cl.
USPC ..... 333/202; 333/219.1

(58) Field of Classification Search
USPC ..... 333/202, 219.1
See application file for complete search history.

(56) References Cited

U.S. PATENT DOCUMENTS

| | | | | |
|---|---|---|---|---|
| 4,675,630 | A | 6/1987 | Tang et al. | |
| 5,325,077 | A * | 6/1994 | Ishikawa et al. | 333/219.1 |
| 6,252,475 | B1 | 6/2001 | Enokihara et al. | |
| 6,496,087 | B1 | 12/2002 | Hattori et al. | |
| 6,573,812 | B1 | 6/2003 | Wakamatsu et al. | |
| 6,762,658 | B1 | 7/2004 | Isomura et al. | |
| 6,781,487 | B2 | 8/2004 | Hattori et al. | |
| 2006/0139127 | A1 * | 6/2006 | Wada et al. | 333/202 |
| 2008/0266033 | A1 | 10/2008 | Ishii et al. | |

FOREIGN PATENT DOCUMENTS

| | | | |
|---|---|---|---|
| CN | 1108826 | A | 9/1995 |
| JP | 04-020701 | U | 2/1992 |
| JP | 04-112503 | U | 9/1992 |
| JP | 06-177606 | | 6/1994 |
| JP | 08-078903 | | 3/1996 |
| JP | 08-222919 | A | 8/1996 |
| JP | 11-145704 | | 5/1999 |
| JP | 2000-077905 | | 3/2000 |
| JP | 2000-295005 | A | 10/2000 |

(Continued)

OTHER PUBLICATIONS

Korean Office Action issued on Aug. 5, 2011, in counterpart Korean Application No. 10-2010-0066398 (4 pages).

(Continued)

*Primary Examiner* — Benny Lee
*Assistant Examiner* — Gerald Stevens
(74) *Attorney, Agent, or Firm* — NSIP Law

(57) ABSTRACT

Various multi-mode resonant filters including a housing having a cavity, are provided. The multi-mode resonant filters include a Dielectric Resonant (DR) element received in the cavity of the housing, and a plurality of transmission lines for connecting a point on one of a first axis, a second axis, and a third axis with a point on another axis. The first axis, the second axis, and the third axis are orthogonal to each other with respect to a center of the DR element.

31 Claims, 53 Drawing Sheets

(56) References Cited

FOREIGN PATENT DOCUMENTS

| | | | |
|---|---|---|---|
| JP | 2001-060805 | A | 3/2001 |
| JP | 2008-295024 | | 12/2008 |
| JP | 2009-77020 | A | 4/2009 |
| KR | 10-2001-0023327 | | 3/2001 |
| KR | 10-0338593 | B1 | 5/2002 |
| WO | WO 2005/069425 | A1 | 7/2005 |

OTHER PUBLICATIONS

Decision on Grant dated Mar. 20, 2012, in counterpart Korean Patent Application No. 10-2010-0066398 (5 pages).

European Search Report mailed Jul. 2, 2012 in counterpart European Patent Application No. 10751761.7 (4 pages, in English).

International Search Report dated Feb. 25, 2011, in corresponding International Application No. PCT/KR2010/004494 (3 pages).

Japanese Decision on Grant issued Apr. 2, 2013 in counterpart Japanese Application No. 2011-522020 (3 pages in Japanese).

Japanese Office Action issued on Jan. 31, 2012.

Chinese Office Action issued Aug. 27, 2013 in counterpart Chinese Application No. 201080001222.5 (22 pages including English Translation).

Korean Decision on Grant issued Oct. 13, 2013 in counterpart Korean Application No. 10-2011-0101510. (6 pages in Korean).

* cited by examiner

MULTI-MODE RESONANT FILTER

CROSS REFERENCE TO RELATED APPLICATION(S)

This application claims the benefit under 35 U.S.C. §119 (a) of Korean Patent Application No. 10-2009-0063222, filed on Jul. 10, 2009, in the Korean Intellectual Property Office, and this application the benefit under 35 U.S.C. §119(e) of U.S. provisional application Nos. 61/224,523 and 61/243,177, filed on Jul. 10, 2009 and Sep. 17, 2009, respectively, the entire disclosures of which are incorporated herein by reference for all purposes.

BACKGROUND

1. Field

The following description relates to a resonator, and more particularly, to a multi-mode (or multi-resonant mode) resonator for outputting resonance frequencies of a plurality of resonant modes and a multi-mode resonant filter using the same.

2. Description of the Related Art

Generally, a high-frequency filter using a Dielectric Resonator (DR), such as a DR filter, a cavity filter, a wave guide filter, and the like, has a circuit tub for resonance of a high frequency, especially a super high frequency. A general resonant circuit is formed using coils and capacitors and is not suitable for forming a super high frequency because of its large radiation loss. For this reason, generally a Radio Frequency (RF) filter is formed by using a plurality of resonators, each of which has a circuit device for resonating at a particular frequency by means of a combination of inductors (L) and capacitors (C). The RF filter typically includes a Dielectric Resonant (DR) element or a metal resonant rod inside a cavity of a metal cylinder or a rectangular hexahedron surrounded by a conductor, such that only an electromagnetic field having a unique frequency exists in a receiving space (cell), thereby allowing super high frequency resonance.

FIG. 1 illustrates a conventional 8-pole band-pass filter (BPF).

Referring to FIG. 1, the conventional BPF includes a housing 11 having 8 cavities partitioned with a predetermined interval therebetween in a hexahedral metal. Each of the cavities includes a DR element 13 having high Q value that is fixed using a support member. The BPF also includes input/output connectors 17 mounted on a side of the housing 11 and a cover 12 for shielding an opening of the housing 11. To adjust the amount of coupling between DR elements 13, the cavities of the housing 11 are partitioned by partitions in which windows having a predetermined size are formed. The inner surface of the housing 11 is plated with silver to stabilize electrical performance and to maximize conductivity. The window formed in each partition is cut by a predetermined interval perpendicularly from the bottom surface of the cavity. The amount of coupling between the DR elements 13 mounted in the cavities is adjusted according to the size of the window to suppress the occurrence of spurious waves. In each window is provided a coupling screw 15, which may be inserted into the window through the housing 11, thereby fine-tuning the amount of coupling.

The DR element 13 mounted in each cavity of the housing 11 is supported by an upright support member provided from the bottom surface, and a tuning screw 14 is provided on the top surface of the DR element 13 to control frequency. On the side of the housing 11, are provided input and output connectors 17 which are connected to input and output feed lines 16.

The input feed line delivers a signal coming from the input connector to the first DR element, while the output feed line delivers a signal coming from the final DR element to the output connector.

Referring to the conventional band-pass filter (or band-rejection filter), to make a filter having a plurality of poles, a plurality of cavities and coupling means for coupling between the DR elements 13 are required. Because the single DR element 13 uses a single resonant mode, to make a multi-mode BPF having a plurality of poles, a plurality of cavities and a plurality of DR elements 13 are required and coupling means for coupling between the DR elements 13 are additionally required. Accordingly, a large space sufficient to receive the cavities and the coupling means are necessary inside the filter, which increases the size and weight of the multi-mode BPF. Therefore, for a small and lightweight filter, it is essential to reduce the number of cavities and DR elements. If the number of cavities and DR elements increases, the size, weight, and manufacturing cost of the filter also increases.

As disclosed in International Patent Publication No. WO 2005/069425 and Japanese Patent Publication Gazette No. 2001-60804, there were attempts to implement a plurality of modes using a single resonant element. However, in the disclosed techniques, a DR element is in a relatively complex polygonal shape, making a process of manufacturing the resonant element very complicated and thus increasing the manufacturing cost of the resonant element. An example of realizing a complex polygonal resonant element and a resonant filter using the same into real products has not yet been identified.

SUMMARY

In one general aspect, there is provided a multi-mode resonant filter comprising a housing having a cavity therein, a Dielectric Resonant (DR) element received in the housing, the DR element forming a plurality of resonant modes in different directions, a first transmission line aligned along a first direction in which a first resonant mode among the plurality of resonant modes is formed, a second transmission line aligned along a second direction in which a second resonant mode among the plurality of resonant modes is formed, the second resonant mode being different from the first resonant mode, and a third transmission line aligned along a third direction in which a third resonant mode among the plurality of resonant modes is formed, the third resonant mode being different from the first resonant mode and the second resonant mode, wherein the first transmission line, the second transmission line, and the third transmission line couple the first resonant mode, the second resonant mode, and the third resonant mode with each other through direct connection or coupling.

The multi-mode resonant filter may further comprise an input connector fixed to a side of the housing, to which an input signal is input, and an output connector fixed to another side of the housing, from which an output signal is output, wherein the first transmission line and the second transmission line are connected to the input connector, and the third transmission line is directly connected to the output connector.

The multi-mode resonant filter may further comprise an input connector fixed to a side of the housing, to which an input signal is input, an output connector fixed to another side of the housing, from which an output signal is output, and an auxiliary transmission line, wherein the first transmission line and the second transmission line are connected to the input connector, the third transmission line is directly connected to the output connector, and the auxiliary transmission line is connected to one of the input connector and the output connector.

The first resonant mode, the second resonant mode, and the third resonant mode may be orthogonal to each other.

The plurality of resonant modes may be substantially identical resonant modes which are formed in different directions.

The plurality of resonant modes may be TE01δ modes.

The DR element may be formed in a substantially spherical, cylindrical, or rectangular hexahedral shape.

An inner circumferential surface and an outer circumferential surface of the housing may be formed in a substantially spherical, cylindrical, or rectangular hexahedral shape.

The first transmission line, the second transmission line, and the third transmission line may each be formed in a bar shape, a rod shape, or a plate shape.

The first transmission line, the second transmission line, and the third transmission line may be aligned between an inner circumferential surface of the housing and an outer circumferential surface of the DR element.

The shape of at least a portion of the first transmission line, the second transmission line, and the third transmission line may correspond to a shape of the DR element or the housing.

The multi-mode resonant filter may further comprise a support member, an end of which is connected to a bottom surface of the DR element and another end of which is connected to an inner circumferential surface of the housing, thereby supporting the housing such that the DR element is positioned at a center inside the housing.

The multi-mode resonant filter may further comprise an input connector fixed to a side of the housing, to which an input signal is input, the input connector being directly connected or coupled with the first transmission line, and an output connector fixed to another side of the housing, from which the input signal coupled according to the plurality of coupled resonant modes is output.

An x axis, a y axis, and a z axis may be orthogonal to each other with respect to a center of the DR element, wherein a first end of the first transmission line is positioned on an +x axis and a second end thereof is positioned on a +z axis, a first end of the second transmission line is connected with the second end of the first transmission line on the +z axis and a second end thereof is positioned on a +y axis, and a first end of the third transmission line is connected with the first end of the first transmission line on the +x axis and a second end thereof is connected with the second end of the second transmission line on the +y axis.

An x axis, a y axis, and a z axis may be orthogonal to each other with respect to a center of the DR element, wherein a first end of the first transmission line is positioned on an +x axis and a second end thereof is positioned on a +z axis, a first end of the second transmission line is connected with the second end of the first transmission line on the +z axis and a second end thereof is positioned on a +y axis, and a first end of the third transmission line is connected with the second end of the second transmission line on the +y axis and a second end thereof is positioned at a point on a −x axis.

An x axis, a y axis, and a z axis may be orthogonal to each other with respect to a center of the DR element, wherein a first end of the first transmission line is positioned on an +x axis and a second end thereof is positioned on a +z axis, a first end of the second transmission line is connected with the second end of the first transmission line on the +z axis and a second end thereof is positioned on a +y axis, a first end of the third transmission line is connected with the second end of the second transmission line on the +y axis and a second end thereof extends toward a −x axis, and the multi-mode resonant filter further comprises a fourth transmission line which is connected with the first end of the first transmission line and extends toward the −y axis and an open structure made of a metallic material, the open structure being connected to a first end of the fourth transmission line.

The first transmission line may comprise a first sub transmission line and a second sub transmission line which are aligned such that a portion of the first sub transmission line and a portion of the second sub transmission line overlap each other, and the second transmission line may comprise a third sub transmission line and a fourth sub transmission line which are aligned such that a portion of the third sub transmission line and a portion of the fourth sub transmission line overlap each other.

An x axis, a y axis, and a z axis may be orthogonal to each other with respect to a center of the DR element, wherein the first transmission line includes a transmission line #1-1 and a transmission line #1-2, a first end of the transmission line #1-1 is positioned at a point on an +x axis and a second end thereof is grounded with an inner bottom surface of the housing, a first end of the transmission line #1-2 is positioned on a point on an +z axis and a second end thereof is grounded with an inner top surface of the housing, the second transmission line includes a transmission line #2-1 and a transmission line #2-2, a first end of the transmission line #2-1 is positioned at a point on an +y axis and a second end thereof is grounded with an inner bottom surface of the housing, a first end of the transmission line #2-2 is connected with the first end of the transmission line #1-1 on an +x axis and a second end thereof is grounded with an inner top surface of the housing, the third transmission line includes a first auxiliary transmission and a second auxiliary transmission line, a first end of the first auxiliary transmission line is connected with the first end of the transmission line #1-1 and a second end thereof extends toward an −y axis, and a first end of the second auxiliary transmission line is connected with the first end of the transmission line #2-1 and a second end thereof extends toward an −x axis.

The multi-mode resonant filter may further comprise a third auxiliary transmission line, wherein a first end of the third sub transmission line is connected with the first end of the transmission line #2-1 on an +y axis and a second end thereof extends toward the +z axis.

The housing may be formed in a substantially rectangular hexahedral shape and the DR element may be formed in a substantially cylindrical shape.

An x axis, a y axis, and a z axis may be orthogonal to each other with respect to a center of the DR element, wherein a first end of the first transmission line is positioned on an +x axis and a second end thereof extends toward an +z axis, the second transmission line includes a transmission line #2-1 and a transmission line #2-2, a first end of the transmission line #2-1 is positioned on an +y axis and a second end thereof extends toward the +z axis, a first end of the transmission line #2-2 is positioned on an −y axis and a second end thereof extends toward the +z axis, the third transmission line includes a transmission line #3-1 and a transmission line #3-2, a first end of the transmission line #3-1 is connected with the first end of the transmission line #2-1 on the +y axis and a second end thereof is positioned on an −x axis, and a first end of the transmission line #3-2 is connected with the first end of transmission line #2-2 on the −x axis and a second end thereof is connected with the first end of the first transmission line on the +x axis.

A second end of the first transmission may be positioned on the +z axis.

The multi-mode resonant filter may further comprise an input connector fixed to a side of the housing, to which an input signal is input, and an output connector fixed to another side of the housing, from which an output signal is output, wherein the first transmission line includes a transmission line #1-1 and a transmission line #1-2, a first end of the transmission line #1-1 is connected with the input connector and a second end thereof extends toward the +z axis, and a second end of the transmission line #3-1 is connected with the output connector.

The multi-mode resonant filter may further comprise an input connector fixed to a side of the housing, to which an input signal is input, and an output connector fixed to another side of the housing, from which an output signal is output, wherein the first transmission line includes a transmission line #1-1 and a transmission line #1-2, a first end of the transmission line #1-1 is connected with the input connector and a second end thereof extends toward the +z axis, and a first end of the transmission line #2-1 is connected with the output connector.

An x axis, a y axis, and a z axis may be orthogonal to each other with respect to a center of the DR element, wherein a first end of the first transmission line is positioned on an +x axis and a second end thereof is positioned on an +z axis, a first end of the second transmission line is connected with the second end of the first transmission line on the +z axis and a second end thereof is positioned on an +y axis, a first end of the third transmission line is connected with the second end of the second transmission line on the +y axis and a second end thereof is positioned on an −y axis, and the multi-mode resonant filter further comprises an input connector connected with the first end of the first transmission line on the +x axis, and an output connector connected with the second end of the third transmission line.

An x axis, a y axis, and a z axis may be orthogonal to each other with respect to a center of the DR element, a first end of the second transmission line is positioned on an +z axis and a second end thereof is positioned on an +y axis, a first end of the third transmission line is connected with the second end of the second transmission line on the +y axis and a second end thereof is grounded to an inner wall of the housing on an −x axis, a first end of the first transmission line is positioned on an +x axis and a second end thereof is connected with the second transmission, the second end of the first transmission being spaced apart from the +z axis, and the multi-mode resonant filter further comprises an input connector connected with the first end of the first transmission line on the +x axis, an output connector connected with the second end of the second transmission line on the +y axis, and an auxiliary line connected with the second end of the second transmission line on the +y axis and extends toward the +x axis.

An x axis, a y axis, and a z axis may be orthogonal to each other with respect to a center of the DR element, wherein a first end of the first transmission line is positioned on an +x axis and a second end thereof is positioned on an +z axis, a first end of the third transmission line is positioned on an +y axis and a second end thereof is grounded to an inner wall of the housing on an −x axis, a first end of the second transmission line is connected with the first end of the third transmission line on the +y axis and a second end thereof is connected with the first transmission, the second end of the first transmission being spaced apart from the +z axis, and the multi-mode resonant filter further comprises an input connector connected with the first end of the first transmission line on the +x axis, an output connector connected with the second end of the second transmission line on the +y axis, and an auxiliary line connected with the second end of the second transmission line on the +y axis and extends toward the +x axis.

An x axis, a y axis, and a z axis which may be orthogonal to each other with respect to a center of the DR element, wherein the first transmission line includes a transmission line #1-1 and a transmission line #1-2, a first end of the transmission line #1-1 is connected with an input probe on an +x axis and a second end thereof extends toward an +z axis, a first end of the transmission line #1-2 is connected with an output probe on an −x axis and a second end thereof extends toward the +z axis, a first end of the second transmission line is positioned on an +y axis and a second end thereof extends toward the +z axis, the third transmission line includes a transmission line #3-1 and a transmission line #3-2, a first end of the transmission line #3-1 is connected with an input probe on the +x axis and a second end thereof is positioned on the +y axis, and a first end of the transmission line #3-2 is connected with the second end of the transmission line #3-1 on the +y axis and a second end thereof is connected with an output probe on the −x axis.

In another aspect, there is provided a multi-mode resonant filter comprising a housing having a cavity, a Dielectric Resonant (DR) element received in the cavity of the housing, and a plurality of transmission lines for connecting a point on one of a first axis, a second axis, and a third axis with a point on another axis, the first axis, the second axis, and the third axis being orthogonal to each other with respect to a center of the DR element.

The multi-mode resonant filter may further comprise an input connector fixed to a side of the housing, to which an input signal is input, and an output connector fixed to another side of the housing, from which an output signal is output, wherein at least two transmission lines are connected to the input connector and at least one transmission line is connected to the output connector.

Other features and aspect may be apparent from the following description, the drawings, and the claims.

DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein may be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness.

The following description proposes multi-mode resonators and multi-mode resonant filters, which provide a plurality of resonant modes. Typically, three cavities and three Dielectric Resonant (DR) elements were equipped in a multi-mode resonator to provide three resonant modes.

The multi-mode resonators and multi-mode resonant filters described herein may provide three resonant modes merely with a single cavity and a single DR element in the cavity. The number of resonant modes, three, is just an example, and it should be appreciated that the multi-mode resonant filter at least two or more resonant modes, for example, three resonant mode, four resonant modes, five resonant modes, or more. The multi-mode resonators may combine a plurality of $TE_{01}\delta$ modes (e.g., three $TE_{01}\delta$ modes) or a plurality of $TM_{01}\delta$ modes.

In the following description, the term "connection" between components made of metallic materials, such as a transmission line, input/output probes, a ground member, and the housing, includes not only direct connection but also coupling which occurs when the components, although spaced apart from each other by a predetermined interval, exist in such positions as to deliver power by electromagnetic field coupling between them. Accordingly, unless expressly stated, the term may refer to a direct connection or coupling.

Figure 1:
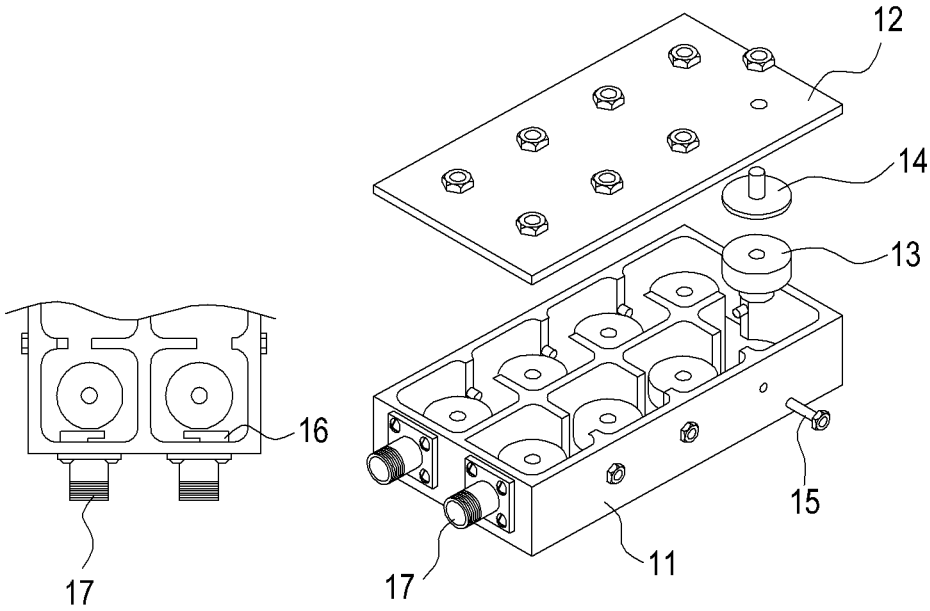
FIG.1 (PRIOR ART)
FIG. 1 is a diagram illustrating an example of a conventional 8-pole Band Pass Filter (BPF).
Figure 2:
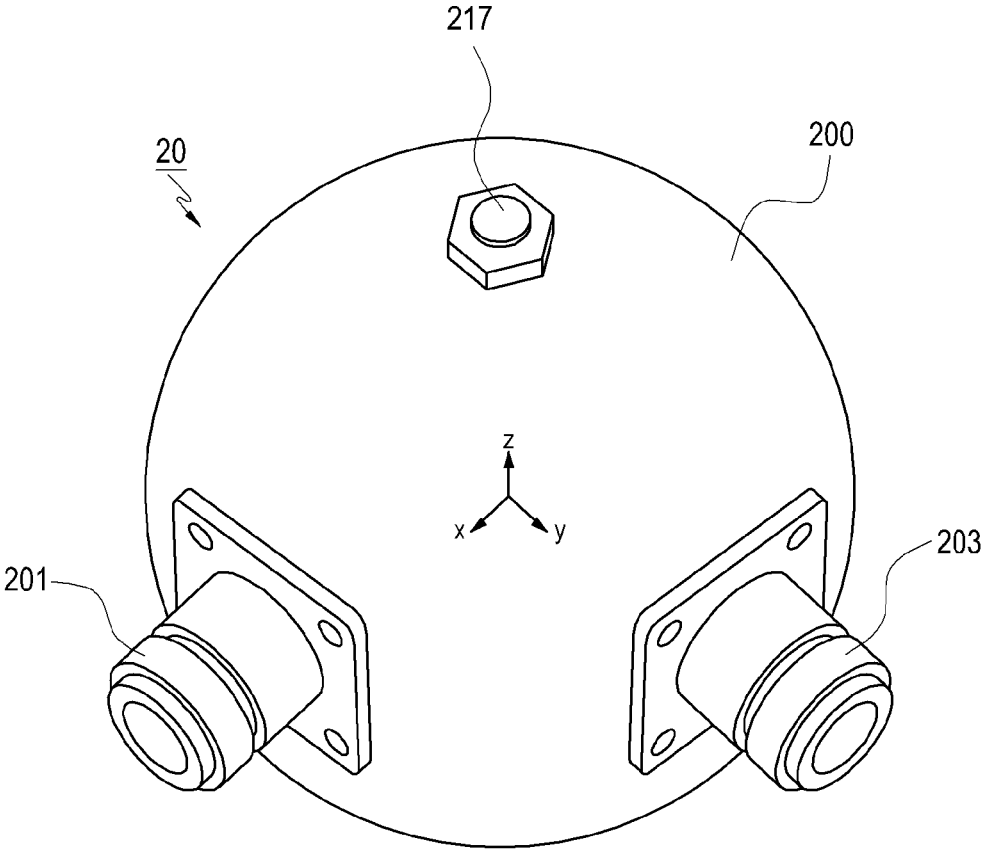
FIGS. 2 and 3 are diagrams illustrating a first example of a multi-mode resonant filter equivalent to a band-pass filter (BPF).
Figure 3:
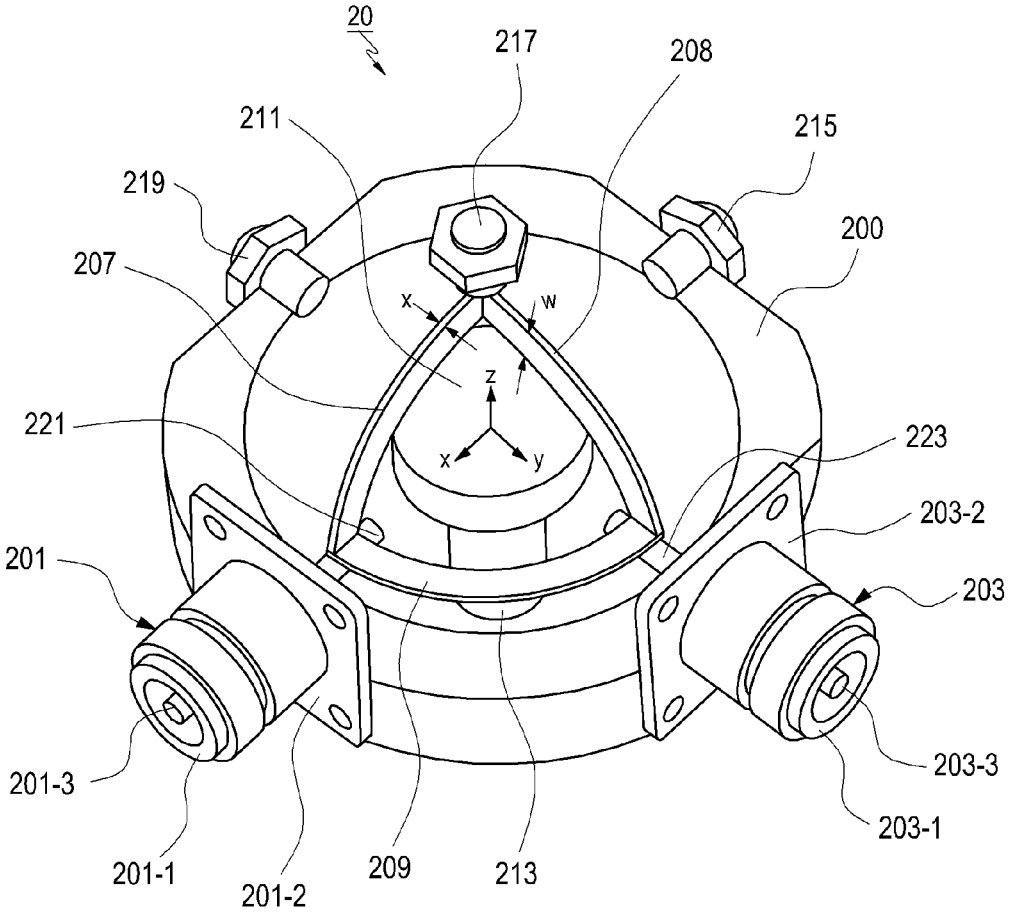

FIG. 2 illustrates a first example of a multi-mode resonant filter, and FIG. 3 illustrates an example where the housing shown in FIG. 2 is partially removed to show the implementation of a Band Pass Filter (BPF).

Referring to FIGS. 2 and 3, a multi-mode resonant filter 20 includes a housing 200 that has a cavity in a spherical or sphere-like shape in which an air layer is formed. For example, an inner circumferential surface of the housing 200 may be formed in a substantially spherical shape. The housing 200 may be formed of a metallic material, for example, aluminum, magnesium, a plastic structure plated with silver, and the like. In the housing 200 is a single cavity that is not partitioned into a plurality of independent spaces by structures such as partitions.

The outer circumferential surface of the housing 200 may be formed in a substantially spherical shape. The multi-mode resonant filter 20 also includes a DR element 211 located near the center of the cavity of the housing 200. The DR element 211 may also be designed to have a spherical or sphere-like shape. The DR element 211 may be formed of dielectrics made of various materials having a relative dielectric constant $\in_r$ between 20 and 90, such as an electro-ceramic material.

The DR element 211 may be supported by a support member 213 made of, for example, $Al_2O_3$, Teflon, engineering plastic, and the like. The support member 213 has a dielectric constant between 2 and 15 which is lower than that of the DR element 211, thus preventing degradation of a quality factor Q of the filter 20. The support member 213 may be formed in a cylindrical shape. In this example, one end of the support member 213 is connected to the bottom surface of the DR element 211 and the other end is connected to the inner circumferential surface of the housing 200 such that the DR element 211 is supported to be positioned at the center of the cavity of the housing 200. The diameter of the support member 213, although smaller than that of the DR element 211, may be sufficient to support the DR element 211.

The multi-mode resonant filter 20 also includes at least one transmission line, for example, a first transmission line 207 and a second transmission line 208 shown in FIGS. 2 and 3. The transmission lines may be used to connect a point present on an axis with a point on another axis. For example, the transmission line may connect a point on an x axis selected in advance from among the x axis, a y axis, and a z axis, with a point on the z axis. In this example, the x axis, y axis, and z axis are orthogonal to each other and independently of each other, with respect to a central point of the DR element 211. The at least one transmission line may be spaced apart from other transmission lines by an interval in the cavity between the DR element 211 and the inner surface of the housing 200. That is, the at least one transmission line may be disposed spaced apart from the DR element 211 and the housing 200, respectively.

In the example of FIGS. 2 and 3, include the first transmission line 207 for connecting a point on the x axis with a point on the z axis, the second transmission line 208 for connecting a point on the z axis with a point on the y axis, and a third transmission line 209 for connecting a point on the y axis with a point on the x axis.

The first, second, and third transmission lines 207, 208, and 209 may be formed of a metal in the shape of a bar, for example, as shown in the drawings, but may also be formed in the shape of a rod or a plate, without being limited thereto. The first, second, and third transmission lines 207, 208, and 209 may be formed in the shape of a curve corresponding to the shape of the outer circumferential surface of the DR element 211 and the shape of the inner circumferential surface of the housing 200, or in the shape of a straight line.

Figure 4:
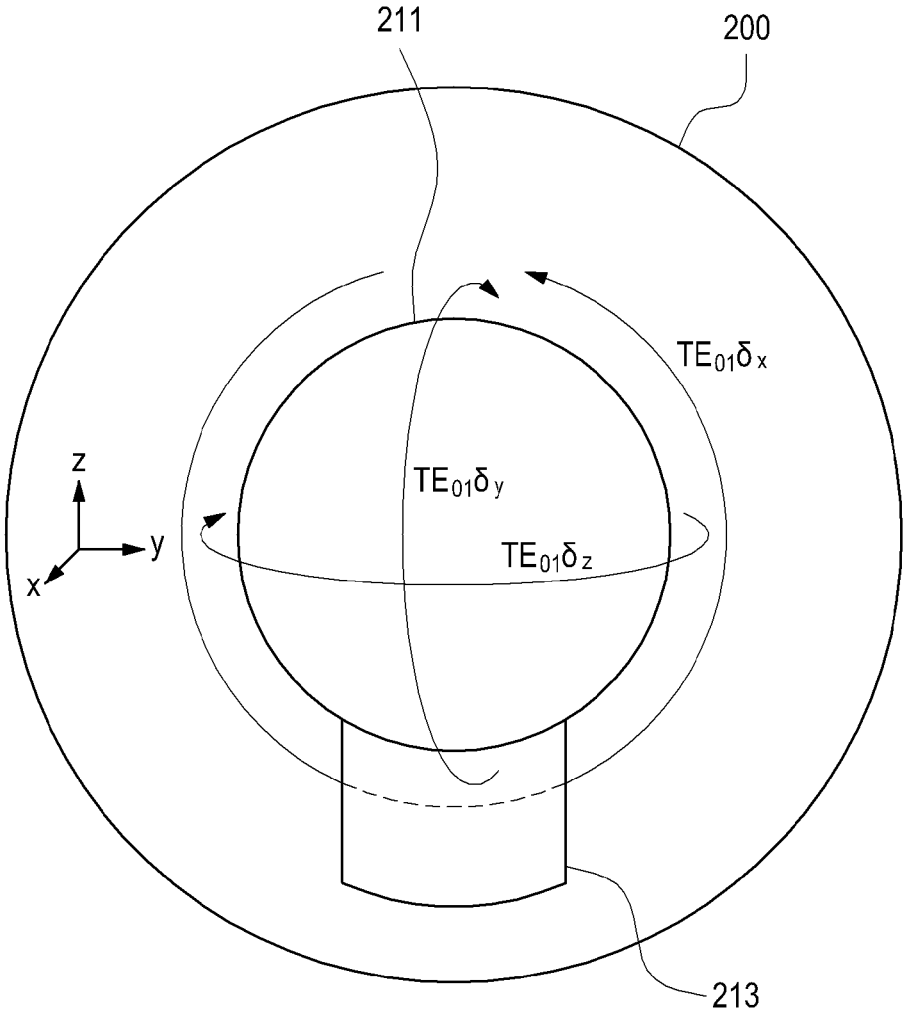
FIG. 4 is a diagram illustrating an example of resonant modes formed by a dielectric resonator.

FIG. 4 illustrates an example of resonant modes formed by a DR element.

Referring to FIG. 4, the DR element 211 is in a substantially spherical shape and includes three substantially identical resonant modes which are orthogonal to each other. The plurality of resonant modes may be orthogonal to each other if DR element 211 is in a cylindrical shape or rectangular hexahedral shape, or the DR element 211 is in a substantially cylindrical shape or rectangular hexahedral shape even when a portion is removed from the cylindrical shape or the rectangular hexahedral shape.

For example, as shown in FIG. 4, the three resonant modes are $TE_{01}\delta$ modes. The modes may be classified into a $TE_{01}\delta_x$ mode in which a dominant resonance is formed on a plane (y-z plane) perpendicular to the x axis, a $TE_{01}\delta_y$ mode in which a dominant resonance is formed on a plane (z-x plane) perpendicular to the y axis, and a $TE_{01}\delta_z$ mode in which a dominant resonance is formed on a plane (x-y plane) perpendicular to the z axis. The $TM_{01}\delta$ modes may be formed by the DR element 211. The $TM_{01}\delta$ modes may also be classified into a $TM_{01}\delta_x$ mode in which a dominant resonance is formed on a plane (y-z plane) perpendicular to the x axis, a $TM_{01}\delta_y$ mode in which a dominant resonance is formed on a plane (z-x plane) perpendicular to the y axis, and a $TM_{01}\delta_z$ mode in which a dominant resonance is formed on a plane (x-y plane) perpendicular to the z axis. In this example, the directions of the $TM_{01}\delta_x$ mode, the $TM_{01}\delta_y$ mode, and the $TM_{01}\delta_z$ mode are substantially identical to those of the $TE_{01}\delta_x$ mode, the $TE_{01}\delta_y$ mode, and the $TE_{01}\delta_z$ mode shown in FIG. 4, respectively.

Referring again to the example shown in FIG. 2, the first transmission line 207 may be aligned along the direction of a first resonant mode (for example, the $TE_{01}\delta_y$ mode) where a dominant resonance is formed on the plane perpendicular to the y axis, thus being coupled with a magnetic field (or an electric field) of the first resonant mode (for example, the $TE_{01}\delta_y$ mode). The first transmission line 207 may also be installed to couple a magnetic field (or an electric field) of a second resonant mode (for example, the $TE_{01}\delta_x$ mode) where a dominant resonance is formed on the plane perpendicular to the x axis, with a magnetic field (or an electric field) of a third resonant mode (for example, the $TE_{01}\delta_z$ mode) where a dominant resonance is formed on the plane perpendicular to the z axis.

Likewise, the second transmission line 208 may be aligned along the direction of the second resonant mode (for example, the $TE_{01}\delta_x$ mode) where a dominant resonance is formed on the plane perpendicular to the x axis, thus being coupled with the second resonant mode (for example, the $TE_{01}\delta_x$ mode). The second transmission line 208 may also be installed to couple a magnetic field (or an electric field) of a third resonant mode (for example, the $TE_{01}\delta_z$ mode) where a dominant resonance is formed on the plane perpendicular to the z axis, with a magnetic field (or an electric field) of the first resonant mode (for example, the $TE_{01}\delta_y$ mode) where a dominant resonance is formed on the plane perpendicular to the y axis.

The third transmission line 209 may be aligned along the direction of the third resonant mode (for example, the $TE_{01}\delta_z$ mode) where a dominant resonance is formed on the plane perpendicular to the z axis, thus being coupled with the third resonant mode (for example, the $TE_{01}\delta_z$ mode). The third transmission line 209 may provide notches in the filter characteristics by coupling the magnetic field (or the electric field) of the first resonant mode with that of the third resonant mode.

Referring again to FIGS. 2 and 3, a first end of the first transmission line 207 is positioned on the x axis, and a second end thereof is positioned on the z axis. The first end of the second transmission line 208 is connected with the second end of the first transmission line 207 on the z axis, and the second end of the second transmission line 208 is positioned on the y axis. Also, the first end of the third transmission line 209 is connected with the first end of the first transmission line 207 on the x axis, and the second end thereof is connected with the second end of the second transmission line 208 on the y axis.

Accordingly, the three orthogonal resonant modes may be coupled to each other using the first transmission line 207 and the second transmission line 208. For example, by interconnecting the first transmission line 207 and the second transmission line 208 and when the DR element 211 is in a simple shape like a sphere, the plurality of resonant modes formed by the DR element 211 may be easily coupled. Notches may be provided using the third transmission line 208 and the position of the notches may be easily adjusted, thereby facilitating implementation of desired filter characteristics. A method for adjusting the number of notches and their positions is further described herein. The third transmission line 209 may be omitted according to filter implementation. In the housing 200, an input connector 201 may be installed in a portion facing an end of the first transmission line 207 on the x axis and an output connector 203 may be installed in a portion facing an end of the second transmission line 208 on the y axis.

For example, on the housing 200, the input connector 201 may be installed in a position corresponding to a first contact where the second end of the first transmission line 207 and the first end of the third transmission line 209 are coupled (for example, a position closest to the first contact on the housing 200). In this example, the input connector 201 includes a connecting portion 201-1 positioned outside the housing 200 and configured to be detachably coupled with a signal input device, a quadrangular fixing plate 201-2 for fixing the input connector 201 to the outer circumferential surface of the housing 200, and a center pin 201-3 positioned inside the connecting portion 201-1 for delivering an input signal into the housing 200. For example, referring to FIGS. 2 and 3, the connecting portion 201-1 and the center pin 201-3 of the input connector 201 may be aligned on an imaginary line extending along the x axis from the center of the DR element 211. A portion on the outer circumferential surface of the housing 200, to which the input connector 201 is fixed, may be flat, thereby allowing the fixing plate 201-2 to be mounted thereon.

On the housing 200, the output connector 203 may be installed in a position corresponding to a second contact where the second end of the second transmission line 208 and the second end of the third transmission line 209 are coupled (for example, a position closest to the second contact on the housing 200). The output connector 203 includes a connecting portion 203-1 positioned outside the housing 200 and configured to be detachably coupled with a signal output device, a quadrangular fixing plate 203-2 for fixing the output connector 203 to the outer circumferential surface of the housing 200, and a center pin 203-3 positioned inside the connecting portion 203-1 to receive an output signal from the filter 20. For example, referring to FIGS. 2 and 3, the connecting portion 203-1 and the center pin 203-3 of the output connector 203 may be aligned on the y axis with respect to the center of the DR element 211. A portion on the outer circumferential surface of the housing 200, to which the output connector 203 is fixed, may be flat, thereby allowing the fixing plate 203-2 to be mounted thereon.

In this example, the first end of an input probe 221 is connected to the center pin 201-3 of the input connector 201 to deliver the input signal to the input probe 221. A second end of the input probe 221 is aligned inside the housing 200. The input probe 221 is aligned spaced apart from the first transmission line 207 and the third transmission line 209, but may provide an input signal to the first transmission line 207 and the third transmission line 209 through coupling. A first end of an output probe 223 is connected to the center pin 203-3 of the output connector 203. A second end of the output probe 223 is aligned inside the housing 200. The output probe 223 is aligned spaced apart from the second transmission line 208 and the third transmission line 209, but may receive the output signal from the second transmission line 208 and the third transmission line 209 through coupling. The input connector 201 and the output connector 203 may be installed on any of the x axis, the y axis, and the z axis. That is, the input connector 201 and the output connector 203 may be installed in a position of the housing 200 such that the input connector 201 intersects the x axis, the y axis, or the z axis.

The input connector 201 is positioned on an imaginary line extending along the x axis from the center of the DR element 211, such that the imaginary line goes through the center of the input connector 201. The output connector 203 is positioned on an imaginary line extending along the y axis from the center of the DR element 211, such that the imaginary line goes through the center of the output connector 203. Accordingly, the input connector 201 and the output connector 203 are aligned to form an angle of approximately 90° therebetween with respect to the center of the DR element 211.

In this example, a plurality of first through third tuning probes 215, 217, and 219 for tuning a resonance frequency and adjusting an inter-resonance coupling value may be installed on and between poles with respect to the x axis, the y axis, and the z axis in the housing 200. The tuning probes 215, 217, and 219 may be used to fine-tune the resonance frequency and coupling value in their positions and may be omitted if desired. For example, the first probe 215 may be positioned on the x axis on the opposite side of the input connector 201 on the housing 200. The second probe 217 may be positioned on the y axis on the opposite side of the output connector 203 on the housing 200. The third connector 219 may be positioned on the z axis on a top portion of the housing 200. Portions where the tuning probes 215, 217, and 219 are positioned on the outer circumferential surface of the housing 200 may be flat, thereby allowing the tuning probes 215, 217, and 219 to be mounted thereon.

The tuning probes 221 and 223 may also be installed on the input connector 201 and the output connector 203, and may be designed in the shape of pins which may be withdrawn from or inserted into the center pin 201-3 of the input connector 201 and the center pin 203-3 of the output connector 203 by means of a screw-coupling structure. In this example, the tuning probes 221 and 223 are installed to be slightly spaced apart from the first transmission line 207 or the second transmission line 208. For example, the tuning probes 221 and 223 may be an input probe 221 and an output probe 223.

Accordingly, the tuning probes 221 and 223 installed on the input connector 201 and the output connector 203 may adjust the amount of coupling between the DR element 211 and the first transmission line 207 or the second transmission line 208 and resonance frequencies as well as a feed power.

In this example, the probes 215, 217, 219, 221, and 223 and the transmission lines 207, 208, and 209 are spaced apart from each other.

As shown in the drawings, each of the first transmission line 207, the second transmission line 208, and the third transmission line 209 may be designed in an arch or in a curved shape. The transmission lines 207, 208, 209 may be used to couple a resonance frequency of each axis to an adjacent axis. Accordingly, the structures of the transmission lines 207, 208, 209 may be designed by adjusting a width w and a thickness t thereof.

The first transmission line 207, the second transmission line 208, and the third transmission line 209 may be fixed to a position on an inner wall of the housing 200 by a support member (not shown) made of a material such as Teflon. Although the first transmission line 207, the second transmission line 208, and the third transmission line 209 are positioned in the cavity inside the housing 200 in the example shown in FIGS. 2 and 3, at least a portion of the first transmission line 207, the second transmission line 208, and/or the third transmission line 209 may be positioned outside the housing 200.

When the first transmission line 207, the second transmission line 208, and/or the third transmission line 209 are positioned outside the housing 200, an additional connection member may be used as a connecting pin or a connecting line to connect both ends of each transmission line to the x axis, the y axis, and/or the z axis via the housing 200. When a portion of the first transmission line 207, the second transmission line 208, and/or the third transmission line 209 are positioned outside the housing 200, a through hole for allowing a portion of the first transmission line 207, the second transmission line 208, and/or the third transmission line 209 may be formed to allow the respective transmission line to go through the housing 200.

In this example, the multi-mode resonant filter 20 may provide a plurality of resonant modes, for example, three resonant modes, by means of a single DR element. The resonant modes may be the $TE_{01}\delta$ modes and the $TM_{01}\delta$ modes.

It should be appreciated, the connection structure between the transmission lines may be changed.

Figure 5:
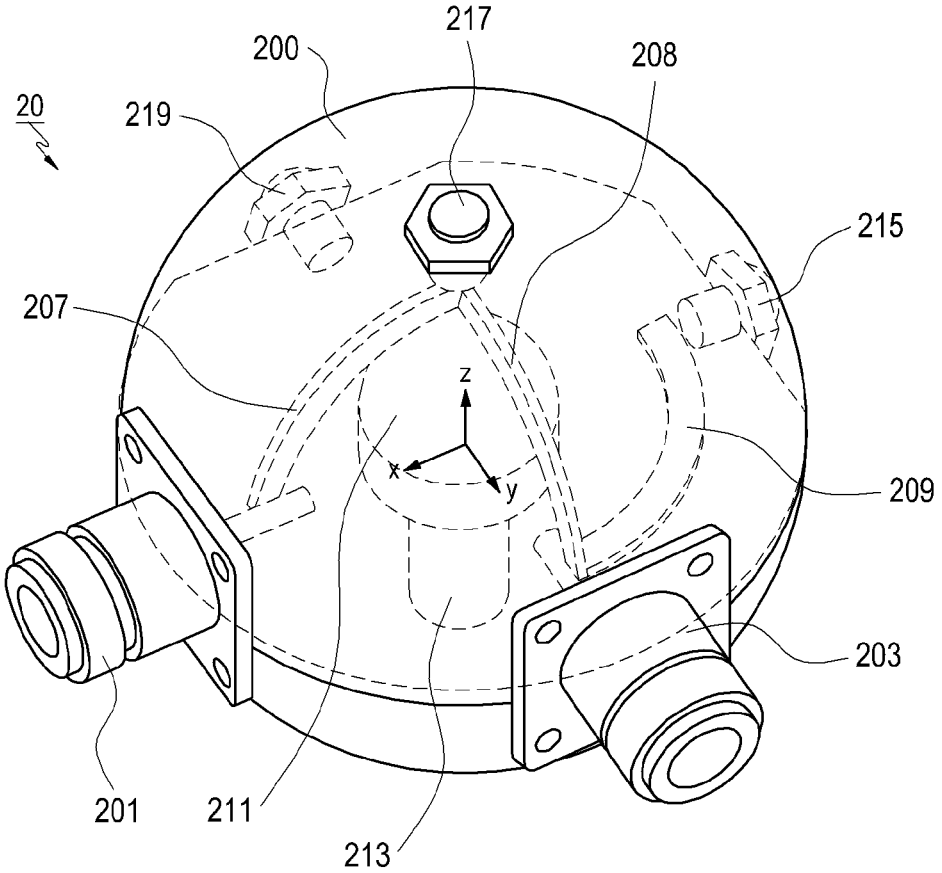
FIG. 5 is a diagram illustrating another connection state of a third transmission line shown in FIGS. 2 and 3.

For example, the third transmission line 209 may connect to a point on a −x axis of a pole opposite to the position of the input connector 201 on the x axis (the position of the tuning probe 215 in FIGS. 2 and 3) and with a point on the y axis. Referring to FIG. 5, as indicated by 209', the third transmission line may connect a +y axis with the −x axis as well as the +x axis with the +y axis. In this example, the second end of the second transmission line 208 and the first end of the third transmission line 209' may be connected with each other, and the second end of the third transmission line 209' may be positioned on the opposite side of the second end of the first transmission line 207 with the DR element 211 therebetween.

Similarly, the positions of the other transmission lines may also be changed to make various connections.

However, except for their starting portions and end portions, the transmission lines should be connected to each other. That is, when the plurality of transmission lines are aligned as shown in FIGS. 2 and 3, a first end of a transmission line is connected with a first end or a second end of another transmission line, whereby the plurality of transmission lines may form a closed loop. In addition, as shown in FIG. 5, an end of a transmission line may be connected with an end of another transmission line, but both ends of the connected transmission lines 207, 208, and 209 may be formed to be opened.

The multi-mode resonant filter 20 may have uniform characteristics along the x axis, the y axis, and the z axis and may have three substantially identical resonant modes which are orthogonal to each other, for example, three $TE_{01}\delta$ modes or three $TM_{01}\delta$ modes, by including a cavity in a spherical or sphere-like shape and the DR element 211 in the housing 200. With the first through third transmission lines structured as described above, three substantially identical resonant modes may be used without degradation of the Q value.

In manufacturing of a multi-mode resonant filter, the shapes and connections of the transmission lines 207, 208, and 209 and the shape of the DR element 211 may be changed depending on the type of mode used, for example, a Transverse Electric (TE) mode or a Transverse Magnetic (TM) mode.

Figure 6:
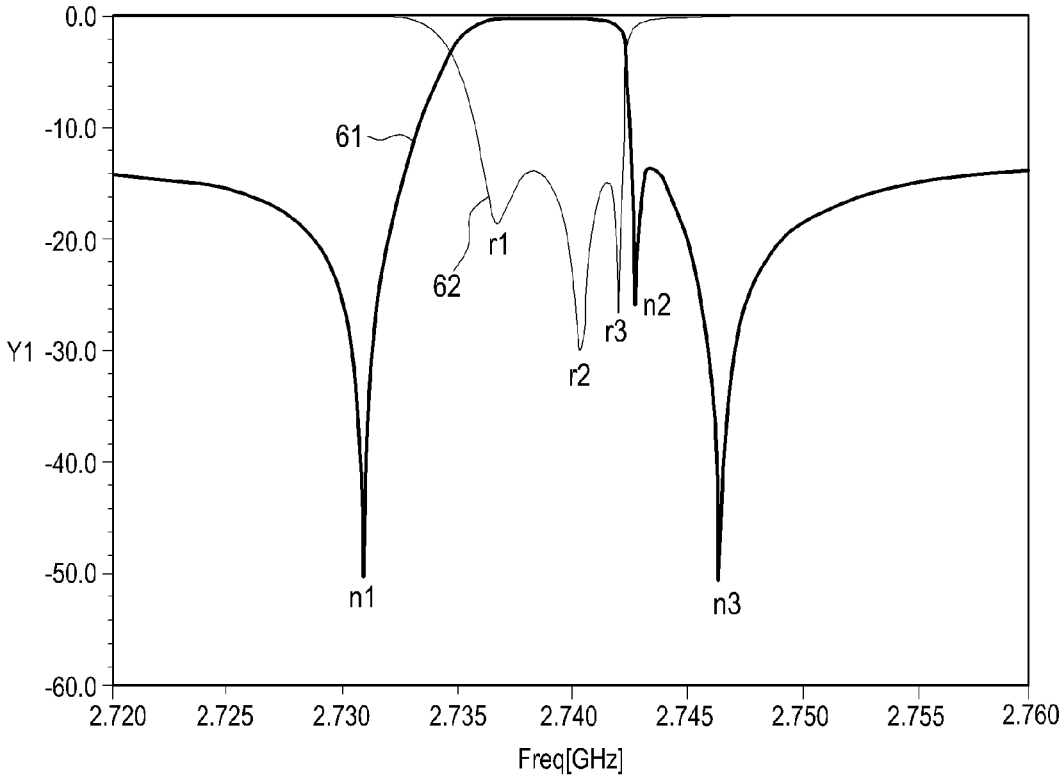
FIG. 6 is a graph illustrating an example of filtering performed by the multi-mode resonant filter shown in FIGS. 2 and 3.

Referring to FIG. 6, the BPF of the first example may cause additional notches to occur in a frequency band higher than a pass band. In FIG. 6, the horizontal axis indicates frequency [GHz] and the vertical axis Y1 indicates attenuation loss. The reference numeral 61 indicates a band-pass characteristic of the BPF, and reference numeral 62 indicates a reflection characteristic. As shown in FIG. 6, the BPF of the first example has a pass band of about 2.737-2.742 GHz, with one notch n1 formed at frequency lower than the pass band and frequency and two notches n2 and n3 formed at frequencies higher than the pass band. Also, the reflection characteristic having three peaks r1, r2, and r3 illustrates that three resonant modes are coupled.

Figure 7:
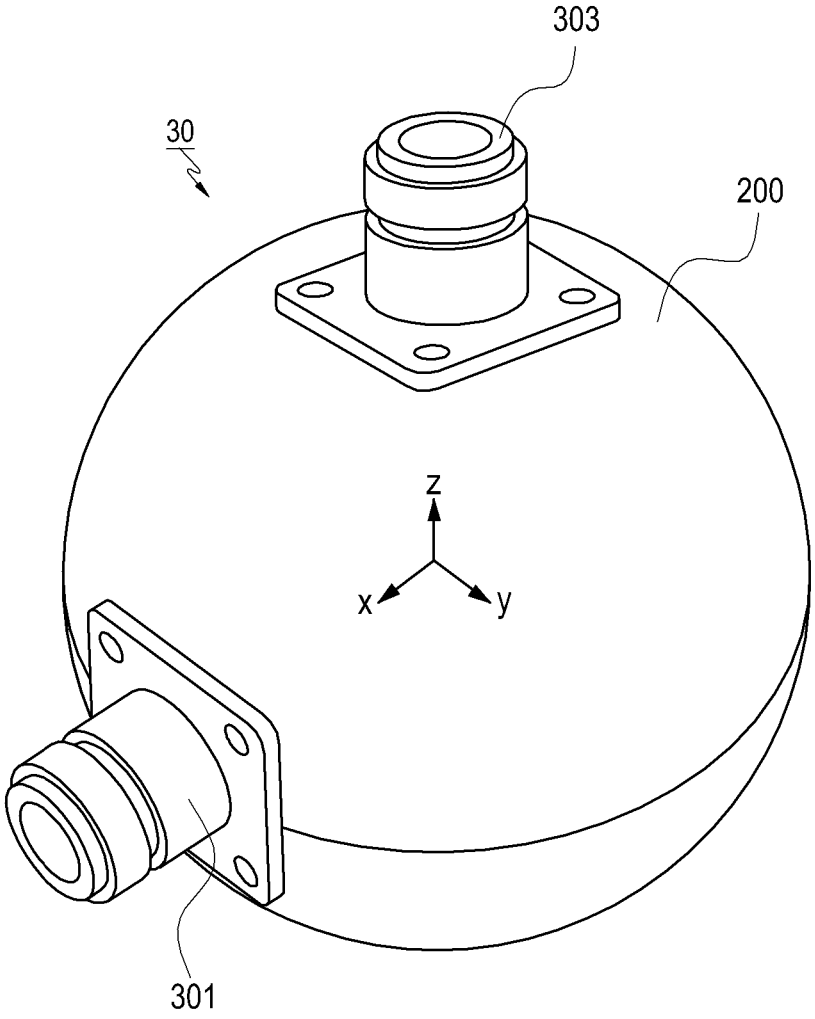
FIGS. 7 and 8 are diagrams illustrating a second example of a multi-mode resonant filter equivalent to a band rejection filter (BRF).
Figure 8:
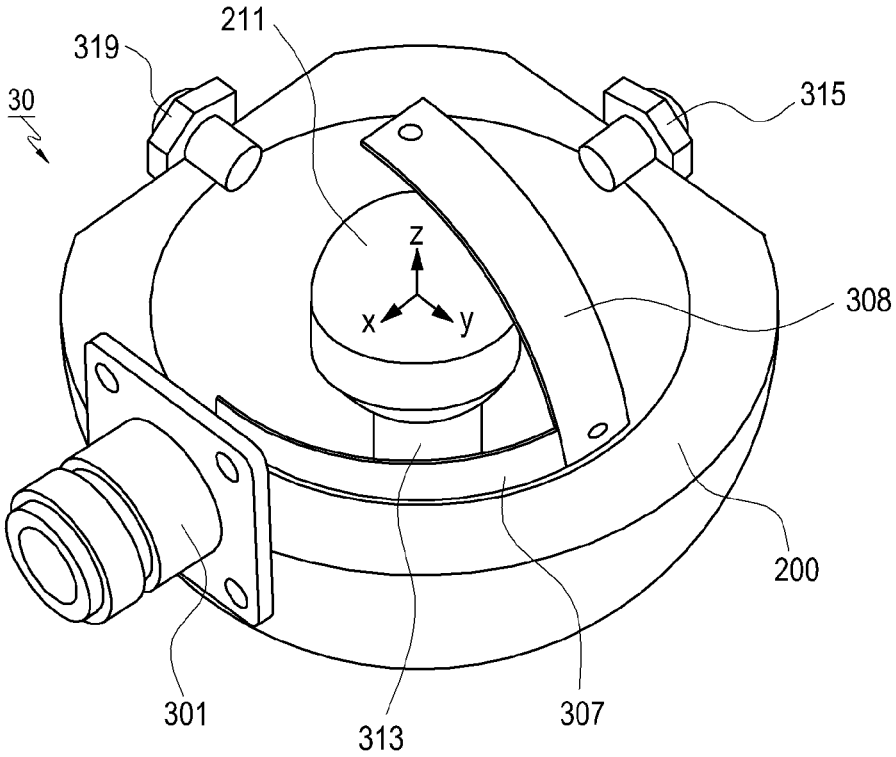

FIG. 7 illustrates a second example of a multi-mode resonant filter, and FIG. 8 illustrates an example where the housing shown in FIG. 7 is partially removed to show implementation of a Band Rejection Filter (BRF).

Referring to FIGS. 7 and 8, like the multi-mode resonant filter 20 according to the first example shown in FIGS. 2 and 3, a multi-mode resonant filter 30 according to the second example includes the housing 200 in a spherical or sphere-like shape, which has a cavity in a spherical or sphere-like shape where an air layer is formed. The multi-mode resonant filter 30 includes a DR element 211 in a spherical or sphere-like shape, which is received in the cavity of the housing 200, a support member 313 for supporting the DR element 211, an input connector 301 formed on a pole of the x axis, an output connector 303 formed on a pole of the z axis, and a plurality of tuning probes 315, 317, and 319 installed on poles of the x axis, the y axis, and the z axis except for the positions where the input connector 301 and the output connector 303 are installed.

The multi-mode resonant filter 30 further includes a first transmission line 307 for connecting a point on the x axis with a point on the y axis and a second transmission line 308 for connecting a point on the y axis with a point on the z axis. In this example, the structure of the first transmission line 307 and the second transmission line 308 are different from that of the first transmission line 207 and the second transmission line 208 shown in FIGS. 2 and 3.

That is, the first transmission line 307 and the second transmission line 308 are designed to have a width and length for an impedance of 60Ω or 75Ω compared to a transmission frequency such that when a signal passes through a transmission line, a frequency band is coupling-canceled by the DR element 211 positioned under the first transmission line 307 and the second transmission line 308, thus allowing the filter 30 to have a band rejection characteristic. The input connector 301 and the output connector 303 are connected directly to a side of the first transmission line 307 and a side of the second transmission line 308, respectively.

For example, the first transmission line 307 may be aligned along the direction of a first resonant mode (for example, the $TE_{01}\delta_z$ mode) where a dominant resonance is formed on the plane perpendicular to the z axis, thus being coupled with a magnetic field (or an electric field) of the first resonant mode (for example, the $TE_{01}\delta_z$ mode). The first transmission line 307 may also be installed to couple a magnetic field (or an electric field) of a second resonant mode (for example, the $TE_{01}\delta_z$ mode) where a dominant resonance is formed on the plane perpendicular to the x axis with a magnetic field (or an electric field) of a third resonant mode (for example, the $TE_{01}\delta_y$ mode) where a dominant resonance is formed on the plane perpendicular to the z axis.

The second transmission line 308 may be aligned along the direction of the second resonant mode (for example, the $TE_{01}\delta_x$ mode) where a dominant resonance is formed on the plane perpendicular to the x axis, thus being coupled with the second resonant mode (for example, the $TE_{01}\delta_x$ mode). The second transmission line 308 may also be installed to couple a magnetic field (or an electric field) of the third resonant mode (for example, the $TE_{01}\delta_y$ mode) where a dominant resonance is formed on the plane perpendicular to the y axis with a magnetic field (or an electric field) of the first resonant mode (for example, the $TE_{01}\delta_z$ mode) where a dominant resonance is formed on the plane perpendicular to the z axis.

The first end of the first transmission line 307 may be directly connected with the input connector 301 through an input probe (not shown), and contact between the first transmission line 307 and the second transmission line 308 may be directly connected with the output connector 303 through an output probe (not shown). The first end of the first transmission line 307 may be directly connected with the second transmission line 308 at a point on the y axis.

Accordingly, three orthogonal resonant modes may be coupled using the first transmission line 307 and the second transmission line 308. That is, a plurality of resonant modes formed by the DR element 211 may be coupled using the first transmission line 307 and the second transmission line 308 having simple structures while using the DR element 211 having a simple shape like a substantially spherical shape. In this example, the first transmission line 307 and the second transmission line 308 are directly connected to the input connector 301 and the output connector 303, thereby implementing a BRF. The multi-mode resonant filter 30 provides a plurality of resonant modes, for example, three substantially identical resonant modes, with a single DR element. For example, the resonant modes may be Transverse Electric (TE) modes or Transverse Magnetic (TM) modes.

The multi-mode resonant filter 30 according to the second example includes the cavity and the DR element 211 which are in a spherical or sphere-like shape, thereby providing three resonant modes, for example, three $TE_{01}\delta$ modes, which are orthogonal to each other in the directions of the x axis, the y axis, and the z axis. With the first transmission line 307 and the second transmission line 308 existing between the housing 200 and the DR element 211, three resonant modes may be efficiently used without degradation of the Q value.

Figure 9:
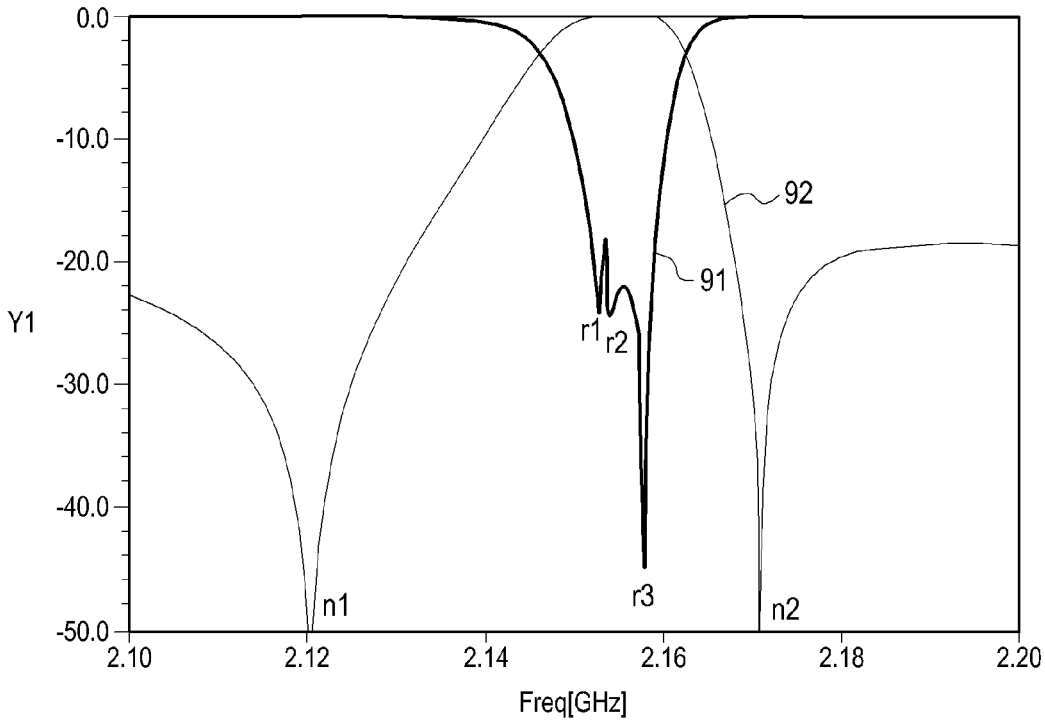
FIG. 9 is a graph illustrating an example of filtering performed by the multi-mode resonant filter shown in FIGS. 7 and 8.

FIG. 9 is a graph that illustrates an example of filtering performed by the multi-mode resonant filter shown in FIGS. 7 and 8. In FIG. 9, the horizontal axis indicates frequency [GHz] and the vertical axis Y1 indicates attenuation loss. In FIG. 9, reference numeral 91 indicates a band rejection characteristic of a BRF according to the second example and reference numeral 92 indicates a reflection characteristic.

As shown in FIG. 9, the BRF according to the second example has a filtering characteristic in which there exists a rejection band of about 2.14-2.16 GHz. In a band rejection characteristic curve 91 shown in FIG. 9, three peaks are formed, whereby three resonant modes are coupled.

Figure 10:
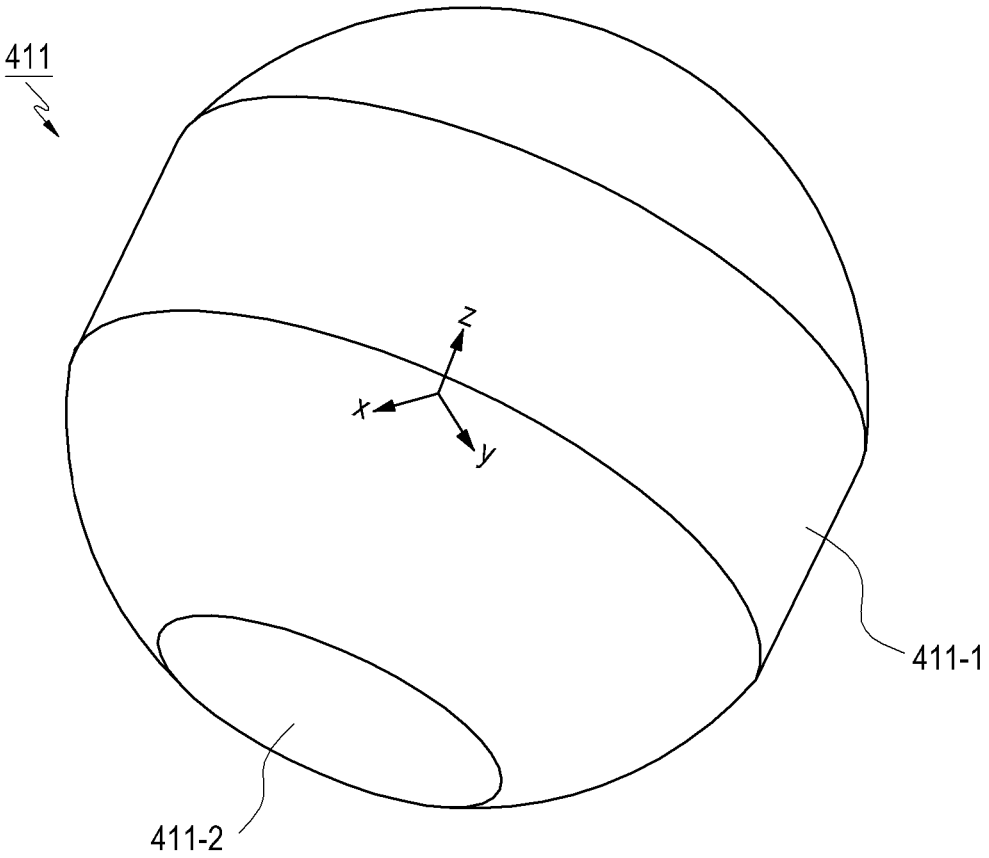
FIG. 10 is a diagram illustrating an example of a DR element applicable to a multi-mode resonant filter.

In implementation of a filter using TE-mode resonance, when the DR element in a spherical shape is fixed using the support member 313, two of three adjacent resonance frequencies move sharply upward. To cause the remaining one resonance frequency and the other two resonance frequencies to be adjacent to each other, as shown in FIG. 10, parts of the outer circumferential surface of the spherical DR element are removed for correction of the resonance frequencies. As shown in FIG. 10, the middle side part of a DR element 411 is removed along the outer circumferential surface thereof in the shape of a band, thus forming a side cut portion 411-1, and a part of the bottom part of the DR element 411 is removed in parallel with the side cut portion 411-1, thus forming a bottom cut portion 411-2. The bottom cut portion 411-2 may be connected with a top surface of the support member 213 or 313.

Figure 11:
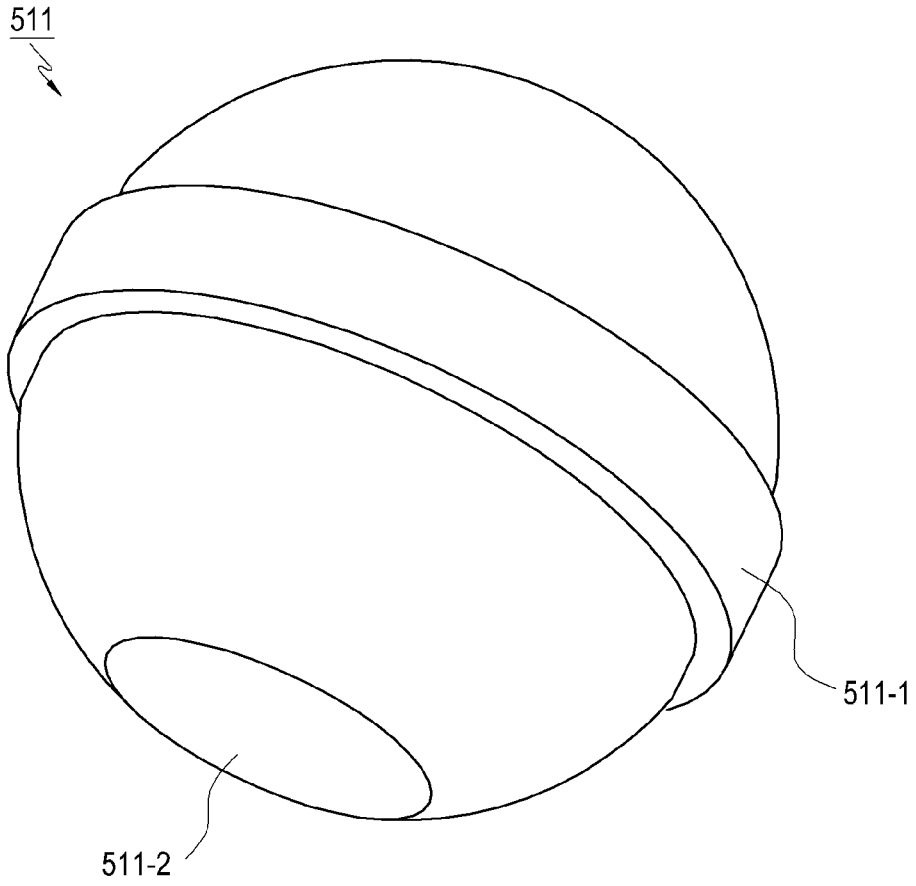
FIG. 11 is a diagram illustrating another example of a DR element applicable to a multi-mode resonant filter.

On the other hand, in implementation of a filter using TM-mode resonance, as shown in FIG. 11, a member may be added to a DR element 511 in the axial direction of the support member 213 or 313 to correct resonance frequencies. As shown in FIG. 11, a protrusion 511-1 in a band shape is formed along the outer circumferential surface of the middle side part of the DR element 511, and a bottom cut portion 511-2 is formed by removing a portion of the bottom part of the DR element 511 in parallel with the protrusion 511-1. The bottom cut portion 511-2 may be connected with a top surface of the support member 213 or 313.

Figure 12:
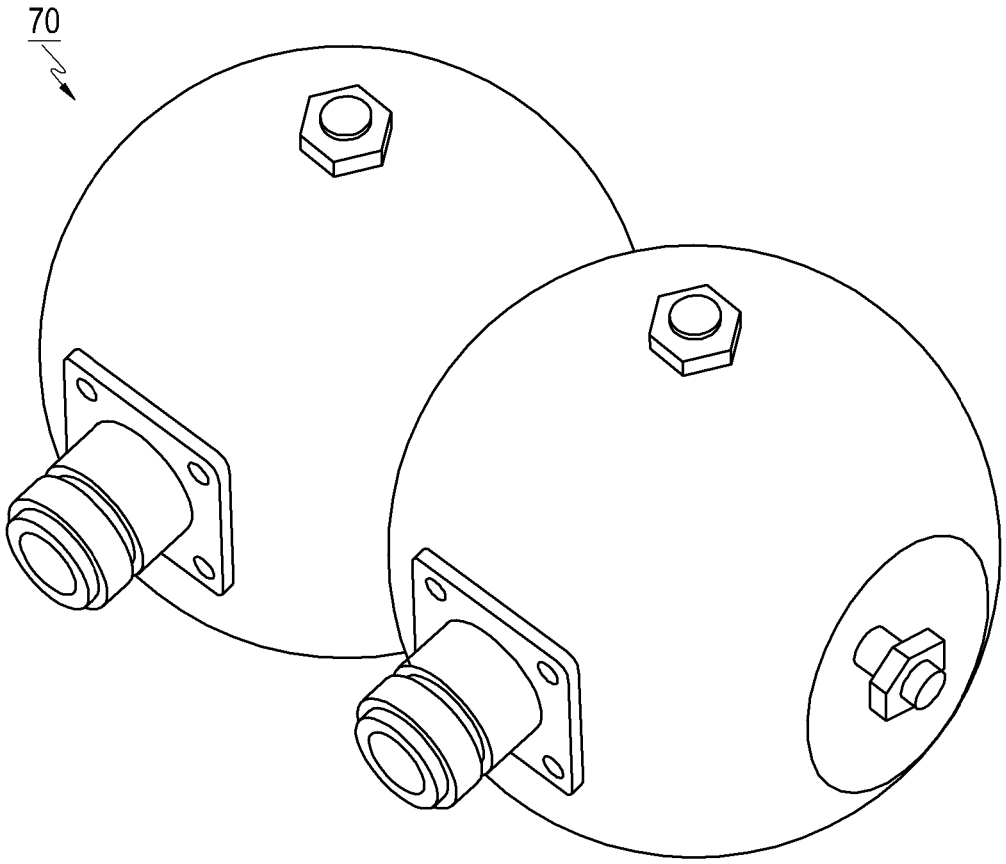
FIGS. 12 and 13 are diagrams illustrating a third example of a multi-mode resonant filter.
Figure 13:
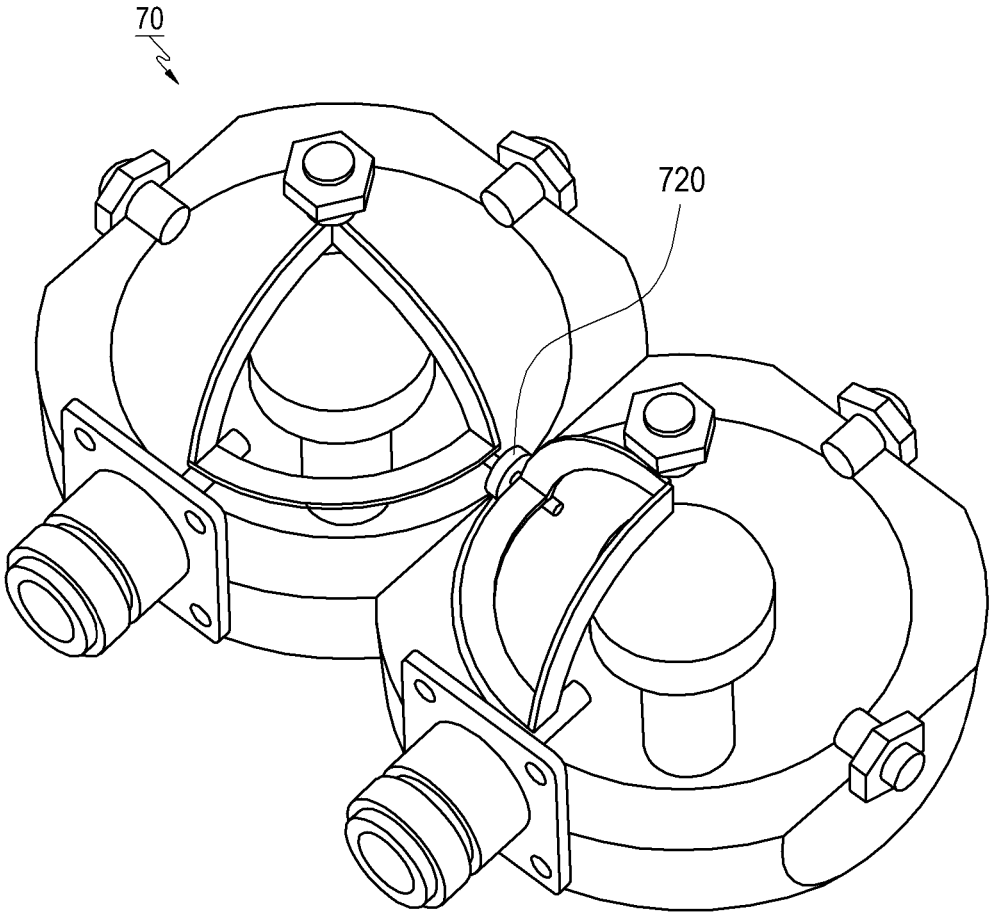

FIGS. 12 and 13 illustrate a third example of a multi-mode resonant filter, in which the multi-mode resonant filters 20 according to the first example shown in FIGS. 2 and 3 are connected in a 2-stage manner. In other words, multi-mode resonant filter 70 shown in FIGS. 12 and 13 includes two multi-mode resonant filters 20 according to the first embodiment shown in FIGS. 2 and 3, and an output of the multi-mode resonant filter 20 in the first stage is connected with an input of the multi-mode resonant filter 20 in the second stage through a connecting line unit 720. It should be appreciated that the multi-mode resonant filters 20 according to the first example shown in FIGS. 2 and 3 may be connected as multiple stages such as two stages or three stages or more, to achieve desired characteristics.

For example, as shown in FIGS. 12 and 13, the multiple multi-mode resonant filters may be connected on their sides. When transmission lines in the same shape are formed in each filter, the transmission lines in each filter may be aligned to mirror each other. In the two filters aligned in parallel with each other in FIGS. 12 and 13, transmission lines in each filter are aligned adjacent to each other. In this example, transmission lines in each filter are interconnected by the connecting line unit 720. The connecting line unit 720 goes through a housing of each filter and is connected with the transmission lines of each filter in each housing.

Figure 14:
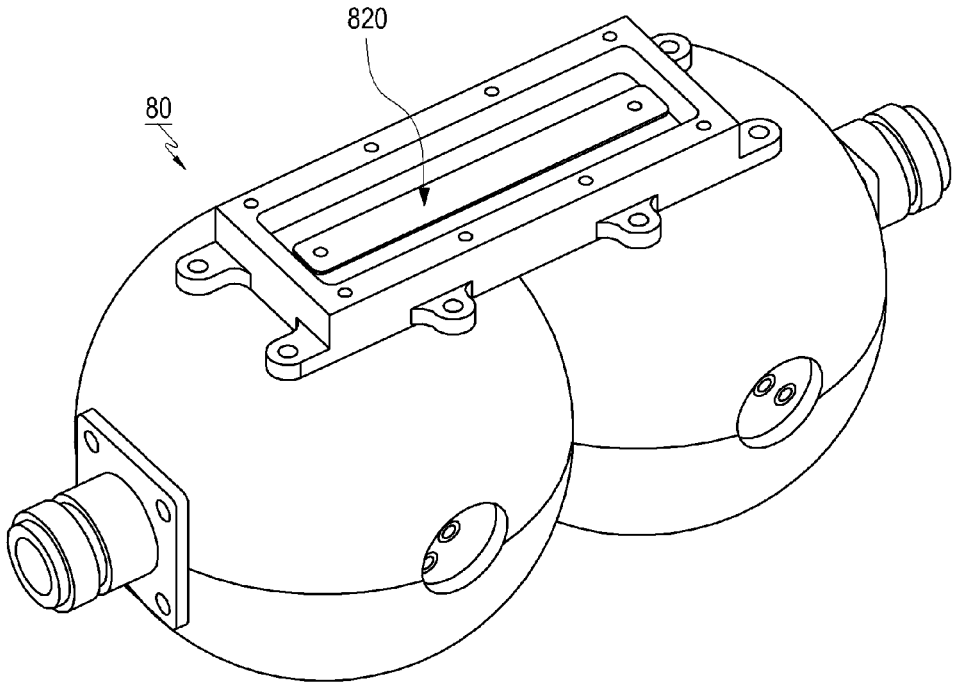
FIGS. 14 and 15 are diagrams illustrating a fourth example of a multi-mode resonant filter.
Figure 15:
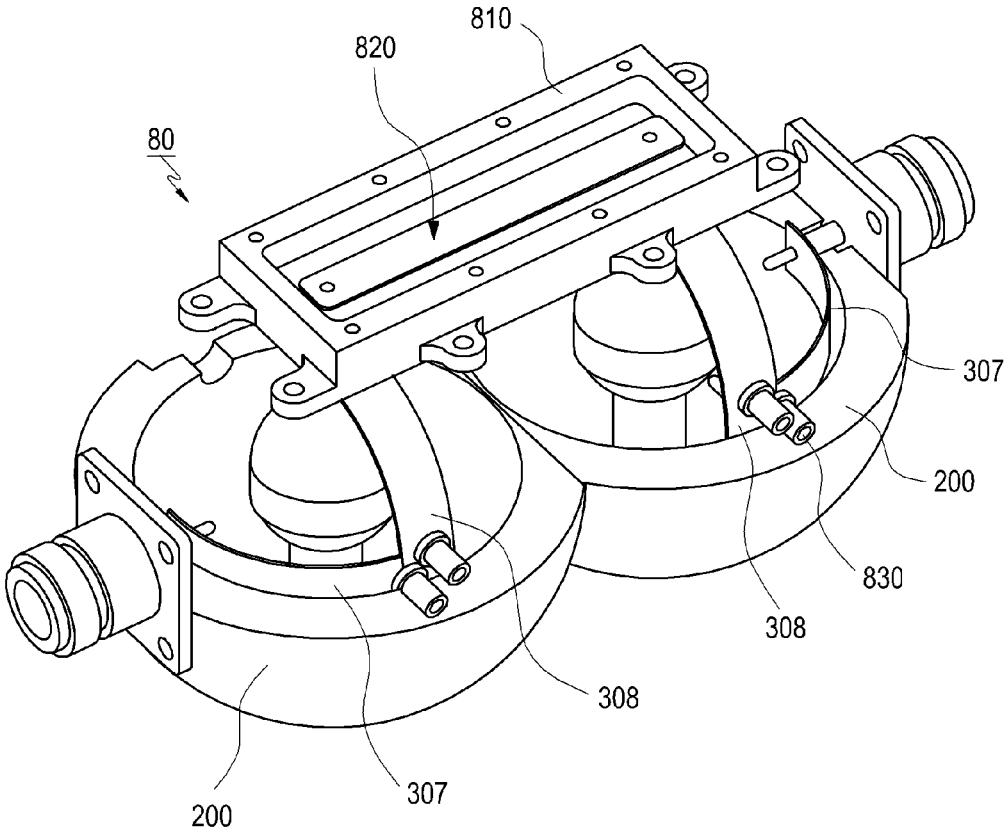

FIGS. 14 and 15 illustrate a fourth example of a multi-mode resonant filter, in which the multi-mode resonant filters 30 according to the second example shown in FIGS. 7 and 8 are connected in a 2-stage manner. For example, the multi-mode resonant filter 80 according to the fourth example shown in FIGS. 14 and 15 includes two multi-mode resonant filters 30 and an output of the multi-mode resonant filter 30 in the first stage that is connected with an input of the multi-mode resonant filter 30 in the second stage through a transmission line unit 820 of 50 Ω.

Referring to FIGS. 14 and 15, multiple multi-mode resonant filters are connected on their sides. When transmission lines in the same shape are formed in each of the multi-mode resonant filters, they may be aligned such that the filters mirror each other. In the two multi-mode resonant filters aligned in parallel with each other in FIGS. 14 and 15, transmission lines in each multi-mode resonant filter are positioned with their resonant elements therebetween and are spaced apart from each other. In this example, transmission lines in each multi-mode resonant filter are interconnected by the transmission line unit 820 formed on the two multi-mode resonant filters. The transmission line unit 820 is positioned in a connector 810 positioned over top portions of the two multi-mode resonant filters. The connector 810 is formed in a concave recess of the top surface and may receive the transmission line unit 820 therein. The transmission line unit 820 goes through the connector 810 and the housing 200 of each multi-mode resonant filter, thus being connected with the transmission lines 307 and 308 of each multi-mode resonant filter in each housing. In FIGS. 14 and 15, a support member 830 for fixing the transmission lines 307 and 308 to the inner wall of the housing 200 is shown. The support member 830 may be made of a dielectric such as Teflon.

Figure 16:
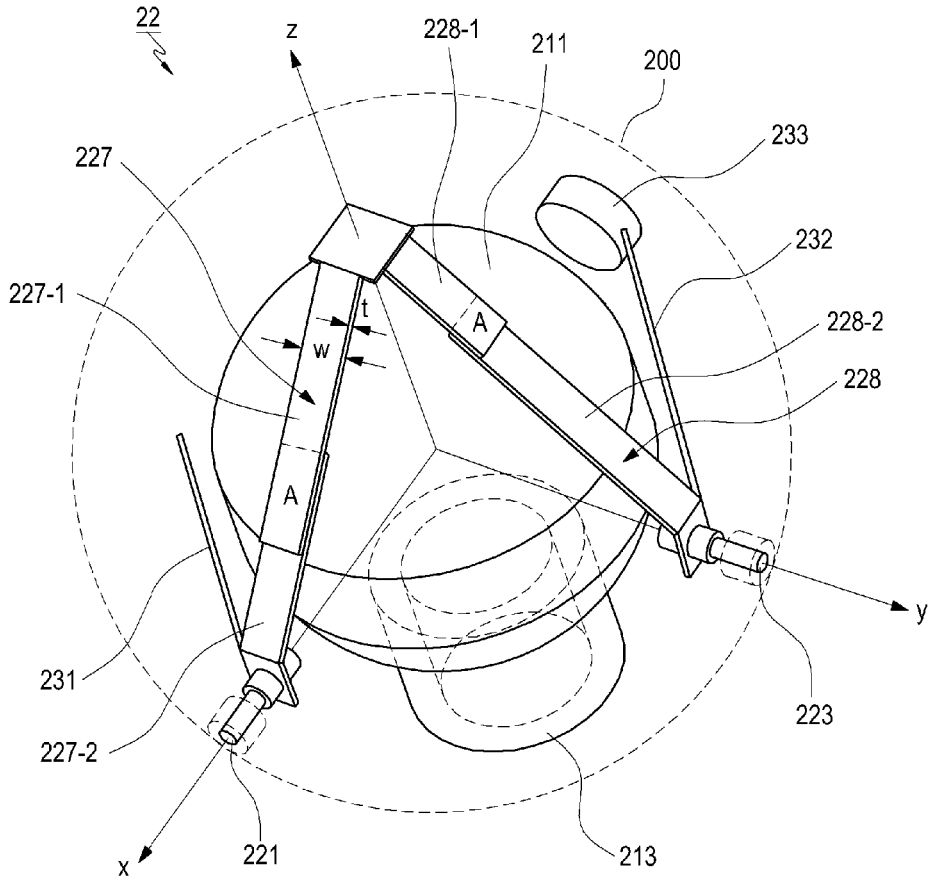
FIGS. 16 and 17 are diagrams illustrating a fifth example of a multi-mode resonant filter.
Figure 17:
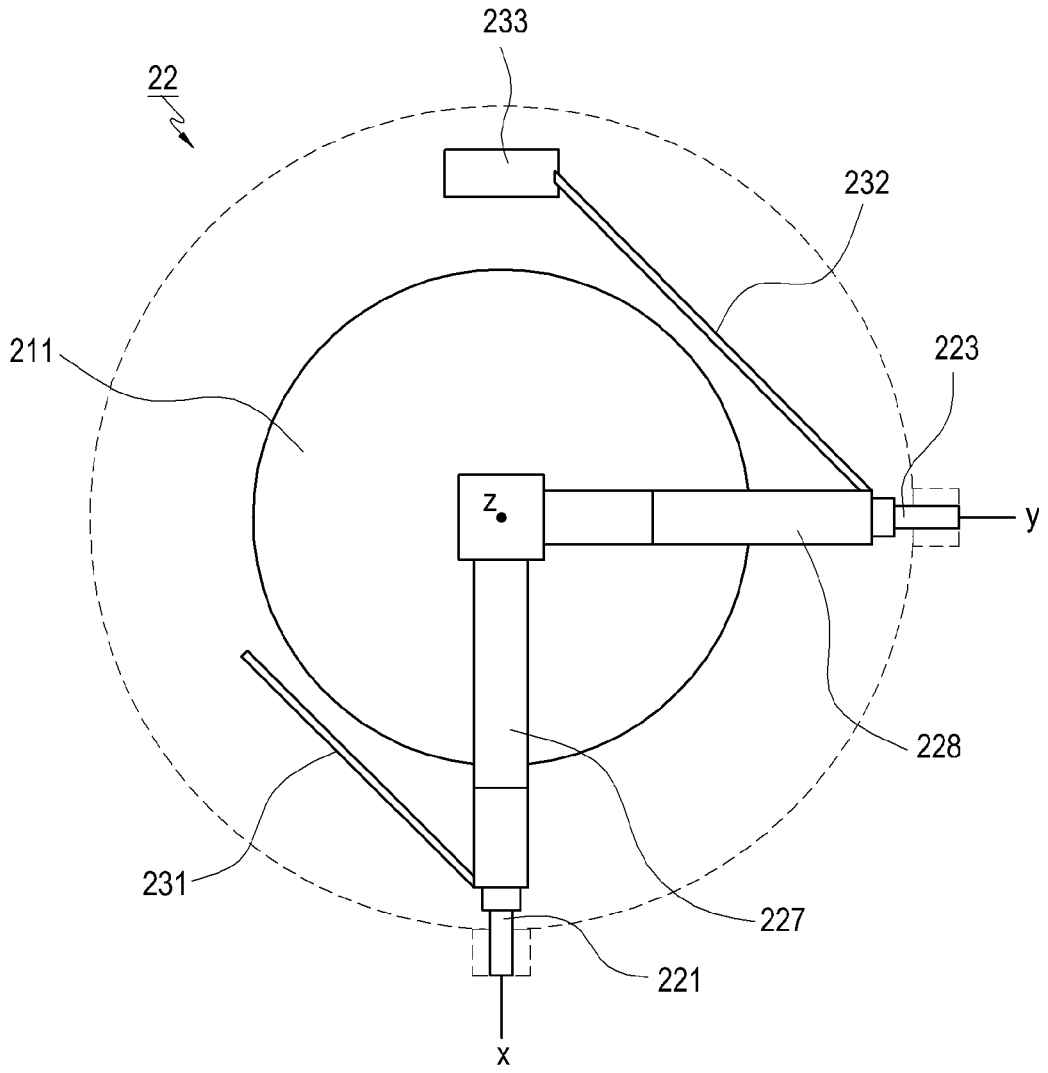

FIGS. 16 and 17 illustrate a fifth example of a multi-mode resonant filter. For convenience of illustration, the housing, the input and output connectors, and the tuning probes formed outside the housing are not shown. In this example, the support member 213 for supporting the DR element 211 is formed in a cylindrical shape, and a cavity is formed in a cylindrical shape in the support member 213 as shown in FIG. 16. That is, by forming the support member 213 to have a larger top portion, the support member 213 may stably support the DR element 211. In addition, the weight of the support member 213 may be reduced by forming the cavity therein, so that the total weight of the filter may also be reduced as well. Because the material Q (quality factor) of the support member 213 may be less than that of the DR element 211, by forming the cavity in the support member 213, it is possible to decrease the influence of material Q of the support member 213, thus preventing degradation of a quality factor Q of the filter 22.

Referring to FIGS. 16 and 17, a multi-mode resonant filter 22, like the multi-mode resonant filter 20 shown in FIGS. 2 and 3, has a cavity in a spherical or sphere-like shape where an air layer is formed inside the housing 200 in a spherical or sphere-like shape. The multi-mode resonant filter 22 also includes the DR element 211 in a spherical or sphere-like shape in the cavity, an input probe 221 for connection with an input connector formed on a pole of the x axis, and an output probe 223 for connection with an output connector formed on a pole of the y axis.

The multi-mode resonant filter 22 also includes a first transmission line 227 for connecting a point on the x axis with a point on the z axis and a second transmission line 228 for connecting a point on the y axis with a point on the z axis. An end of the first transmission line 227 along the x axis is connected with the input probe 221, and an end of the second transmission line 228 along the y axis is connected with the output probe 223. For example, the end of the first transmission line 227 along the x axis may be directly connected with the input probe 221 or may be aligned adjacent to the input probe 221 although not directly connected with the input probe 221, to achieve electromagnetic field coupling. An end of the second transmission line 228 along the y axis may be directly connected with the output probe 223 or may be aligned adjacent to the output probe 223 although not directly connected with the output probe 223, to achieve electromagnetic field coupling.

The first transmission line 227 and the second transmission line 228 may be of a substantially linear shape, and as indicated by A, the first transmission line 227 and the second transmission line 228 may include two sub transmission lines 227-1 and 227-2 and two sub transmission lines 228-1 and 228-2, respectively, which may be used for electromagnetic coupling therebetween. For example, each of the first transmission line 227 and the second transmission line 228 may be a transmission line formed as a single body or may be formed with two or more sub transmission lines 227-1 and 227-2 or 228-1 and 228-2, including portions that overlap as indicated by A. For example, the first transmission line 227 may include the first sub transmission line 227-1 and the second sub transmission line 227-2 which are aligned such that a portion A of the first sub transmission line 227-1 and a portion A of the second sub transmission line 227-2 overlap. The second transmission line 228 may include the third sub transmission line 228-1 and the fourth sub transmission line 228-2 which are aligned such that a portion A of the third sub transmission line 228-1 and a portion A of the fourth sub transmission line 228-2 overlap.

The portions A may be directly connected with each other, or may be aligned adjacent to each other although not directly connected with each other, to achieve electromagnetic coupling.

In FIGS. 16 and 17, a first end of the first transmission line 227 is connected with the input probe 221 at a point on a +x axis and a second end thereof is positioned at a point on a +z axis. A first end of the second transmission line 228 may be directly connected with the second end of the first transmission line 227 on the +z axis and a second end thereof may be connected with the output probe 223 on a +y axis. To adjust a notch characteristic or a coupling characteristic, auxiliary transmission lines 231 and 232 which connect a point on the x axis with a point on the y axis may be provided.

For example, the first auxiliary transmission line 231 may be connected at an end thereof to a contact point between the first transmission line 227 and the input probe 221, and extend towards a [+] pole of the x axis and a [−] pole of the y axis. The second auxiliary transmission line 232 may be connected at an end thereof to a contact point to between the second transmission line 228 and the output probe 223, and may extend towards a [+] pole of the y axis and a [−] pole of the x axis. At a second end of the second auxiliary transmission line 232 there may be installed an open structure 233 for forming an open circuit. The open structure 233 may be formed of a metallic material in a disc or coin shape that has a width larger than the width of the second auxiliary transmission line 232.

Figure 18:
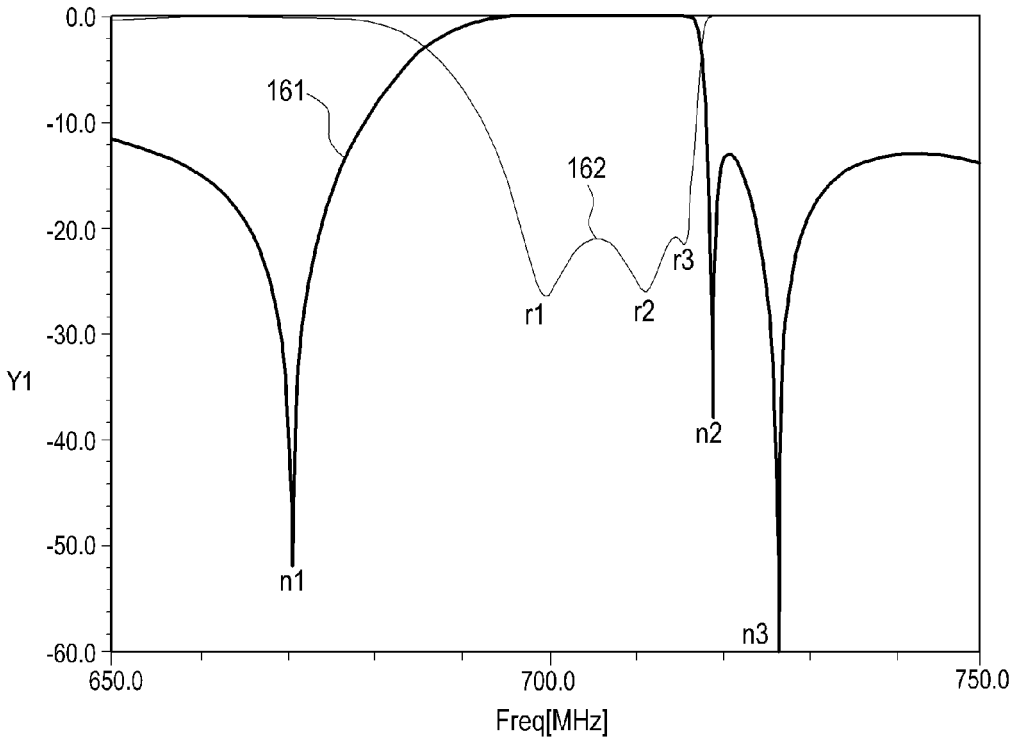
FIG. 18 is a graph illustrating an example of filtering in FIGS. 16 and 17.

As described above, the BPF according to the fifth example may, as shown in FIG. 18, causes additional notches to occur in a frequency band higher than a pass band. In FIG. 18, the horizontal axis indicates frequency [GHz] and the vertical axis Y1 indicates attenuation loss. In FIG. 18, reference numeral 161 indicates a band-pass characteristic of a BPF according to the fifth example, and reference numeral 162 indicates a reflection characteristic. As shown in FIG. 18, the BPF has a pass band of about 695-716 MHz, with a notch n1 formed at frequency lower than the pass band and with notches n2 and n3 formed at frequencies higher than the pass band. Also, the reflection characteristic curve 162 having three peaks r1, r2, and r3 illustrates that three resonant modes are coupled.

Figure 19:
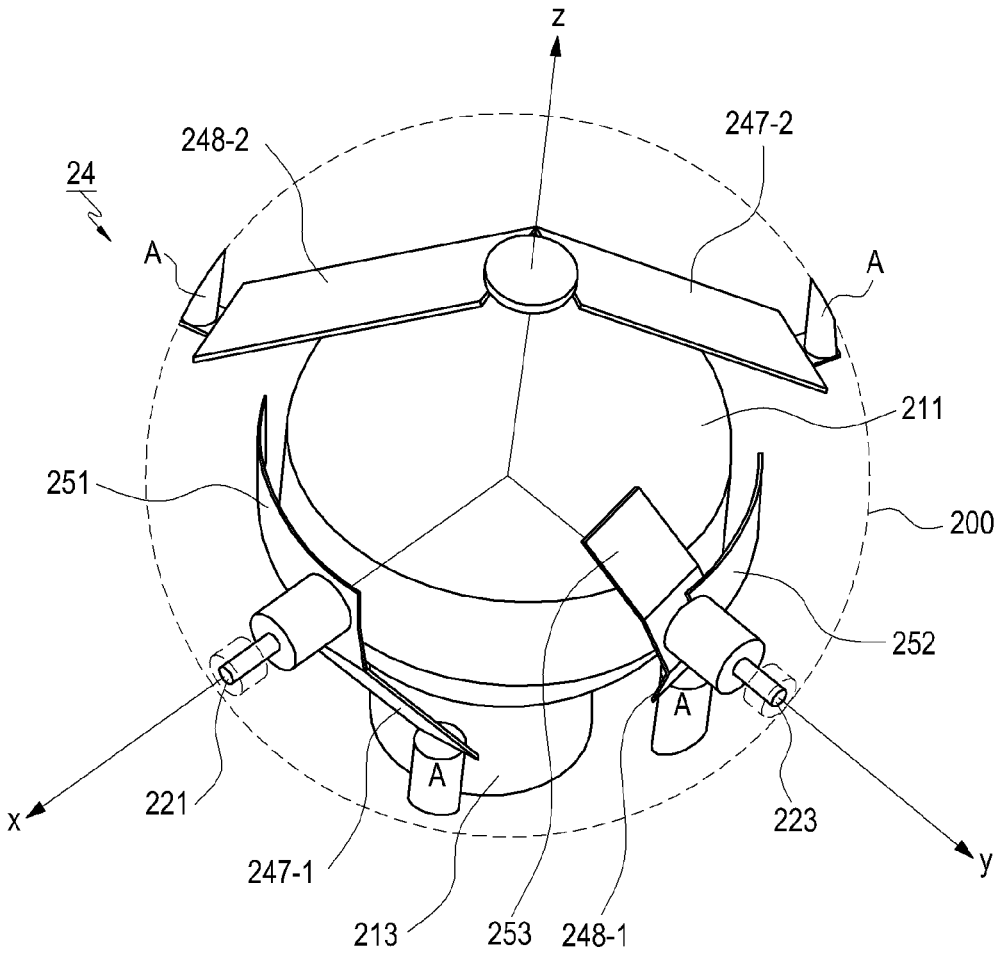
FIGS. 19 and 20 are diagrams illustrating a sixth example of a multi-mode resonant filter.
Figure 20:
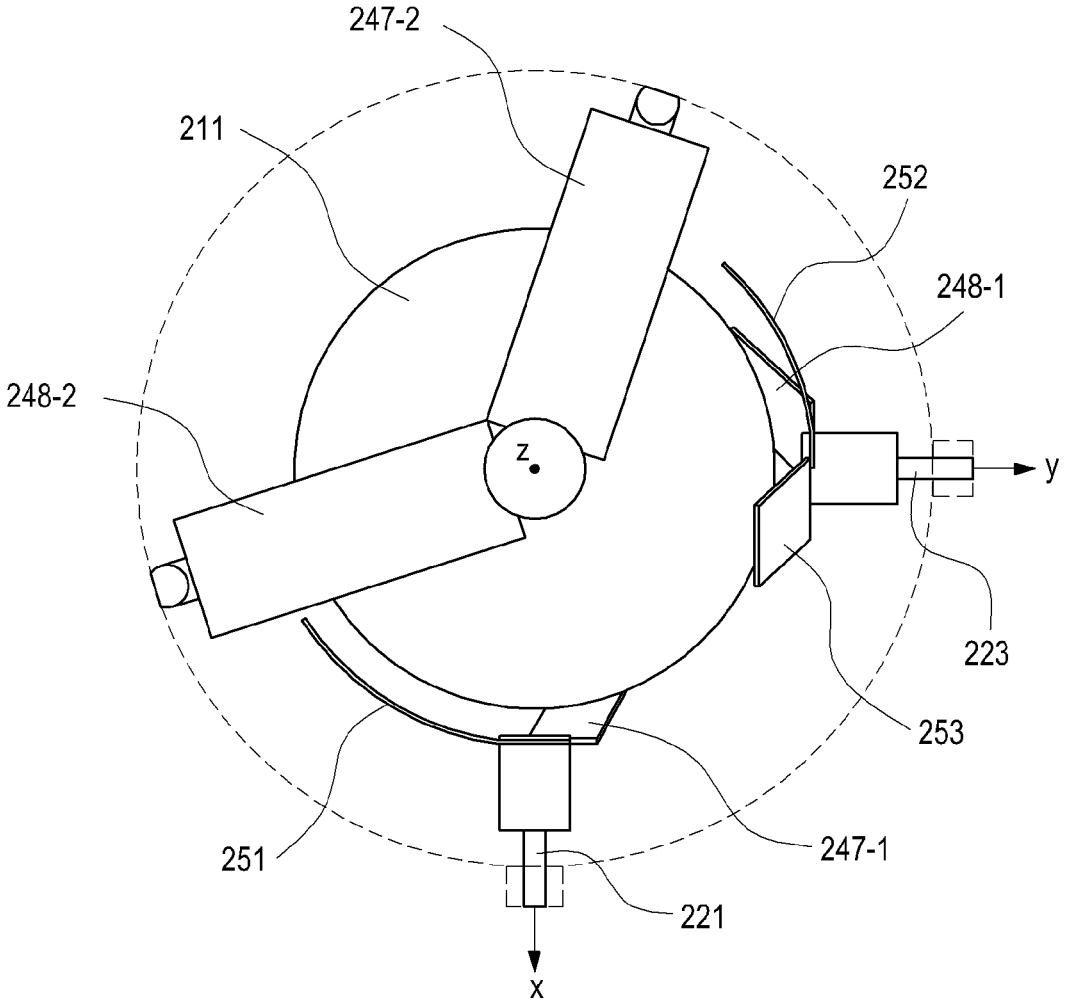

FIGS. 19 and 20 illustrate a sixth example of a multi-mode resonant filter. For convenience of illustration, the housing, the input and output connectors, and the tuning probes formed outside the housing are not shown.

Referring to FIGS. 19 and 20, multi-mode resonant filter 24 according to the sixth example, like the multi-mode resonant filter 22 according to the fifth example shown in FIGS. 16 and 17, has a cavity in a spherical or sphere-like shape where an air layer is formed in the housing 200 in a spherical or sphere-like shape. The multi-mode resonant filter 24 also includes the DR element 211 in a spherical or sphere-like shape in the cavity, the input probe 221 for connection with an input connector formed on a pole of the x axis, and the output probe 223 for connection with an output connector formed on a pole of the y axis.

In this example, a first transmission line for connecting a point on the x axis with a point on the y axis includes a transmission line #1-1 247-1 and a first-second transmission line #1-2 247-2. An end of the transmission line #1-1 247-1 along the x axis is connected with the input probe 221 positioned at a point on the +x axis. An end of the transmission line #1-1 247-1 along the z axis is oriented toward the [−] pole of the z axis and is grounded in contact with the inner bottom surface of the housing (not shown) by means of a grounding structure A. Grounding structure A may be made of a metallic material. The end of the transmission line #1-1 247-1 along the z axis is twisted by a predetermined interval (for example, an angle of less than 45°) from the −z axis in the direction of the +y axis. The reason why the end is twisted by a predetermined interval from the particular axis (+y axis) along the aligning direction of the transmission line #1-1 247-1, is as follows: the direction of a particular mode (for example, the $TE_{01}\delta_y$ mode) may not be orthogonal to the y axis and may be twisted slightly depending on the strength of an electric field or a magnetic field formed in the housing 200, and therefore, the aligning direction of the transmission line #1-1 247-1 may be adjusted according to the twisted direction of the particular mode (for example, the $TE_{01}\delta_y$ mode). In the examples where the transmission lines are not orthogonal to a particular axis and are twisted therefrom by a predetermined interval, the aligning direction of the transmission lines may be adjusted according to the twisted direction of a particular mode if the direction of the particular mode is twisted according to the strength of an electric field or a magnetic field.

An end of the transmission line #1-2 247-2 along the z axis is connected with a point on the [+] pole. An end of the transmission line #1-2 247-2 along the x axis is oriented toward the [−] pole of the x axis and is grounded in contact with the inner top surface of the housing 200 by means of the grounding structure A. Grounding structure A may be made of a metallic material. The end of the transmission line #1-2 247-2 along the x axis may be twisted by a predetermined interval (for example, an angle of less than 45°) from the −x axis in the direction of the +y axis.

It should be noted that while the transmission line #1-1 247-1 and the transmission line #1-2 247-2 are physically separated from each other, they are regarded as being connected with each other in terms of a circuit by coupling with a magnetic field (or an electric field) of a single mode (for example, the $TE_{01}\delta_x$ mode). Accordingly, even if the transmission line #1-1 247-1 and the transmission line #1-2 247-2 are spaced apart from each other, both of them may be coupled with the same single mode (for example, $TM_{01}\delta_x$ mode). In this example, the transmission line #1-1 247-1 and the transmission line #1-2 247-2 may be installed such that they are twisted by a predetermined interval from the x axis, instead of accurately matching the x axis. This is because a maximum resonant mode of each axis may be offset by the plurality of transmission lines and several elements installed in the cavity. Thus, the transmission line #1-1 247-1 and the transmission line #1-2 247-2 may be installed in positions or in directions corresponding to the directions of the offset maximum resonant mode.

Likewise, a second transmission line for connecting a point on the z axis with a point on the y axis includes a transmission line #2-1 248-1 and a transmission line #2-2 248-2. An end of the transmission line #2-1 248-1 along the y axis is connected with the output probe 223 positioned at a point on the +y axis. An end of the transmission line #2-1 248-1 along the z axis is oriented toward the [−] pole of the z axis and is grounded with the bottom inner surface of the housing (not shown) by means of the grounding structure A. Grounding structure A may be made of a metallic material. The end of the transmission line #2-1 248-1 along the z axis may be twisted by a predetermined interval (for example, an angle of less than 45°) from the −z axis in the direction of the −x axis.

An end of the transmission line #2-2 248-2 along the z axis is connected with the transmission line #1-2 247-2 at a point on the [+] pole of the z axis An end of the transmission line #2-2 248-2 along the y axis is oriented toward the [−] pole of the y axis and is grounded with the inner top surface of the housing (not shown) by means of the grounding structure A. Grounding structure A may be made of a metallic material. The transmission line #2-1 248-1 and the transmission line #2-2 248-2 are also installed such that they are twisted by a predetermined interval (for example, an angle of less than 45°) from the −y axis in the direction of the +x axis, instead of matching the −y axis.

In addition to the foregoing structure, to adjust notch characteristics or coupling characteristics, auxiliary transmission lines 251, 252, and 253 for connecting a point on the x axis with a point on the y axis may be provided. In this example, the first auxiliary transmission line 251 is connected at an end thereof to the transmission line #1-1 247-1 on the +x axis, and extends towards the [+] pole of the x axis and the [−] pole of the y axis. The second auxiliary transmission line 252 is connected at an end thereof to the transmission line #2-1 248-1 on the +y axis, and extends towards the [+] pole of the y axis and the [−] pole of the x axis. The third auxiliary transmission line 253 is connected at an end thereof to the transmission line #2-1 248-1 on the +y axis, and is twisted by a predetermined interval (for example, an angle of less than 45°) from the +z axis in the direction of the +x axis, while extending towards the +z axis.

Figure 21:
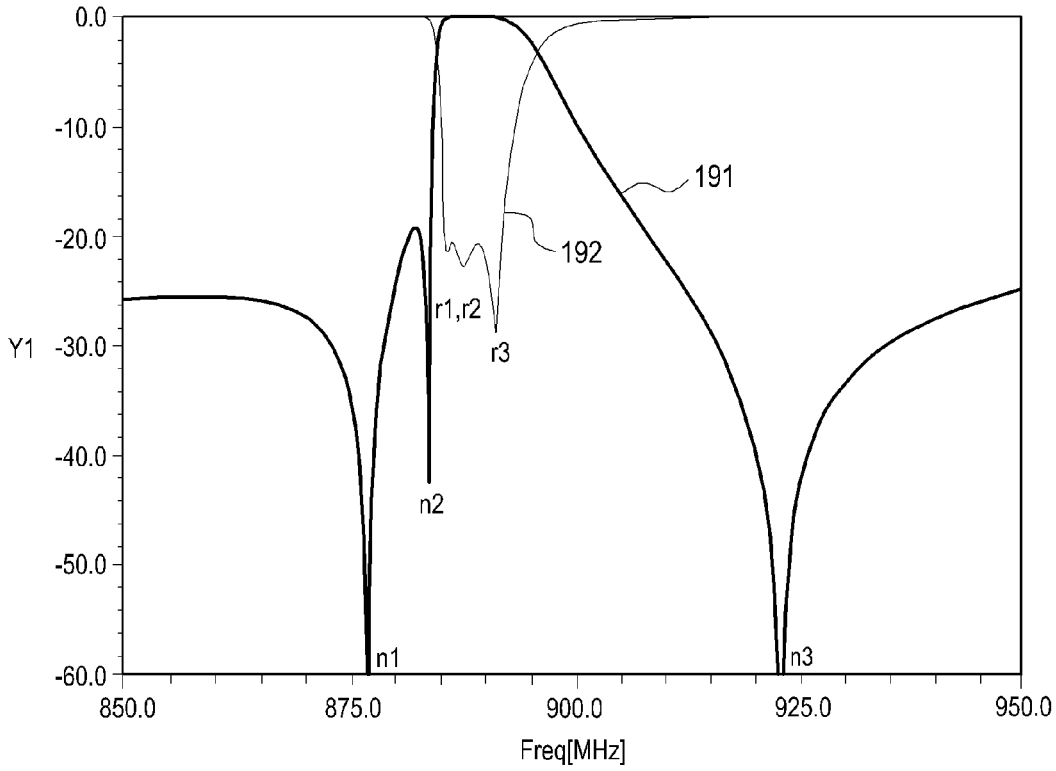
FIG. 21 is a graph illustrating an example of filtering in FIGS. 19 and 20.

With the above-described structure, as shown in FIG. 21, the BPF according to the sixth example may cause additional notches to occur in a frequency band lower than a pass band. In FIG. 21, the horizontal axis indicates frequency [GHz] and the vertical axis Y1 indicates attenuation loss. In FIG. 21, reference numeral 191 indicates a band-pass characteristic of the BPF and reference numeral 192 indicates a reflection characteristic. As shown in FIG. 21, the BPF has a band pass characteristic such that there exists a pass band of about 885-893 MHz, with notches n1 and n2 formed at frequencies lower than the pass band and a notch n3 formed at frequency higher than the pass band. Also, the reflection characteristic having three peaks r1, r2, and r3 illustrates that three resonant modes are coupled.

Figure 22:
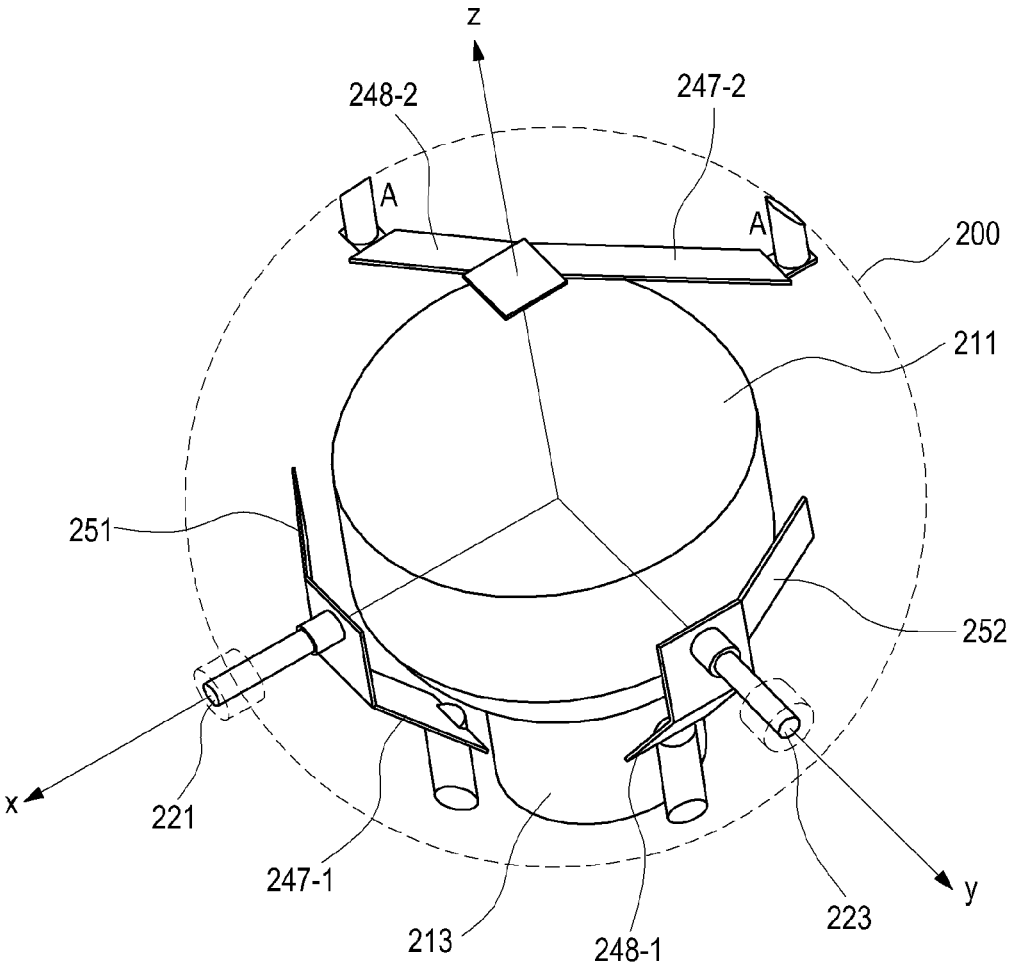
FIG. 22 is a diagram illustrating a seventh example of a multi-mode resonant filter.

FIG. 22 illustrates a seventh example of a multi-mode resonant filter. The multi-mode resonant filter according to the seventh example has the same structure as the multi-mode resonant filter 24 according to the sixth example shown in FIGS. 19 and 20, except that the third auxiliary transmission line 253 is removed.

Figure 23:
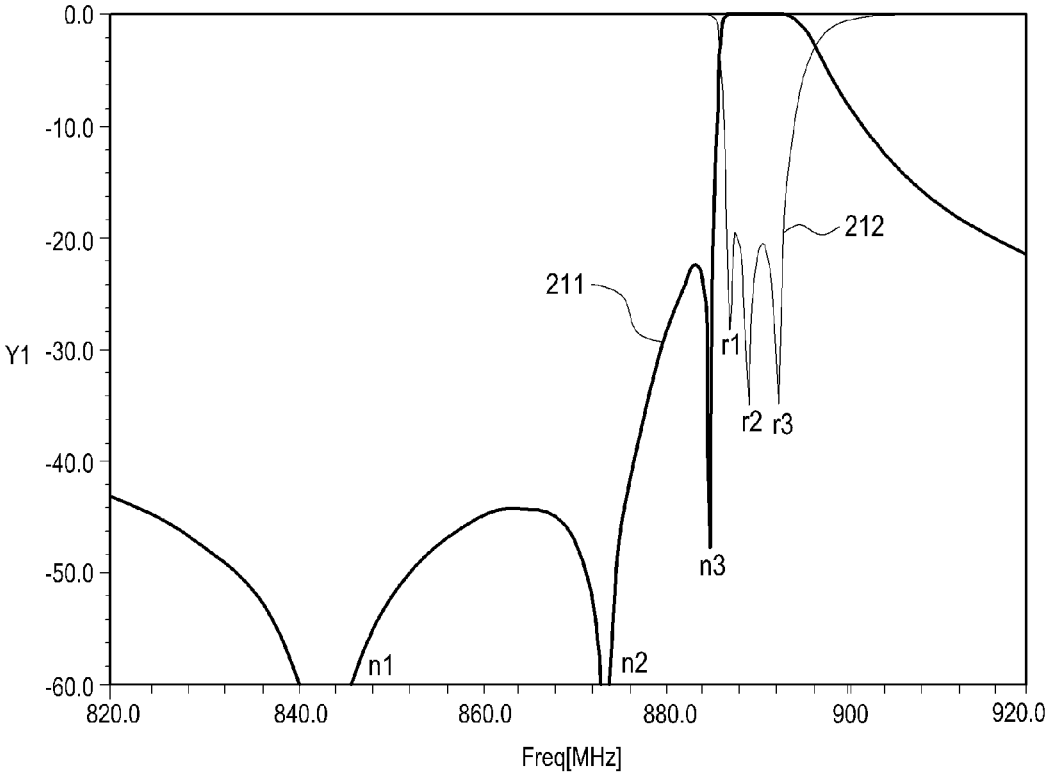
FIG. 23 is a graph illustrating an example of filtering performed by the multi-mode resonant filter shown in FIG. 22.

FIG. 23 is a graph that illustrates an example of filtering performed by the multi-mode resonant filter shown in FIG. 22. As shown in FIG. 22, the BPF according to the seventh example may cause additional notches to occur in a frequency band lower than a pass band. In FIG. 23, the horizontal axis indicates frequency [GHz] and the vertical axis Y1 indicates attenuation loss. In FIG. 23, reference numeral 211 indicates a band-pass characteristic of the BPF and reference numeral 212 indicates a reflection characteristic. As shown in FIG. 23, the BPF according to the seventh example has a band pass characteristic such that there exists a pass band of about 883-887 MHz, with notches n1, n2, and n3 formed at frequencies lower than the pass band. Also, the reflection characteristic curve 212 having three peaks r1, r2, and r3 illustrates that three resonant modes are coupled.

Figure 24:
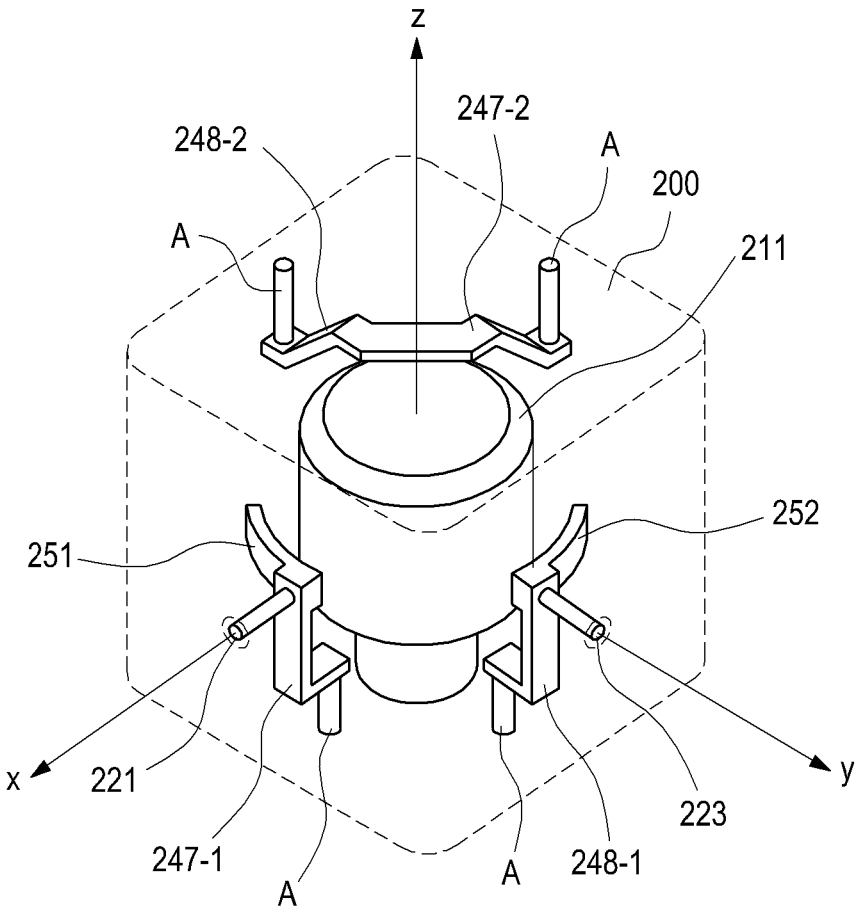
FIG. 24 is a diagram illustrating an eighth example of a multi-mode resonant filter.

FIG. 24 illustrates an eighth example of a multi-mode resonant filter. The multi-mode resonant filter according to the eighth example has the same structure as the multi-mode resonant filter 24 according to the sixth example shown in FIGS. 19 and 20 except that the third auxiliary transmission line 253 is removed from the multi-mode resonant filter, the DR element 211 is in a cylindrical shape, and the housing 200 is in a rectangular hexahedral shape.

Referring to FIG. 24, the multi-mode resonant filter according to the eighth example includes a cavity in a substantially rectangular hexahedral shape, the DR element 211 in a substantially cylindrical shape in the cavity, the input probe 221 for connection with an input connector formed on a pole of the x axis, and the output probe 223 for connection with an output connector formed on a pole of the y axis.

In this example, a first transmission line for connecting a point on the x axis with a point on the z axis includes the transmission line #1-1 247-1 and the transmission line #1-2 247-2. An end of the transmission line #1-1 247-1 along the x axis is connected with the input probe 221 positioned at a point on the +x axis. An end of the transmission line #1-1 247-1 along the z axis is oriented toward the [−] pole of the z axis and is grounded with the inner bottom surface of the housing 200 by means of a grounding structure A. Grounding structure A may be made of a metallic material.

An end of the transmission line #1-2 247-2 along the z axis is connected with a point on the [+] pole. An end of the transmission line #1-2 247-2 along the x axis is oriented toward the [−] pole of the x axis and is grounded with the inner top surface of the housing 200 by means of the grounding structure A. Grounding structure A may be made of a metallic material.

It should be noted that while the transmission line #1-1 247-1 and the transmission line #1-2 247-2 are physically separated from each other, they are regarded as being connected with each other in terms of a circuit for coupling with a magnetic field (or an electric field) of a single mode (for example, the $TE_{01}\delta$ mode). Accordingly, even if the transmission line #1-1 247-1 and the transmission line #1-2 247-2 are spaced apart from each other, both of them are coupled with the same single mode (for example, $TE_{01}\delta$ mode).

Likewise, a second transmission line for connecting a point on the z axis with a point on the y axis includes the transmission line #2-1 248-1 and the transmission line #2-2 248-2. An end of the transmission line #2-1 248-1 along the y axis is connected with the output probe 223 positioned at a point on the +y axis. An end of the transmission line #2-1 248-1 along the z axis is oriented toward the [−] pole of the z axis and is grounded in contact with the bottom inner surface of the housing 200 by means of the grounding structure A. Grounding structure A may be made of a metallic material.

An end of the transmission line #2-2 248-2 along the z axis is connected with the transmission line #1-2 247-2 at a point on the [+] pole of the z axis. An end of the transmission line #2-2 248-2 along the y axis is oriented toward the [−] pole of the y axis and is grounded with the inner top surface of the housing 200 by means of the grounding structure A. Grounding structure A may be made of a metallic material.

In addition to the foregoing structure, to adjust a notch feature or a coupling feature, the auxiliary transmission lines 251 and 252 for connecting a point on the x axis with a point on the y axis may be provided. In this example, the first auxiliary transmission line 251 is connected at an end thereof to the transmission line #1-1 247-1 on the +x axis, and extends towards the [+] pole of the x axis and the [−] pole of the y axis. The second auxiliary transmission line 252 is connected at an end thereof to the transmission line #2-1 248-1 on the +y axis, and extends towards the [+] pole of the y axis and the [−] pole of the x axis.

Figure 25:
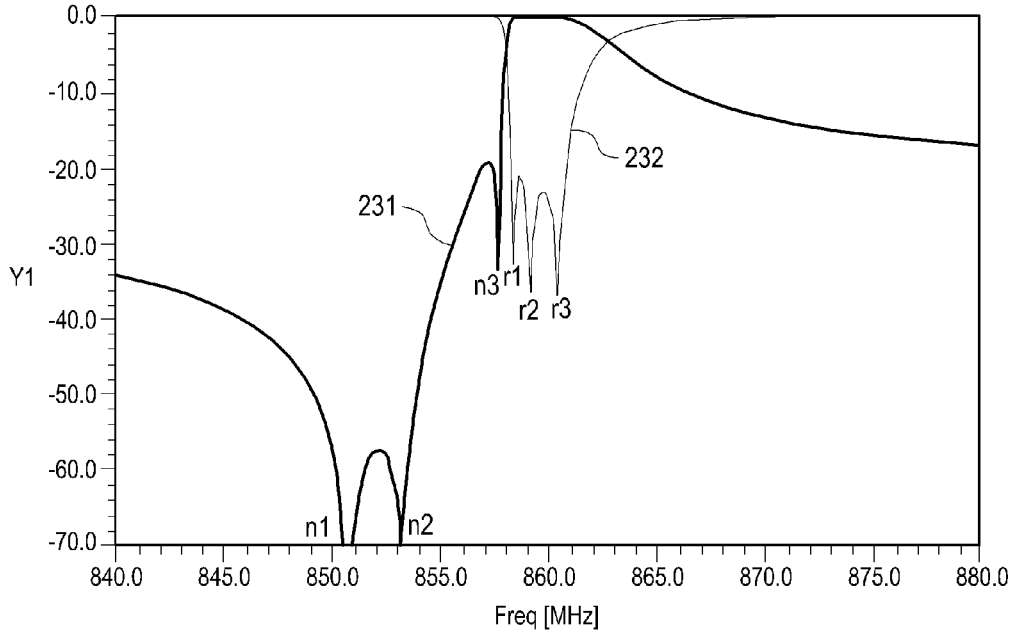
FIG. 25 is a graph illustrating an example of filtering performed by the multi-mode resonant filter shown in FIG. 24.

FIG. 25 is a graph that illustrates an example of filtering performed by the multi-mode resonant filter shown in FIG. 24. As shown in FIG. 25, the BPF according to the eighth example may cause additional notches to occur in a frequency band lower than a pass band. In FIG. 25, the horizontal axis indicates frequency [GHz] and the vertical axis Y1 indicates attenuation loss. In FIG. 25, reference numeral 231 indicates a band-pass characteristic of the BPF according to the eighth example and reference numeral 232 indicates a reflection characteristic. As shown in FIG. 25, the BPF has a band pass characteristic such that there exists a pass band of about 883-887 MHz, with notches n1, n2, and n3 formed at frequencies lower than the pass band. Also, the reflection characteristic curve 232 having three peaks r1, r2, and r3 illustrates that three resonant modes are coupled.

Figure 26:
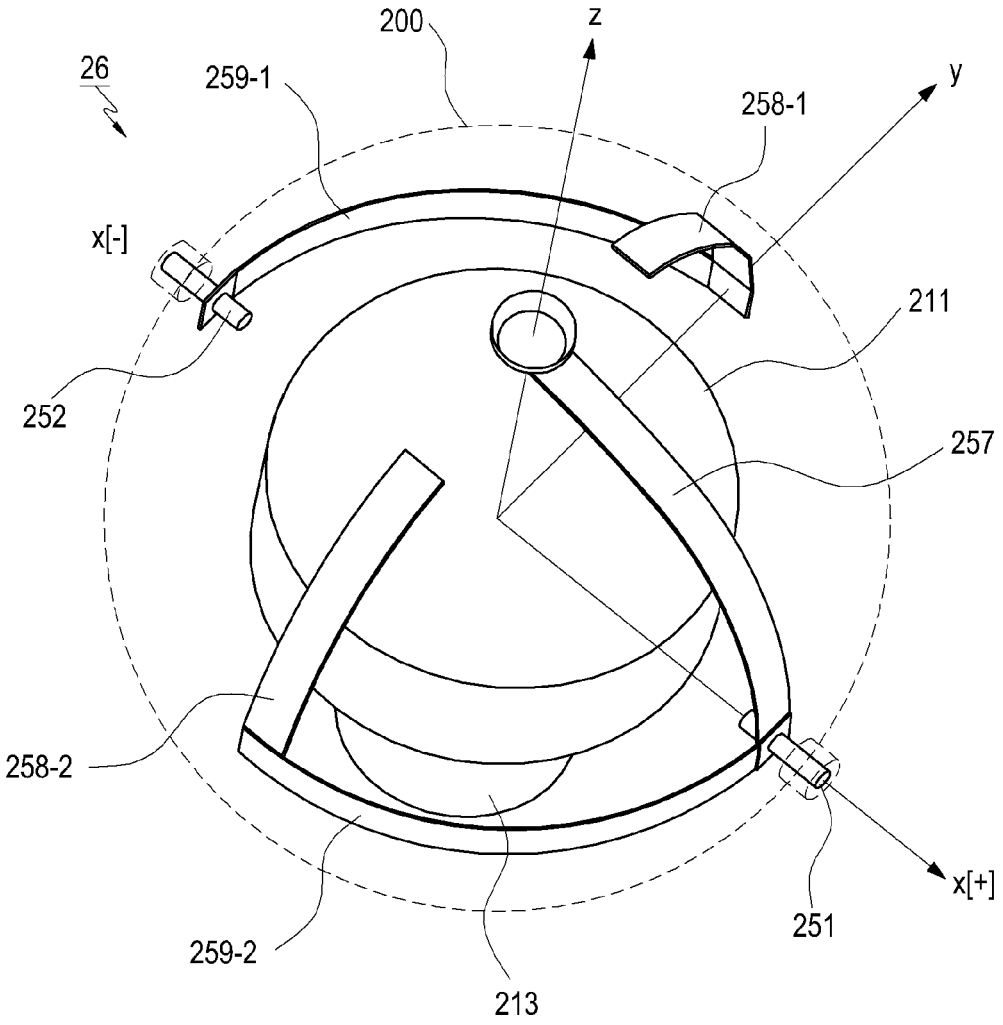
FIGS. 26 and 27 are diagrams illustrating a ninth example of a multi-mode resonant filter.
Figure 27:
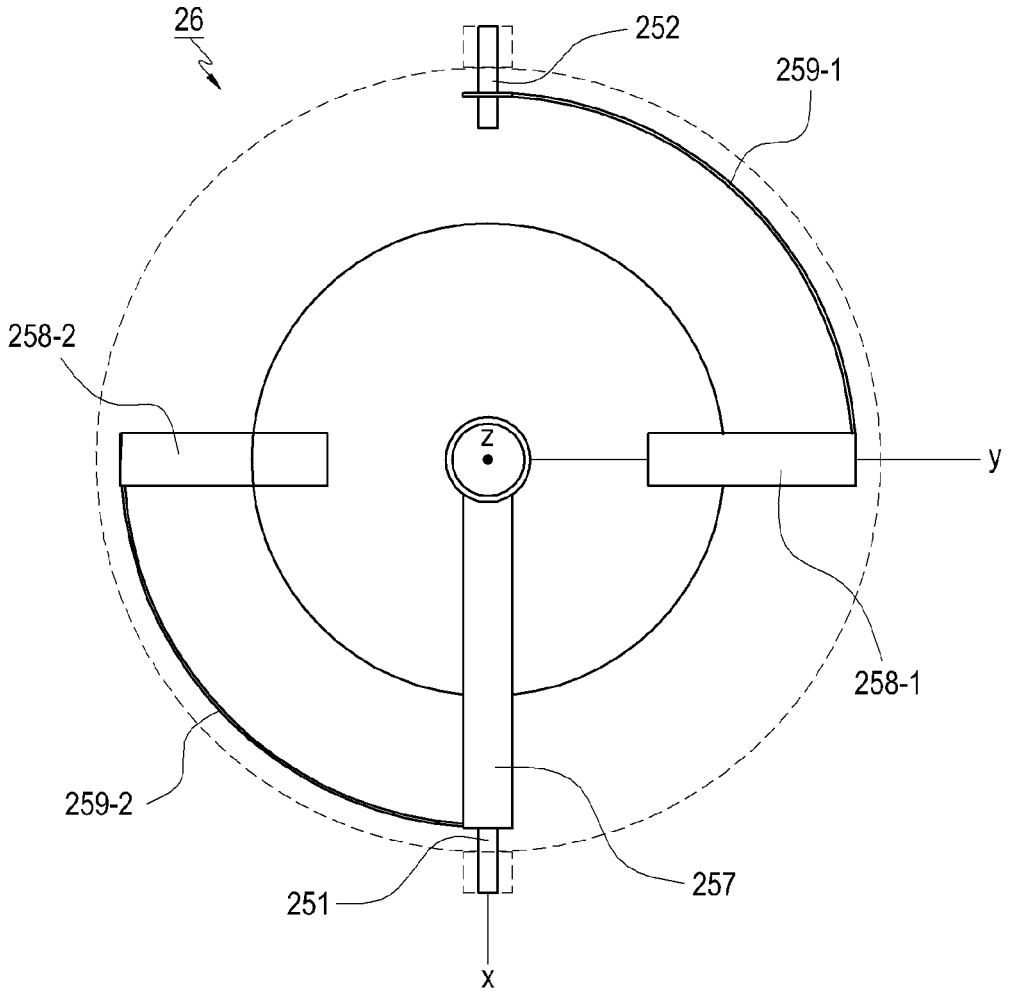

FIGS. 26 and 27 illustrate a ninth example of a multi-mode resonant filter. For convenience of illustration, only parts associated with internal transmission lines are shown. Referring to FIGS. 26 and 27, in multi-mode resonant filter 26 according to the ninth example, an input probe 251 for connection with an input connector is formed on a pole ([+] pole) of the x axis and an output probe 252 for connection with an output connector is formed on the other pole ([−] pole) of the x axis.

In this example, a first transmission line 257 for connecting a point on the x axis with a point on the z axis is also included in the multi-mode resonant filter 26. Like in the previous examples, an end of the first transmission line 257 along the x axis is connected with the input probe 221 and an end thereof along the z axis extends to a point on the +z axis.

A second transmission line for connecting a point on the z axis with a point on the y axis includes a transmission line #2-1 258-1 and a transmission line #2-2 258-2. An end of the transmission line #2-1 258-1 along the y axis is positioned on a point on the [+] pole of the y axis, and an end thereof along the z axis is spaced apart from the first transmission line 257 by a predetermined interval without being connected with the first transmission line 257, and being oriented toward the [+] pole of the z axis. An end of the transmission line #2-2 258-2 along the y axis is positioned on a point of the [−] pole of the y axis, and an end thereof along the z axis is spaced apart from the first transmission line 257 by a predetermined interval without being connected with the first transmission line 257, and being oriented toward the [+] pole of the z axis.

A third transmission line for connecting the y axis with the x axis includes a transmission line #3-1 259-1 and a transmission line #3-2 259-2. An end of the transmission line #3-1 259-1 along the y axis is connected with the transmission line #2-1 258-1, and an end thereof along the x axis is connected with the output probe 252 mounted around the [−] pole of the x axis. An end of the transmission line #3-2 259-2 along the y axis is connected with the transmission line #2-2 258-2 and an end thereof along the x axis is connected with the input probe 251 formed around the [+] pole of the x axis.

Figure 28:
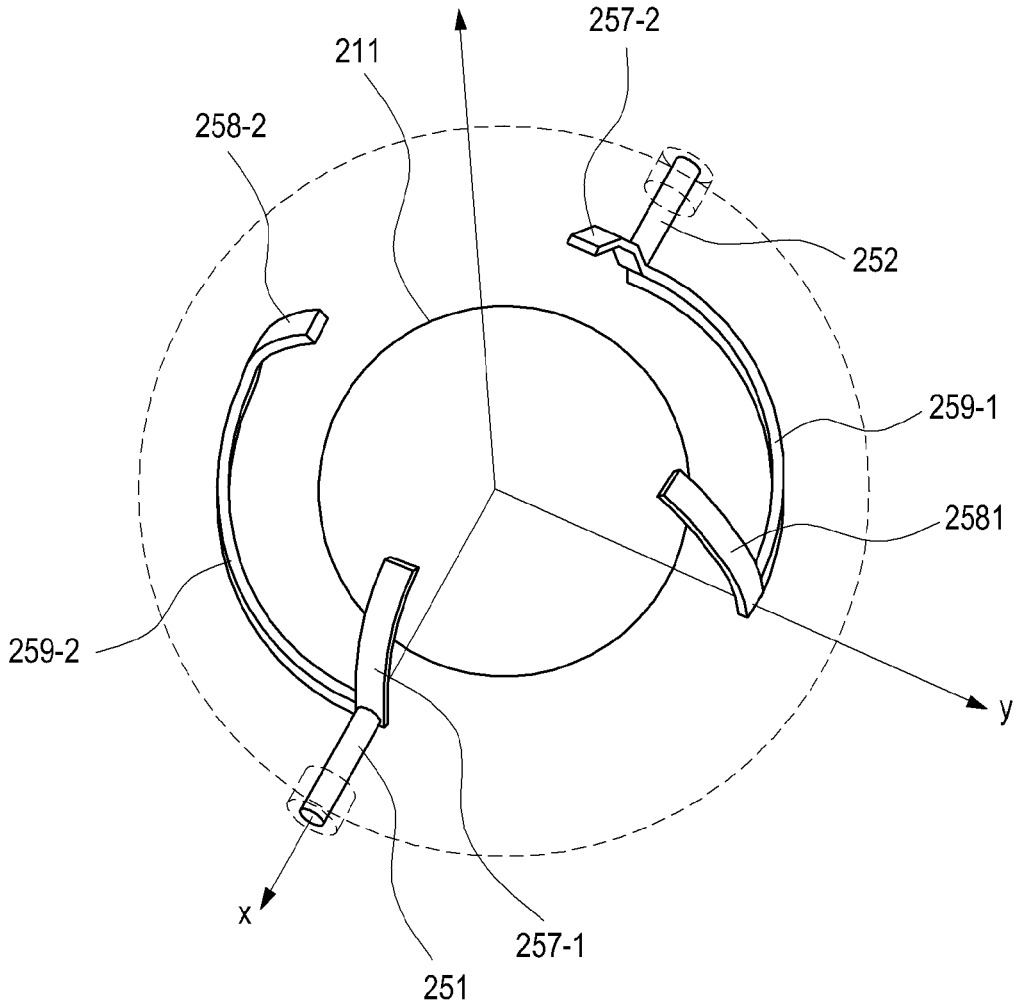
FIGS. 28 and 29 are diagrams illustrating a tenth example of a multi-mode resonant filter.
Figure 29:
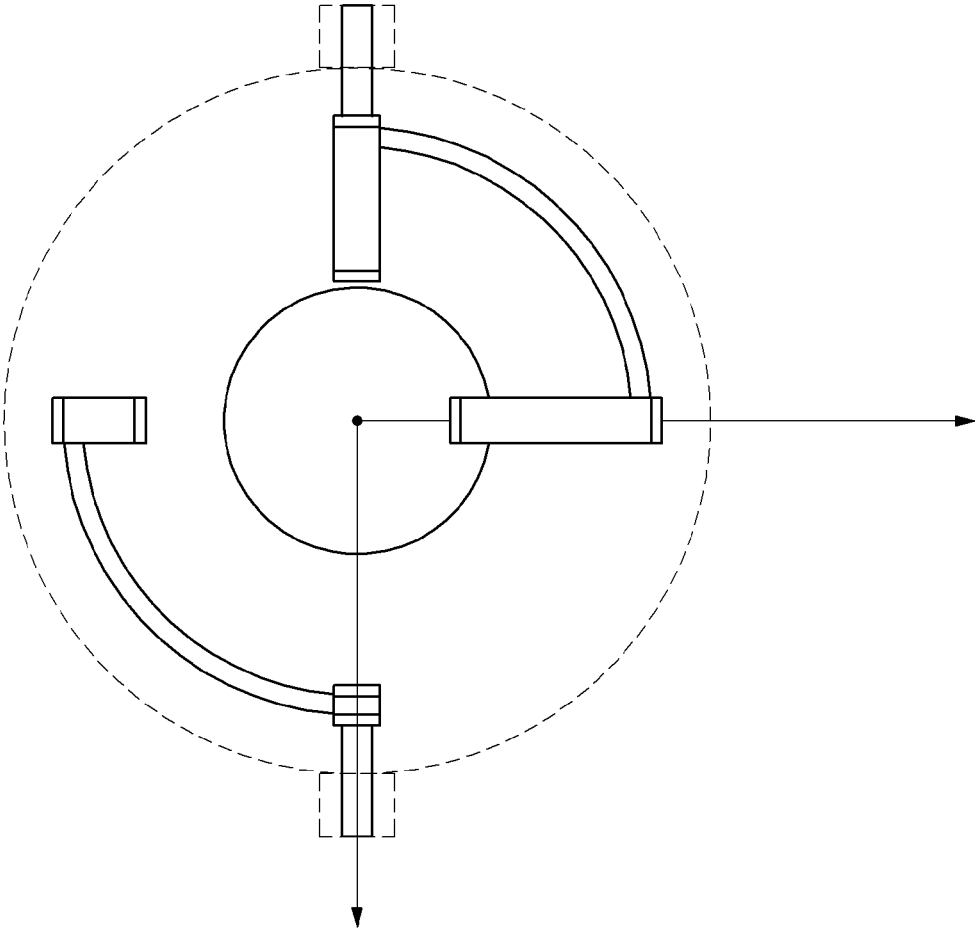

FIGS. 28 and 29 illustrate a tenth example of a multi-mode resonant filter. The multi-mode resonant filter according to the tenth example has the same structure as the multi-mode resonant filter according to the ninth example shown in FIGS. 26 and 27 except that the first transmission line 257 includes a transmission line #1-1 257-1 and a transmission line #1-2 257-2.

For example, the first transmission line 257 for connecting the x axis with the z axis includes the transmission line #1-1 257-1 and the transmission line #1-2 257-2. An end of the transmission line #1-1 257-1 along the x axis is connected with the input probe 221 on the x axis, and an end thereof along the z axis is spaced apart from the +z axis by a predetermined interval without being connected to the +z axis, and being oriented toward the +z axis. An end of the transmission line #1-2 257-2 along the −x axis is connected with the output probe 252 on the −x axis, and an end thereof along the +z axis is spaced apart from the +z axis by a predetermined interval without being connected to the +z axis, and being oriented toward the +z axis.

Figure 30:
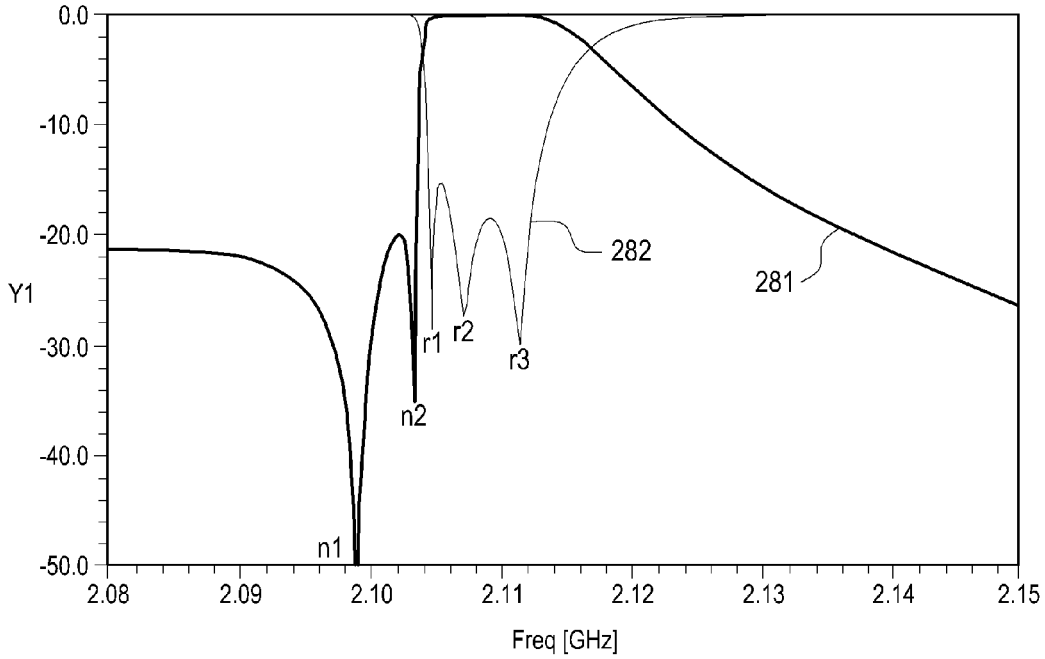
FIG. 30 is a graph illustrating an example of filtering performed by the multi-mode resonant filter shown in FIGS. 28 and 29.

FIG. 30 is a graph that illustrates an example of filtering performed by the multi-mode resonant filter shown in FIGS. 28 and 29. As shown in FIG. 30, the BPF according to the tenth example may adjust the range of a pass band and cause notches to occur in a frequency band lower than a pass band. In FIG. 30, the horizontal axis indicates frequency [GHz] and the vertical axis Y1 indicates attenuation loss. In FIG. 30, reference numeral 281 indicates a band-pass characteristic of the BPF and reference numeral 282 indicates a reflection characteristic. As shown in FIG. 30, the BPF has a band pass characteristic such that there exists a pass band of about 2.105-2.113 GHz, with notches n1 and n2 formed at frequencies lower than the pass band. Also, the reflection characteristic curve 282 having three peaks r1, r2, and r3 illustrates that three resonant modes are coupled.

Figure 31:
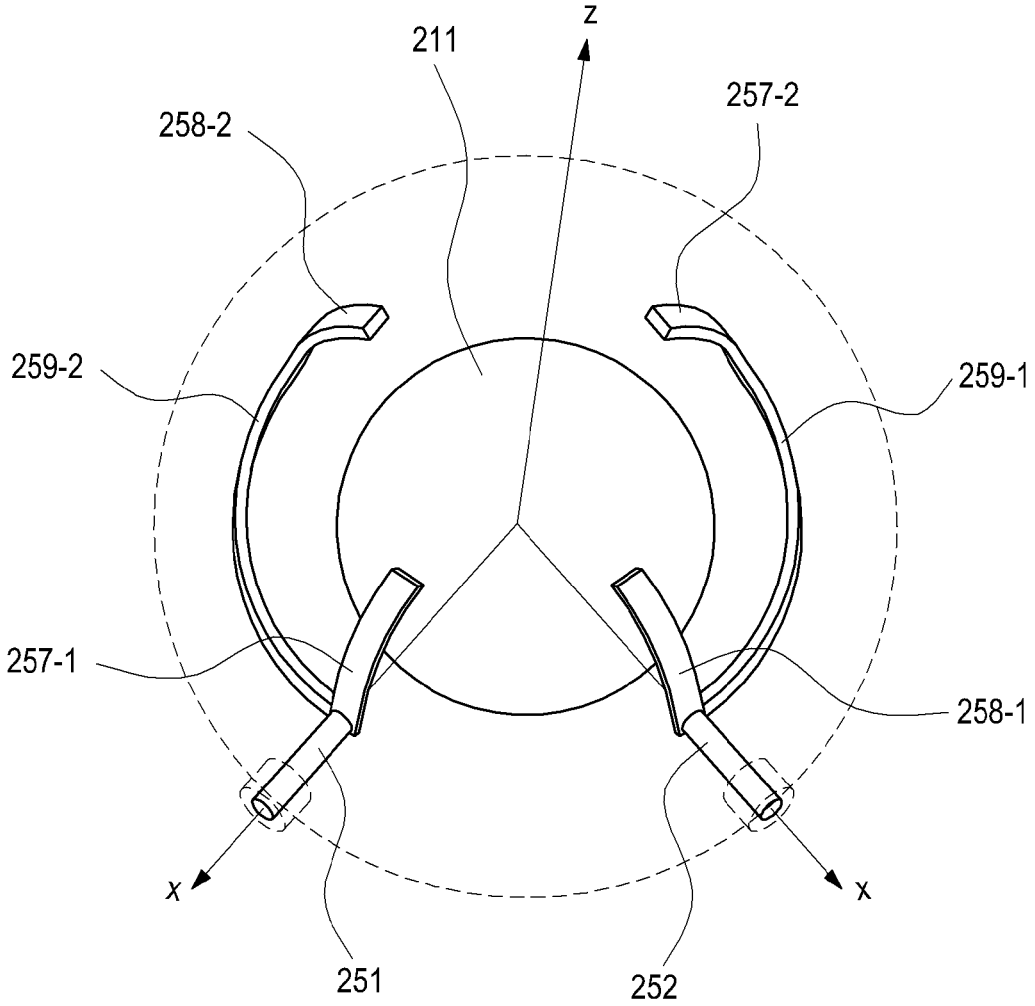
FIGS. 31 and 32 are diagrams illustrating an eleventh example of a multi-mode resonant filter.
Figure 32:
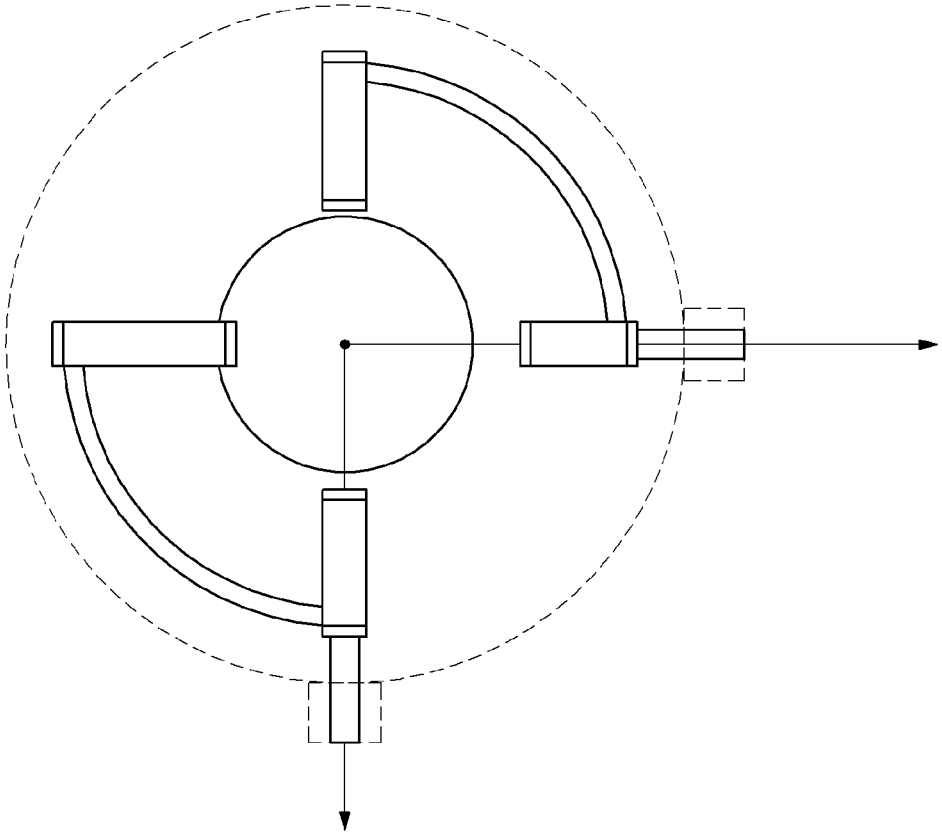

FIGS. 31 and 32 illustrate an eleventh example of a multi-mode resonant filter. The multi-mode resonant filter according to the eleventh example has the same structure as the multi-mode resonant filter according to the ninth example shown in FIGS. 26 and 27 except that an end of the first transmission line 257 extends toward the [+] pole of the z axis, but is spaced apart from the [+] pole of the z axis by a predetermined interval, without being connected to the [+] pole of the z axis, and the position of the output probe 252 is changed.

For example, the first transmission line 257 for connecting the x axis with the z axis includes the transmission line #1-1 257-1 and the transmission line #1-2 257-2. An end of the transmission line #1-1 257-1 along the x axis is connected with the input probe 221 positioned on the x axis, and an end thereof along the z axis is spaced apart from the [+] pole of the z axis by a predetermined interval without being connected with the [+] pole of the z axis, and being oriented toward the [+] pole of the z axis. An end of the transmission line #1-2 257-2 along the x axis is connected with the [−] pole of the x axis, and an end thereof along the z axis is spaced apart from the [+] pole of the z axis by a predetermined interval without being connected with the [+] pole of the z axis, and being oriented toward the [+] pole of the z axis.

The second transmission line 258 includes the transmission line #2-1 258-1 and the transmission line #2-2 258-2. An end of the transmission line #2-1 258-1 along the y axis is connected with the output probe 252 positioned on the +y axis, and an end thereof along the z axis is spaced apart from the [+] pole of the z axis by a predetermined interval without being connected with the [+] pole of the z axis, and being oriented toward the [+] pole of the z axis. An end of the transmission line #2-2 258-2 along the y axis is positioned on a point of the [−] pole of the y axis, and an end thereof along the z axis is spaced apart from the [+] pole of the z axis by a predetermined interval without being connected with the first transmission line 257, and being oriented toward the [+] pole of the z axis.

The third transmission line 259 for connecting the y axis with the x axis includes the transmission line #3-1 259-1 and the transmission line #3-2 259-2. An end of the transmission line #3-1 259-1 along the y axis is connected with the output probe 252, and an end thereof along the x axis is connected with a point on the x axis. An end of the transmission line #3-2 259-2 along the y axis is connected with the transmission line #2-2 258-2 and an end thereof along the x axis is connected with the input probe 251 formed around the [+] pole of the x axis.

Figure 33:
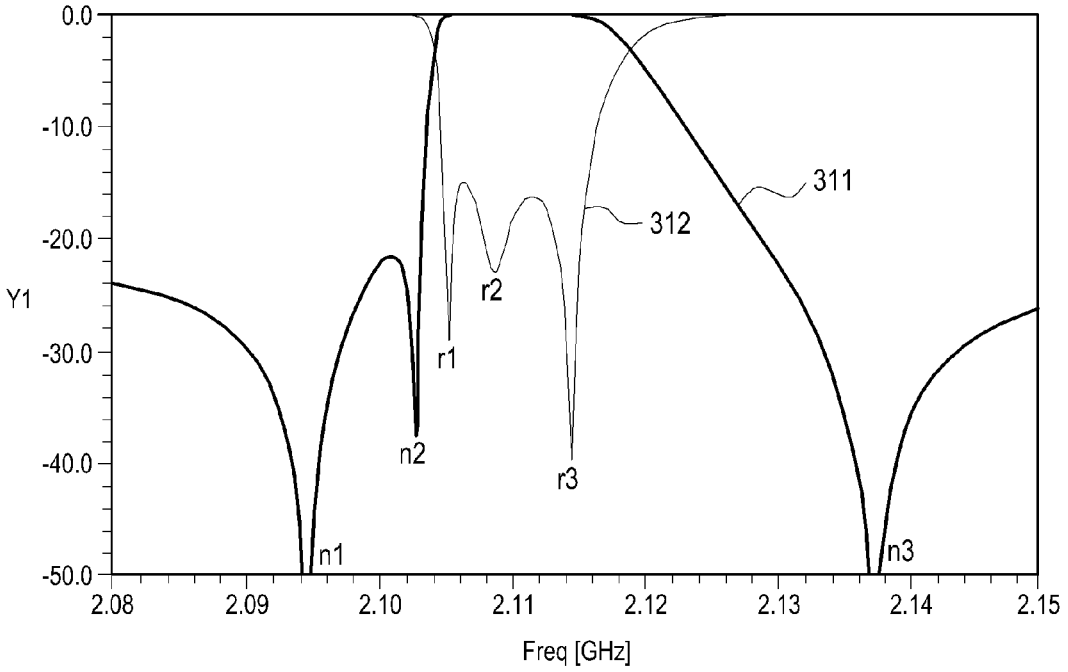
FIG. 33 is a graph illustrating an example of filtering performed by the multi-mode resonant filter shown in FIGS. 31 and 32.

FIG. 33 is a graph that illustrates an example of filtering performed by the multi-mode resonant filter shown in FIGS. 31 and 32. As shown in FIG. 33, the BPF according to the eleventh example may cause notches to occur in a frequency band higher than a pass band. In FIG. 33, the horizontal axis indicates frequency Freq[GHz] and the vertical axis Y1 indicates attenuation loss. In FIG. 33, reference numeral 311 indicates a band-pass characteristic of the BPF and reference numeral 312 indicates a reflection characteristic. As shown in FIG. 33, the BPF has a band pass characteristic such that there exists a pass band of about 2.105-2.113 GHz, with notches n1 and n2 formed at frequencies lower than the pass band and with a notch n3 formed at frequency higher than the pass band. Also, the reflection characteristic curve 312 having three peaks r1, r2, and r3 illustrates that three resonant modes are coupled.

Figure 34:
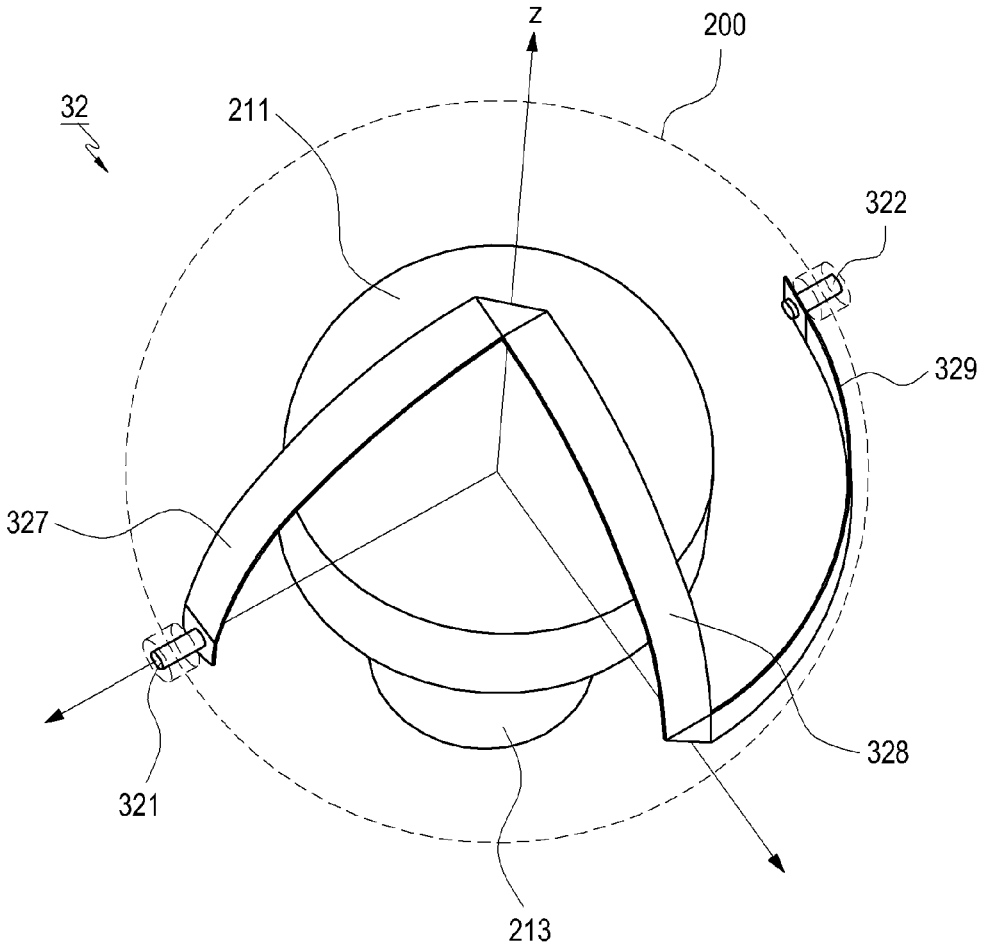
FIGS. 34 and 35 are diagrams illustrating a twelfth example of a multi-mode resonant filter.
Figure 35:
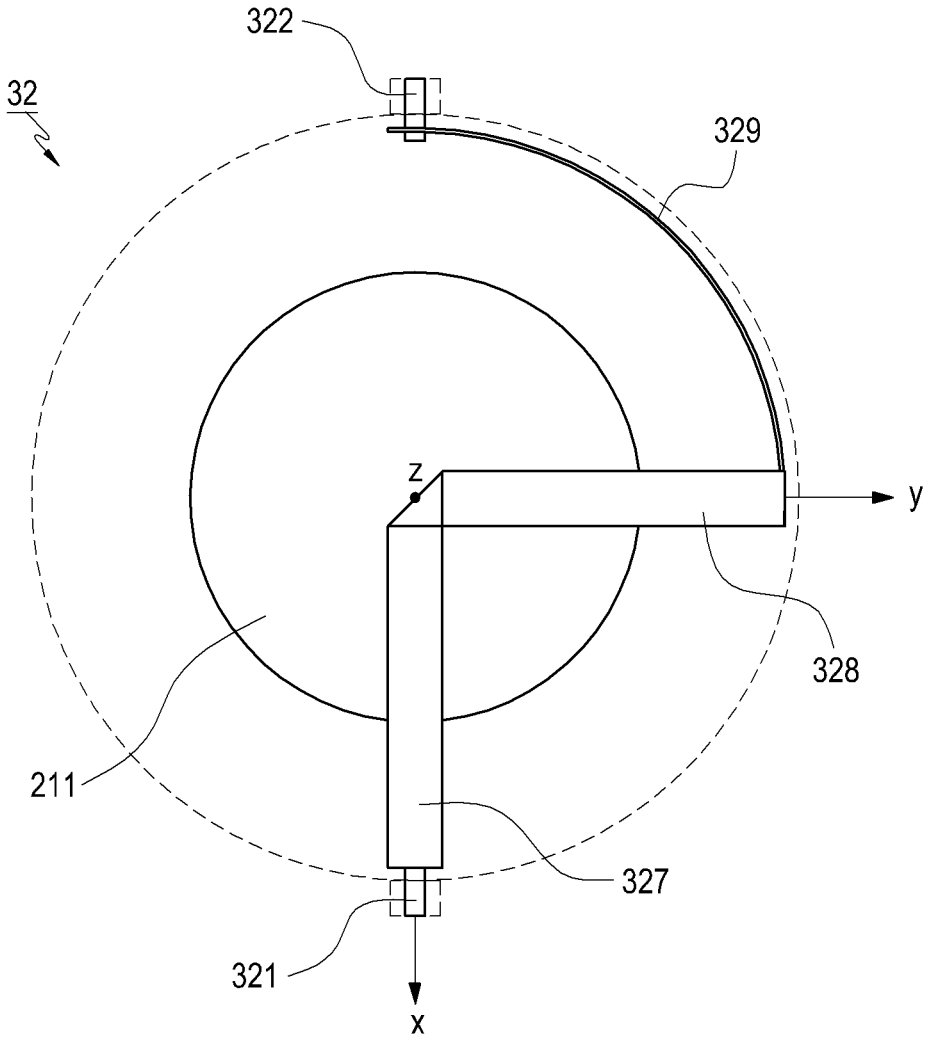

FIGS. 34 and 35 illustrate a twelfth example of a multi-mode resonant filter. For convenience of illustration, the housing disclosed in the previous examples, the input and output connectors, and the tuning probes formed outside the housing are not shown.

Referring to FIGS. 34 and 35, a multi-mode resonant filter 32 according to the twelfth example has a cavity in a spherical or sphere-like shape where an air layer is formed in the housing 200 in a spherical or sphere-like shape, the DR element 211 in a spherical or sphere-like shape in the cavity, and an input probe 321 for connection with an input connector formed on a pole ([+] pole) of the x axis. An output probe 322 for connection with an output connector is formed on the other pole ([−] pole) of the x axis.

The multi-mode resonant filter 32 also includes a first transmission line 327 for connecting a point on the x axis ([+] pole thereof) with a point on the z axis, a second transmission line 328 for connecting a point on the y axis with a point on the z axis, and a third transmission line 329 for connecting a point on the y axis with a point on the x axis ([−] pole thereof). An end of the first transmission line 327 along the x axis is connected with the input probe 321, and an end of the third transmission line 329 along the x axis is connected with the output probe 322. Accordingly, the first transmission line 327, the second transmission line 328, and the third transmission line 329 are connected in series on the whole. The first transmission line 327, the second transmission line 328, and the third transmission line 329 may be formed by bending a single metal bar formed as a single body. For example, an end of the single metal bar may be connected to the input probe 321 positioned on a point on the +x axis, and a second end of the single metal bar extend toward the +z axis. The second end of the single metal bar reached on the +z axis may be bent at 90°, whereby the second end of the single metal bar extends toward the +y axis. The second end of the single metal bar reached on the +y axis may be bent again at 90°, whereby the second end of the single metal bar extends toward the −x axis. Once the single metal bar reaches the −x axis while extending toward the −x axis, the second end thereof is connected to the output probe 322.

Figure 36:
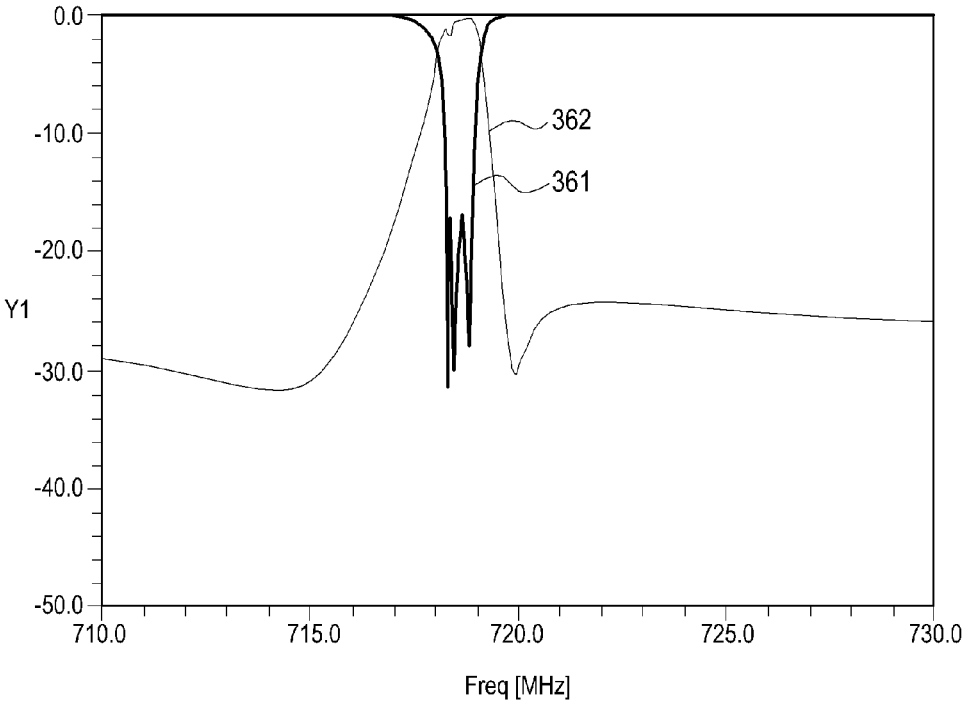
FIG. 36 is a graph illustrating an example of filtering performed by the multi-mode resonant filter shown in FIGS. 34 and 35.

FIG. 36 is a graph that illustrates an example of filtering performed by the multi-mode resonant filter shown in FIGS. 34 and 35. In FIG. 36, the horizontal axis indicates frequency [GHz] and the vertical axis Y1 indicates attenuation loss. In FIG. 36, reference numeral 361 indicates a band rejection characteristic of the BRF and reference numeral 362 indicates a reflection characteristic.

As shown in FIG. 36, the BRF has a band rejection characteristic such that there exists a rejection band of about 717-720 MHz. Also, the band rejection characteristic curve 361 having three peaks, as shown in FIG. 36, illustrates that three resonant modes are coupled.

Figure 37:
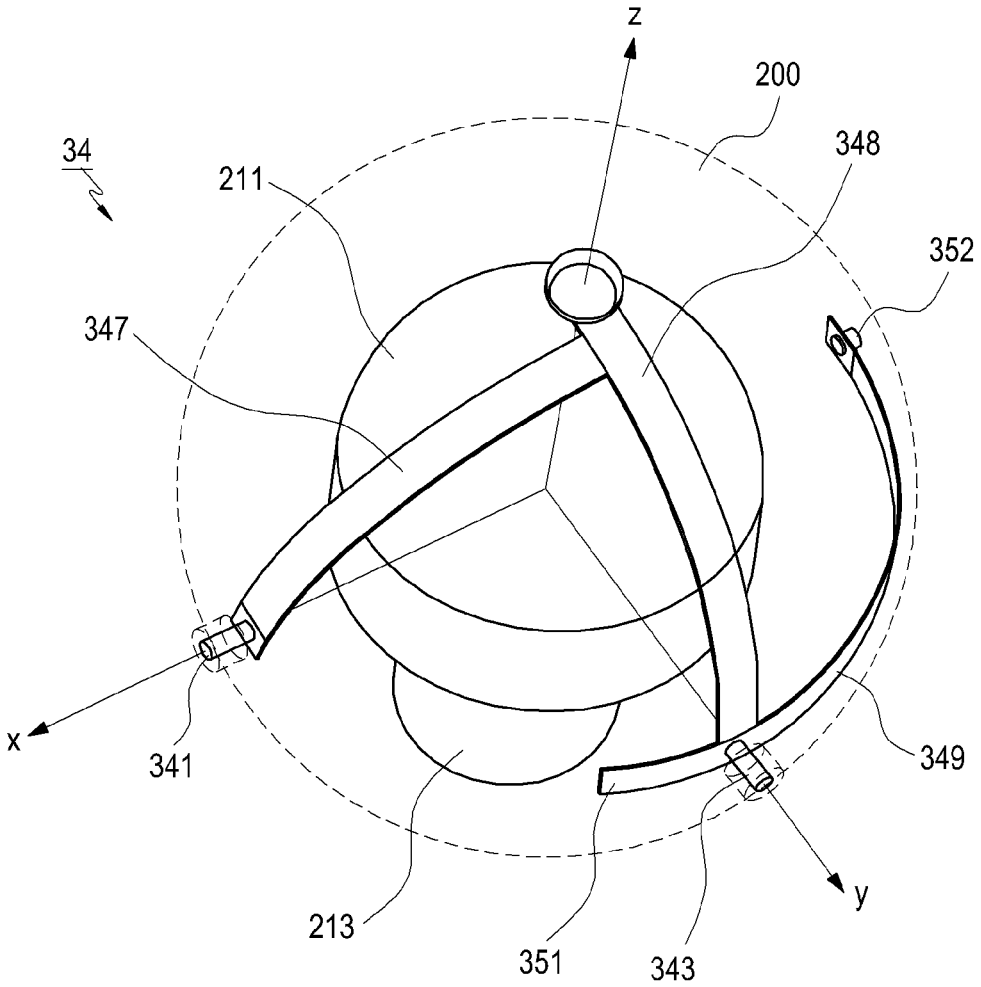
FIGS. 37 and 38 are diagrams illustrating a thirteenth example of a multi-mode resonant filter.
Figure 38:
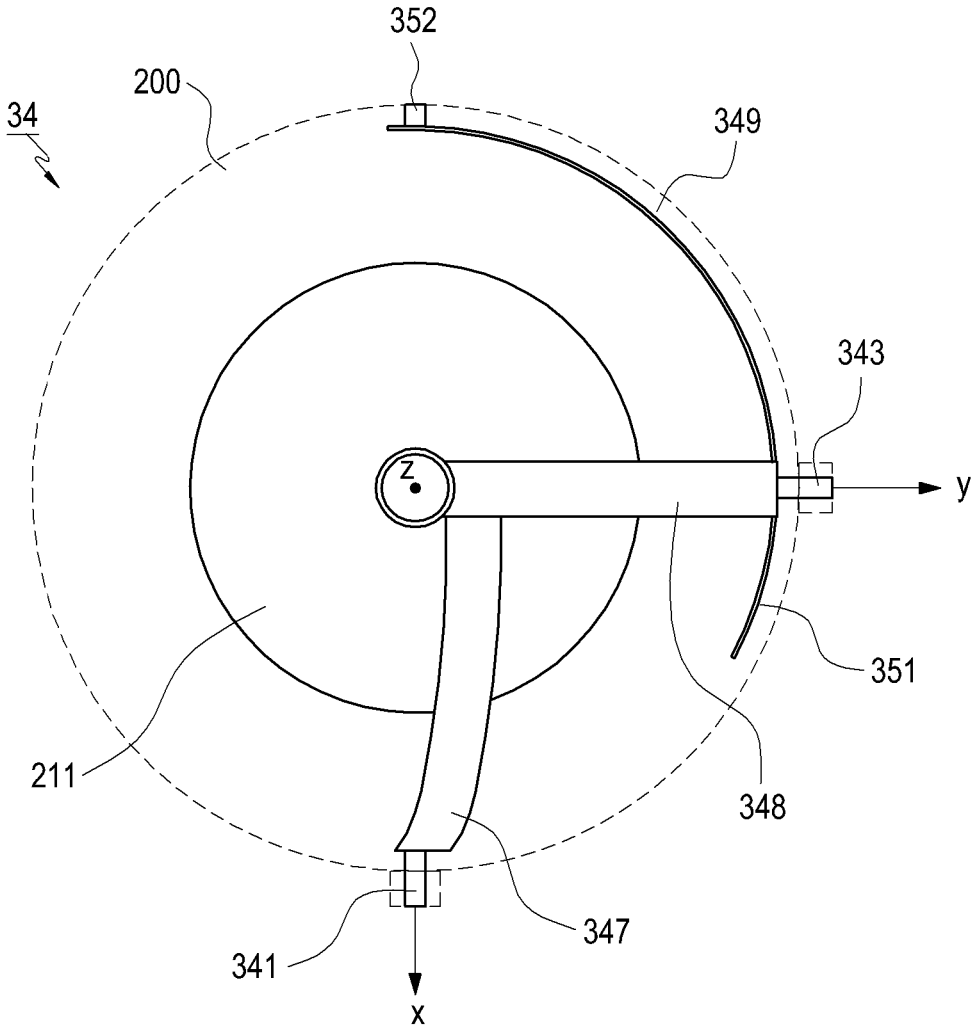

FIGS. 37 and 38 illustrate a thirteenth example of a multi-mode resonant filter. For convenience of illustration, the housing disclosed in the previous examples, the input and output connectors, and the tuning probes formed outside the housing are not shown.

Referring to FIGS. 37 and 38, a multi-mode resonant filter 34 according to the thirteenth example has a cavity in a spherical or sphere-like shape where an air layer is formed in the housing 200 in a spherical or sphere-like shape, the DR element 211 in a spherical or sphere-like shape in the cavity, an input probe 341 for connection with an input connector formed on a pole ([+] pole) of the x axis, and an output probe 343 for connection with an output connector formed on a pole of the y axis.

The multi-mode resonant filter 34 also includes a first transmission line 347 for connecting a point around the x axis ([+] pole thereof) with a point around the z axis, a second transmission line 348 for connecting a point on the y axis with a point on the z axis, and a third transmission line 349 for connecting a point on the y axis with a point on the x axis ([−] pole thereof). An end of the first transmission line 347 along the x axis is connected with the input probe 341, and an end of the second transmission line 348 along the y axis is connected with the output probe 343. Accordingly, the first transmission line 347 is twisted by a predetermined interval (an angle of less than 45° from the z axis), instead of matching the z axis, thus being connected with the second transmission line 348. The other end of the first transmission line 347 is spaced apart from the +z axis by a predetermined distance which is smaller than the distance between the other end of the first transmission line 347 and the output probe 343 on the +y axis. An end of the third transmission line 349 along the x axis ([−] pole thereof) is grounded by means of a metal grounding member 352 by being directly connected with the inner wall of the housing 200. Thus, the third transmission line 349 is electrically short-circuited.

In addition to the foregoing structure, to adjust a notch feature or a coupling feature, a first auxiliary transmission line 351 may be installed such that it is connected at an end thereof with the third transmission line 349 and is oriented toward the [+] pole of the x axis and the [−] pole of the y axis. A first end of the first auxiliary transmission line 351 is connected with the output probe 343, and a second end thereof is spaced apart from the x axis, though extending toward the x axis.

Figure 39:
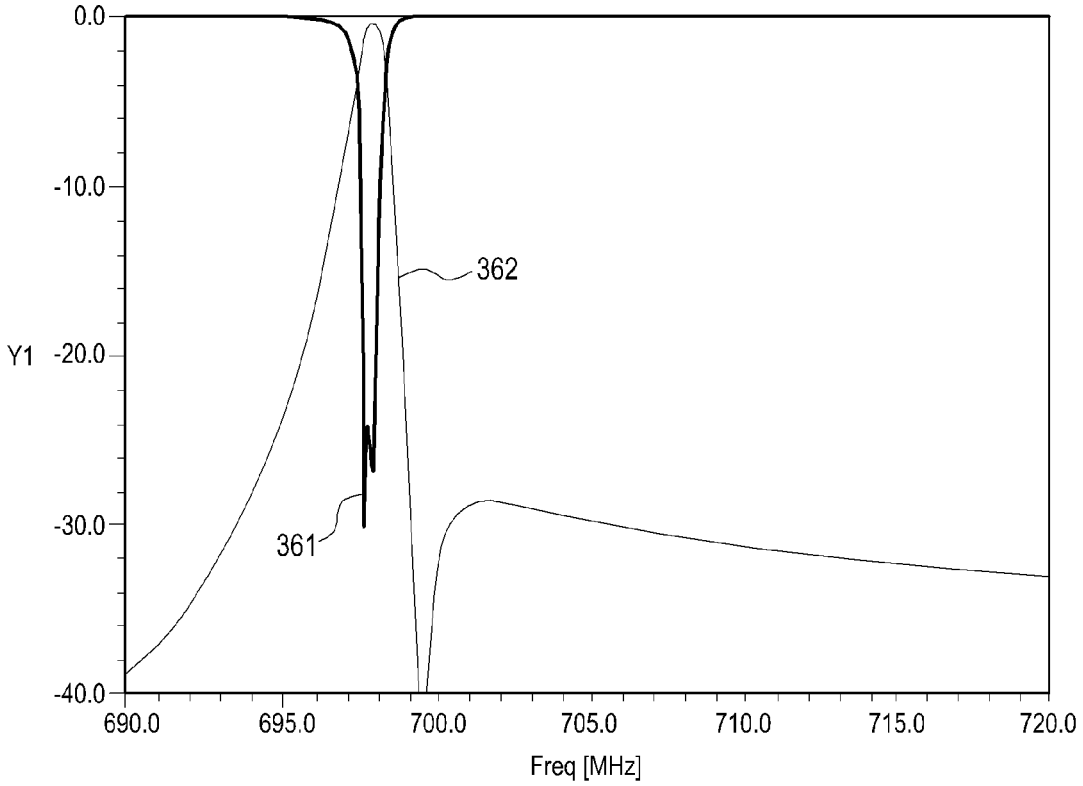
FIG. 39 is a graph illustrating an example of filtering performed by the multi-mode resonant filter shown in FIGS. 37 and 38.

FIG. 39 is a graph that illustrates an example of filtering performed by the multi-mode resonant filter shown in FIGS. 37 and 38. In FIG. 39, the horizontal axis indicates frequency [GHz] and the vertical axis Y1 indicates attenuation loss. In FIG. 39, reference numeral 361 indicates a band rejection characteristic of the BRF and reference numeral 362 indicates a reflection characteristic.

The BRF according to the thirteenth example has a filtering feature such that a rejection band exists around 698 MHz. In the band rejection characteristic curve 361 shown in FIG. 39, three resonant modes are coupled by formation of three peaks. However, in FIG. 36, left two peaks among the three peaks overlap each other. Those of ordinary skill in the art should understand that two adjacent peaks may be shown as overlapping according to a set resolution of a graph.

Figure 40:
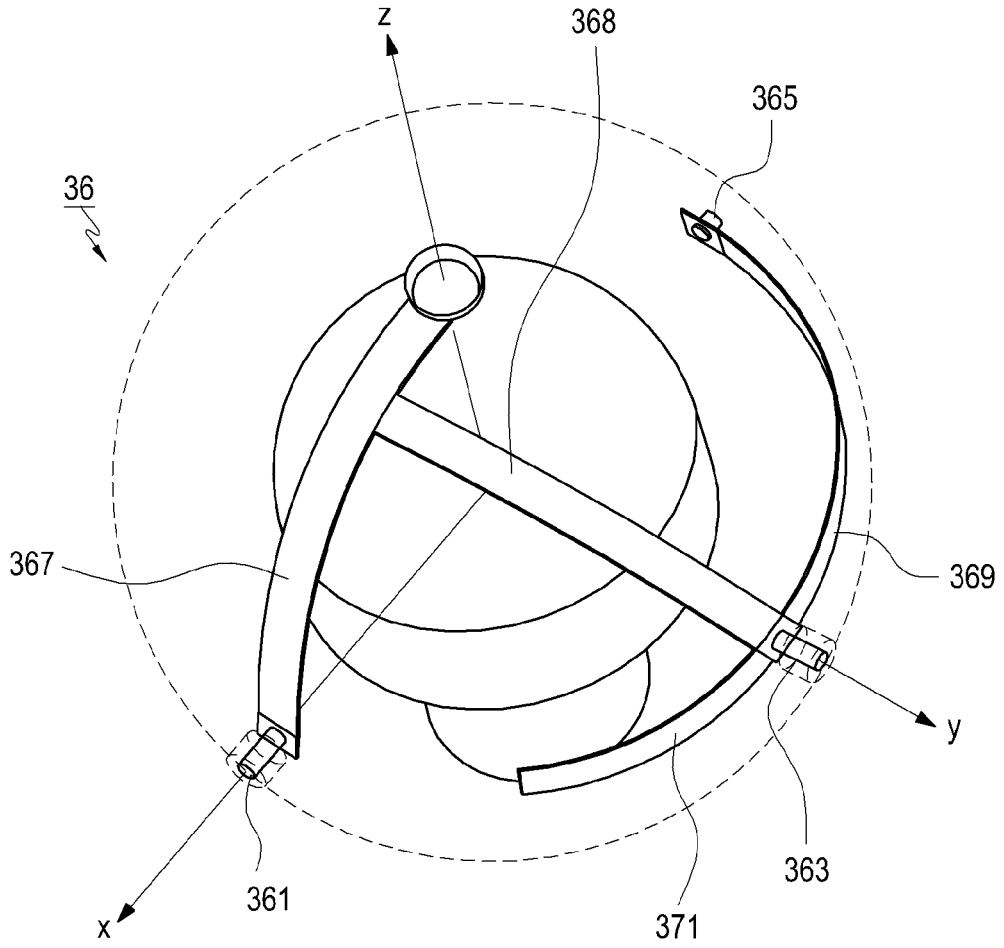
FIGS. 40 and 41 are diagrams illustrating a fourteenth example of a multi-mode resonant filter.
Figure 41:
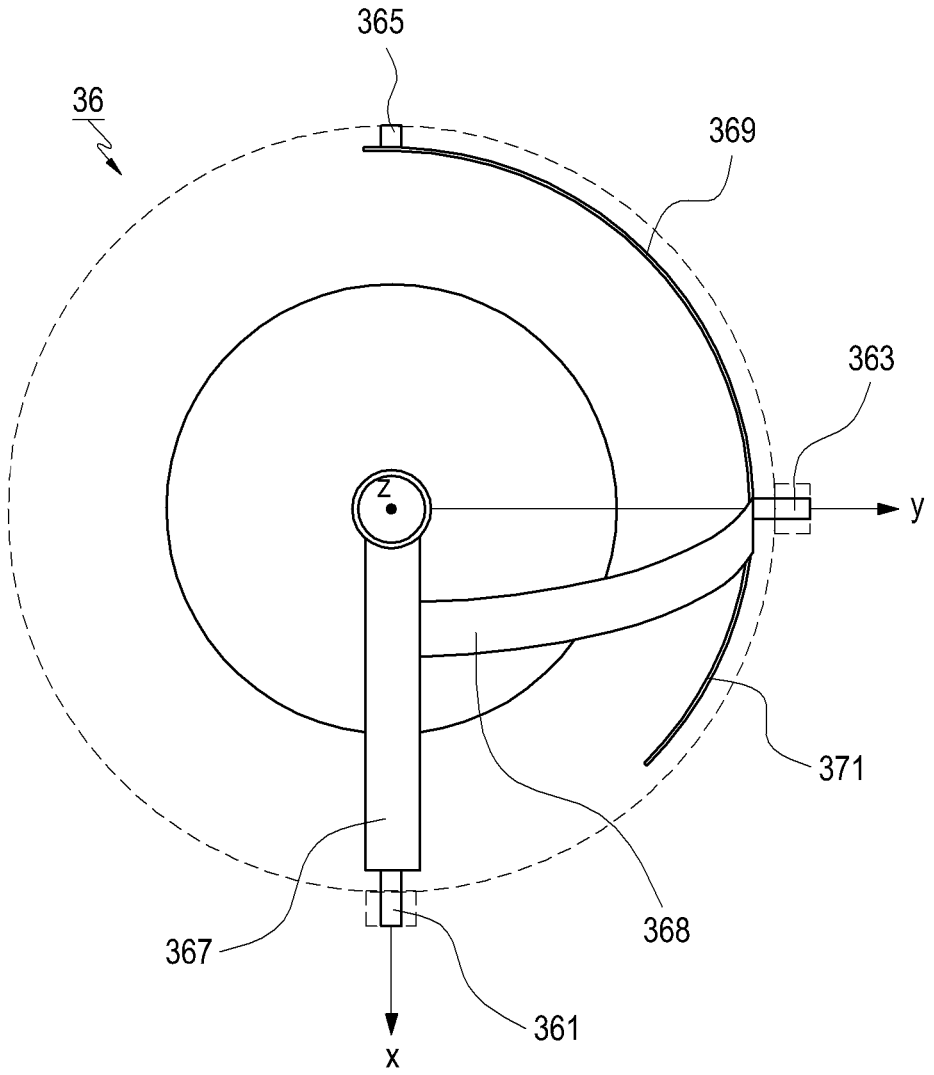

FIGS. 40 and 41 illustrate a fourteenth example of a multi-mode resonant filter. For convenience of illustration, only parts associated with internal transmission lines are shown. Referring to FIGS. 40 and 41, in a multi-mode resonant filter 36 according to the fourteenth example, an input probe 361 for connection with an input connector is formed on a pole ([+] pole) of the x axis and an output probe 363 for connection with an output connector is formed on a pole of the y axis.

The multi-mode resonant filter 36 also includes a first transmission line 367 for connecting a point on the ([+] pole) of the x axis with a point on the z axis, a second transmission line 368 for connecting a point around the y axis with a point around the z axis, and a third transmission line 369 for connecting a point on the y axis with a point on the x axis ([−] pole thereof). In this example, a first end of the first transmission line 367 along the x axis is connected with the input probe 361, and an end of the second transmission line 368 along the y axis is connected with the output probe 363. The second transmission line 368 is twisted by a predetermined interval (an angle of less than 45° from the z axis), instead of matching the z axis, thus being connected to the first transmission line 367. A second end of the second transmission line 368 is spaced apart from the +z axis by a predetermined distance which is smaller than the distance between the second end of the second transmission line 348 and the input probe 361 on the +x axis. An end of the third transmission line 369 along the x axis (toward the [−] pole thereof) is grounded by being directly connected to the inner wall of the housing 200 by means of a metal grounding member 365. Therefore, the third transmission line 369 is electrically short-circuited.

In addition to the foregoing structure, to adjust a notch feature or a coupling feature, a first auxiliary transmission line 371 may be installed such that it is connected at an end thereof with the third transmission line 369 and extends towards the [+] pole of the x axis and the [−] pole of the y axis. A first end of the first auxiliary transmission line 371 is connected to the output probe 363 and a second end thereof extends towards the x axis, but is spaced apart from the x axis.

Figure 42:
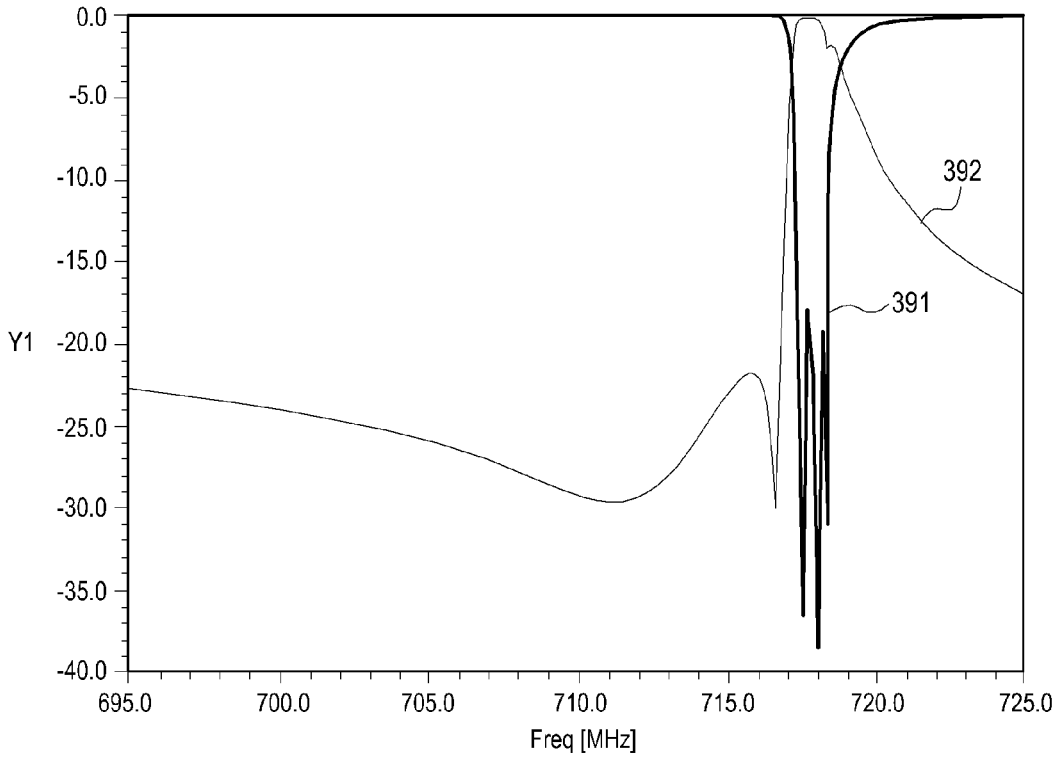
FIG. 42 is a graph illustrating an example of filtering performed by the multi-mode resonant filter shown in FIGS. 40 and 41.

FIG. 42 is a graph that illustrates an example of filtering performed by the multi-mode resonant filter shown in FIGS. 40 and 41. In FIG. 42, the horizontal axis indicates frequency [GHz] and the vertical axis Y1 indicates attenuation loss. In FIG. 42, reference numeral 391 indicates a band rejection characteristic of the BRF and reference numeral 392 indicates a reflection characteristic. As shown in FIG. 42, the BRF has a filtering characteristic such that there exists a rejection band of about 717-719 MHz. Also, curve 391 of FIG. 42 illustrates that three resonant modes are coupled by formation of three peaks.

Figure 43:
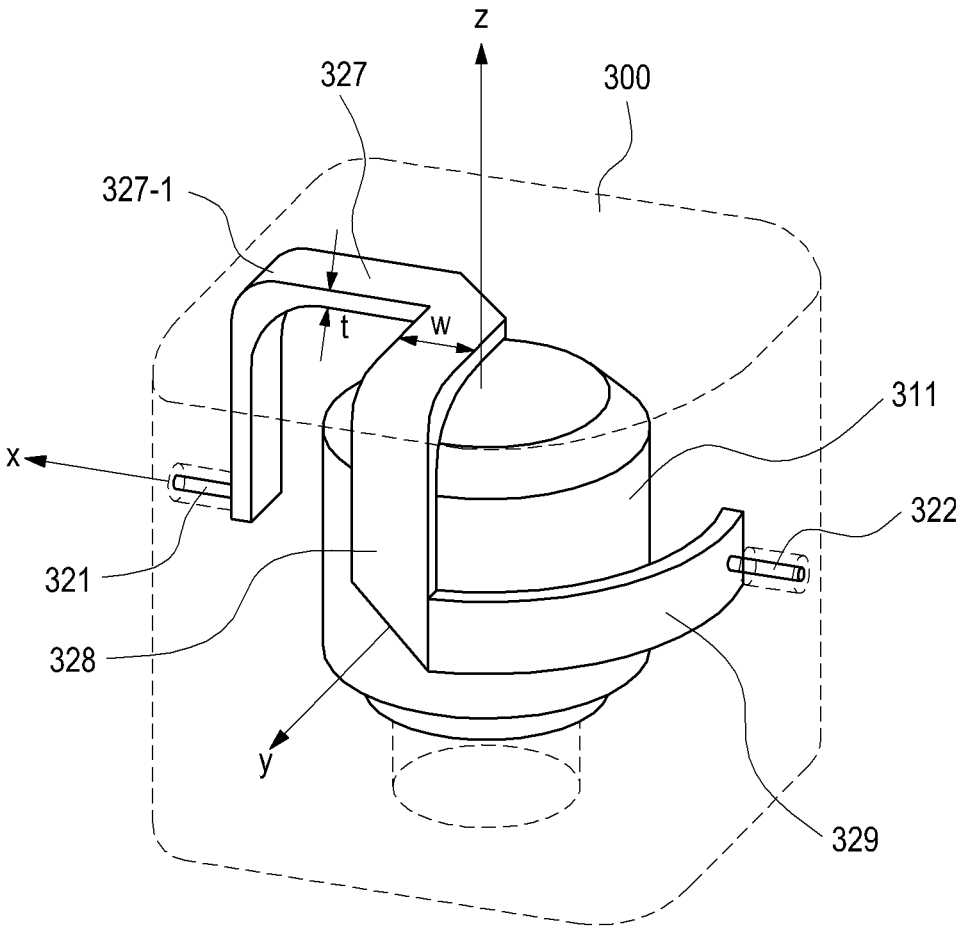
FIG. 43 is a diagram illustrating a fifteenth example of a multi-mode resonant filter.

FIG. 43 illustrates a fifteenth example of a multi-mode resonant filter. The multi-mode resonant filter according to the fifteenth example has the same structure as the multi-mode resonant filter according to the twelfth example shown in FIGS. 34 and 35 except that the DR element 211 has a cylindrical shape and the housing 200 has a rectangular hexahedral shape.

Referring to FIG. 43, a multi-mode resonant filter 32 according to the fifteenth example includes a cavity in a substantially rectangular hexahedral shape where an air layer is formed in the housing 200 in a substantially rectangular hexahedral shape, and the DR element 211 in a substantially cylindrical shape in the cavity. As shown in FIG. 43, corners of the inner circumferential surface or the outer circumferential surface of the housing 200 may be partially treated to form gentle curves. Top and bottom corners of the DR element 211 may also be partially removed, but the DR element 211 may be regarded as being in a substantially cylindrical shape as long as it has a cylindrical shape on the whole.

The input probe 321 for connection with an input connector is formed on a pole ([+] pole) of the x axis. The output probe 322 for connection with an output connector is formed on the other pole ([−] pole) of the x axis.

In this example, the multi-mode resonant filter 32 also includes a first transmission line 327 for connecting a point on the x axis ([+] pole thereof) with a point on the z axis, a second transmission line 328 for connecting a point on the y axis with a point on the z axis, and a third transmission line 329 for connecting a point on the y axis with a point on the x axis ([−] pole thereof). An end of the first transmission line 327 along the x axis is connected with the input probe 321, and an end of the third transmission line 329 along the x axis is connected with the output probe 322. Accordingly, the first transmission line 327, the second transmission line 328, and the third transmission line 329 are connected in series on the whole. The first transmission line 327 is connected with the second transmission line 328 on the z axis. The second transmission line 328 is connected with the third transmission line 329 on the y axis.

The thickness t of the first transmission line 327, the second transmission line 328, and the third transmission line 329 according to the fifteenth example is greater than that of the transmission lines according to the twelfth example shown in FIGS. 34 and 35. The width w of the first transmission line 327, the second transmission line 328, and the third transmission line 329 may be adjusted to achieve desired filter characteristics.

In addition, the first transmission line 327 according to the fifteenth example may be bent following the shape of the housing 200. That is, to correspond to the inner circumferential shape of the housing 200 in a rectangular hexahedral shape, a portion 327-1 of the first transmission line 327 may be bent at approximately 90° following the inner circumferential shape of the housing 200. The third transmission line 329 may be formed in a curved shape following the shape of the DR element 211. In other words, to correspond to the outer circumferential shape of the DR element 211 in a cylindrical shape, the third transmission line 329 may be formed in a curved shape following the outer circumferential shape of the DR element 211.

Figure 44:
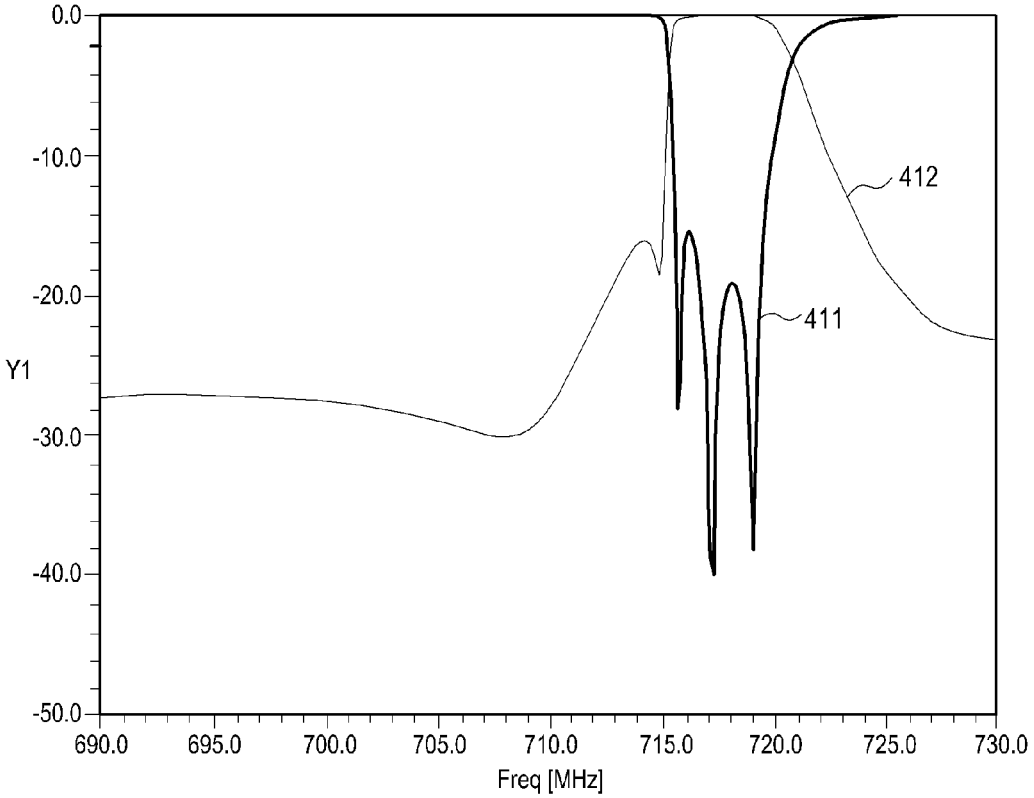
FIG. 44 is a graph illustrating an example of filtering performed by the multi-mode resonant filter shown in FIG. 43.

FIG. 44 is a graph that illustrates an example of filtering performed by the multi-mode resonant filter shown in FIG. 43. In FIG. 44, a horizontal axis indicates frequency [GHz] and the vertical axis Y1 indicates attenuation loss. In FIG. 44, reference numeral 411 indicates a band rejection characteristic of the BRF and reference numeral 412 indicates a reflection characteristic. As shown in FIG. 44, the BRF has a filtering characteristic such that there exists a rejection band of about 715-719 MHz. Also, curve 411 of FIG. 44 illustrates that three resonant modes are coupled by formation of three peaks.

Figure 45:
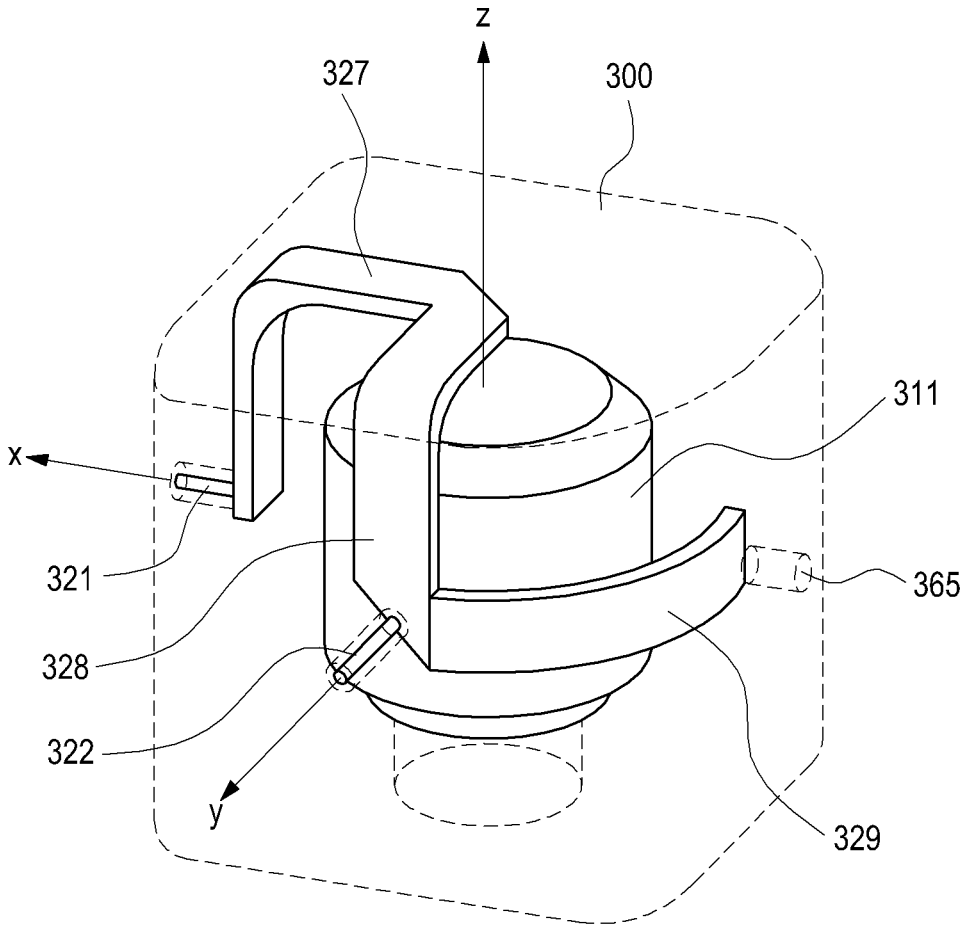
FIG. 45 is a diagram illustrating a sixteenth example of a multi-mode resonant filter.

FIG. 45 illustrates a sixteenth example of a multi-mode resonant filter. The multi-mode resonant filter according to the sixteenth example is different from the multi-mode resonant filter according to the fifteenth example shown in FIG. 43 as described below.

Referring to FIG. 45, the multi-mode resonant filter according to the sixteenth example includes the input probe 321 for connection with an input connector on a pole ([+] pole) of the x axis. The output probe 322 for connection with an output connector is formed on a pole ([+] pole) of the y axis.

The multi-mode resonant filter according to the sixteenth example also includes a first transmission line 327 for connecting a point on the x axis ([+] pole thereof) with a point on the z axis, a second transmission line 328 for connecting a point on the y axis with a point on the z axis, and a third transmission line 329 for connecting a point on the y axis with a point on the x axis ([−] pole thereof). An end of the first transmission line 327 along the x axis is connected with the input probe 321, and an end of the second transmission line 328 along the y axis is connected with the output probe 322. Accordingly, the first transmission line 327, the second transmission line 328, and the third transmission line 329 are connected in series on the whole. The first transmission line 327 is connected with the second transmission line 328 on the z axis. The second transmission line 328 is connected with the third transmission line 329 on the y axis. An end of the third transmission line 329 along the x axis ([−] pole thereof) is grounded by being directly connected to the inner wall of the housing 200 by means of the metal grounding member 365. Therefore, the third transmission line 329 is electrically short-circuited.

Figure 46:
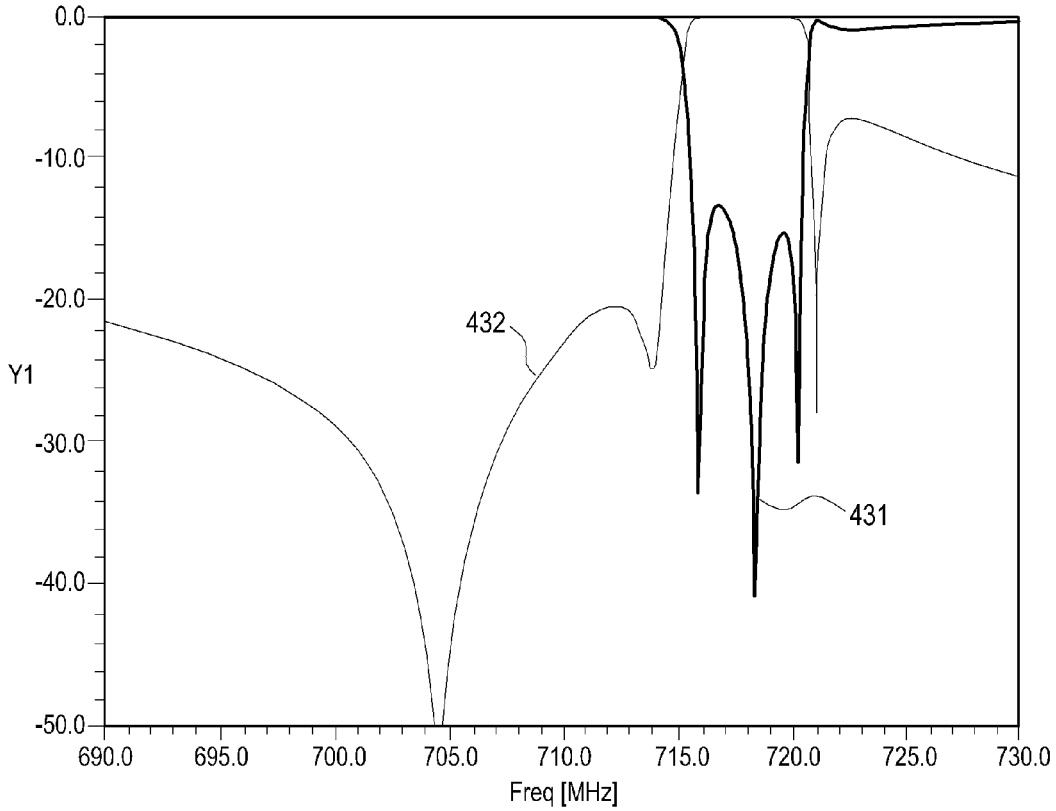
FIG. 46 is a graph illustrating an example of filtering performed by the multi-mode resonant filter shown in FIG. 45.

FIG. 46 is a graph that illustrates an example of filtering performed by the multi-mode resonant filter shown in FIG. 45. In FIG. 46, the horizontal axis indicates frequency [GHz] and the vertical axis Y1 indicates attenuation loss. In FIG. 46, reference numeral 431 indicates a band rejection characteristic of the BRF and reference numeral 432 indicates a reflection characteristic. As shown in FIG. 46, the BRF has a filtering characteristic such that there exists a rejection band of about 715-721 MHz. Also, curve 431 of FIG. 46 illustrates that three resonant modes are coupled by formation of three peaks.

Figure 47:
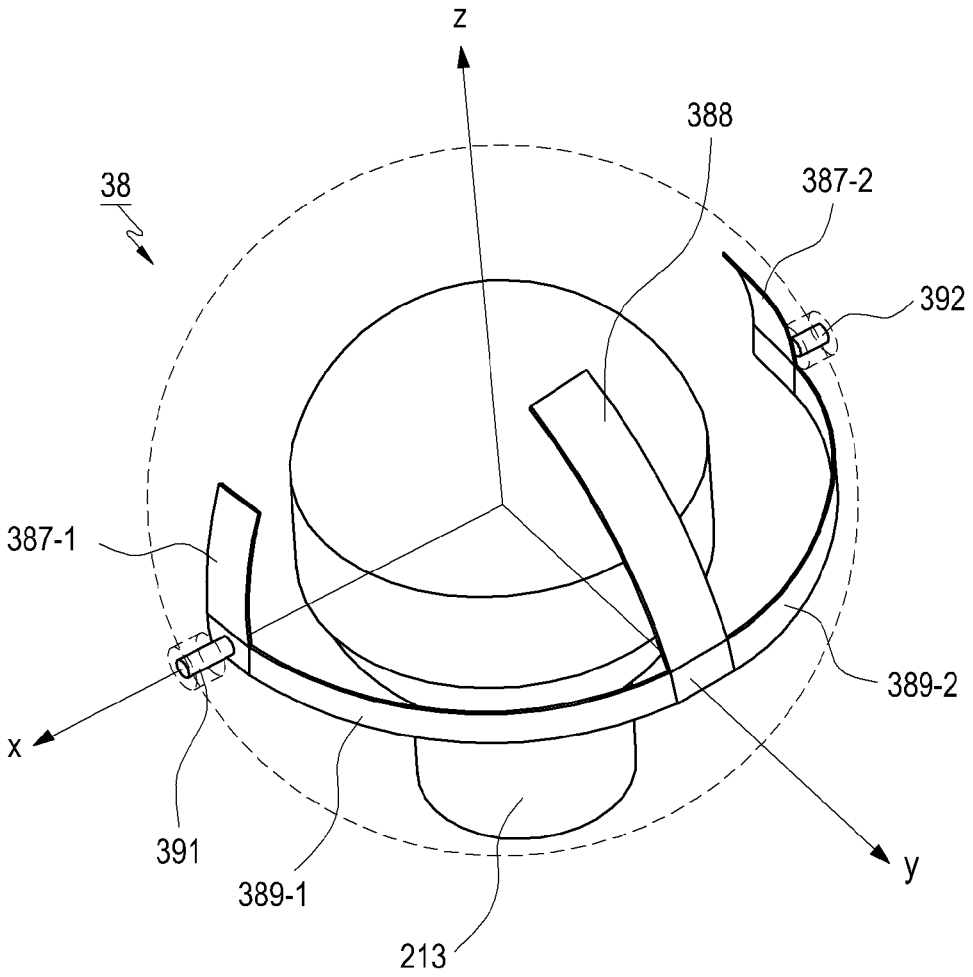
FIGS. 47 and 48 are diagrams illustrating a seventeenth example of a multi-mode resonant filter.
Figure 48:
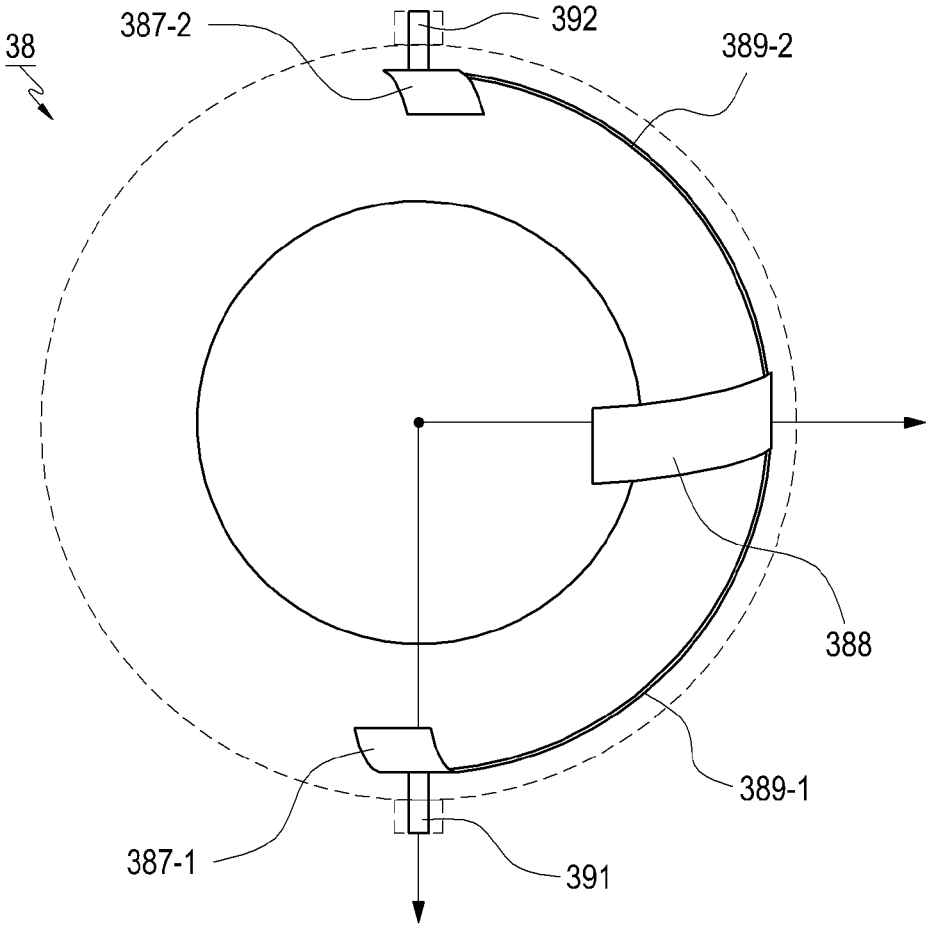

FIGS. 47 and 48 illustrate a seventeenth example of a multi-mode resonant filter. For convenience of illustration, only parts associated with transmission lines are shown. Referring to FIGS. 47 and 48, in a multi-mode resonant filter 38 according to the seventeenth example, an input probe 391 for connection with an input connector is formed on a pole ([+] pole) of the x axis, and an output probe 392 for connection with an output connector is formed on the other pole ([−] pole) of the x axis.

The multi-mode resonant filter 38 also includes a first transmission line for connecting the x axis with the z axis, which includes a transmission line #1-1 387-1 and a transmission line #1-2 387-2. An end of the transmission line #1-1 387-1 along the x axis is connected with the input probe 391, and an end thereof along the z axis is spaced apart from a point on the z axis by a predetermined interval without reaching the point on the z axis, and extending toward the [+] pole of the z axis. An end of the transmission line #1-2 387-2 along the x axis is connected with the output probe 392, and an end thereof along the z axis is spaced apart by the predetermined interval from a point on the z axis without reaching the point on the z axis, and extending toward the [+] pole of the z axis.

The multi-mode resonant filter 38 also includes a second transmission line 388 for connecting the z axis with the y axis. An end of the second transmission line 388 along the y axis is connected with a point on the y axis ([+] pole thereof), and an end thereof along the z axis is spaced apart from a point on the z axis by a predetermined interval without reaching the point on the z axis, and being oriented toward the [+] pole of the z axis.

The multi-mode resonant filter 38 also includes a third transmission line 389 for connecting the x axis with the y axis, which includes a transmission line #3-1 389-1 and a transmission line #3-2 389-2. An end of the transmission line #3-1 389-1 along the x axis is connected with the input probe 391, and an end thereof along the y axis is connected with a point on the y axis ([+] pole thereof). An end of the transmission line #3-2 389-2 along the x axis is connected with the output probe 392, and an end thereof along the y axis is connected with a point on the y axis ([+] pole thereof). The transmission line #1-1 387-1, the transmission line #1-2 387-2, and the second transmission line 388 may be twisted by a predetermined interval (an angle of less than 45° from the z axis), instead of matching their corresponding axes.

Figure 49:
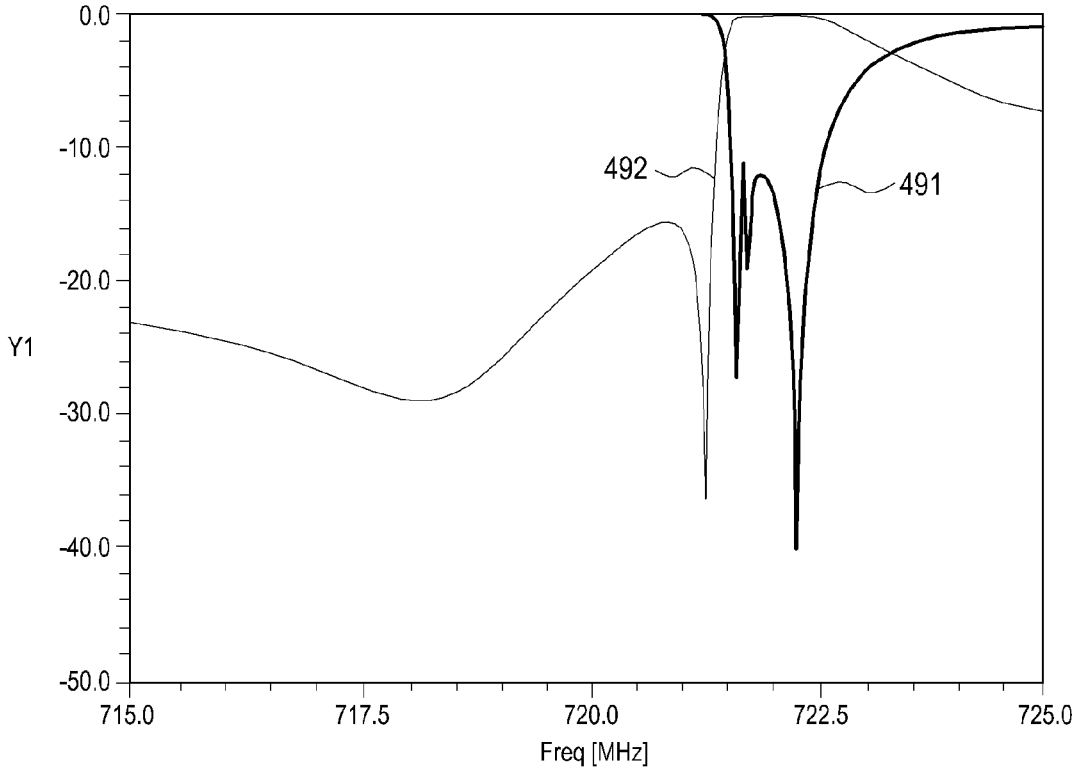
FIG. 49 is a graph illustrating an example of filtering performed by the multi-mode resonant filter shown in FIGS. 47 and 48.

FIG. 49 is a graph that illustrates an example of filtering performed by the multi-mode resonant filter shown in FIGS. 47 and 48. In FIG. 49, the horizontal axis indicates frequency Freq[GHz] and the vertical axis Y1 indicates attenuation loss. In FIG. 49, reference numeral 491 indicates a band rejection characteristic of the BRF and reference numeral 492 indicates a reflection characteristic.

As shown in FIG. 49, the BRF has a filtering feature such that there exists a rejection band of about 721-723 MHz. Also, curve 491 of FIG. 49 illustrates that three resonant modes are coupled by formation of three peaks.

Figure 50:
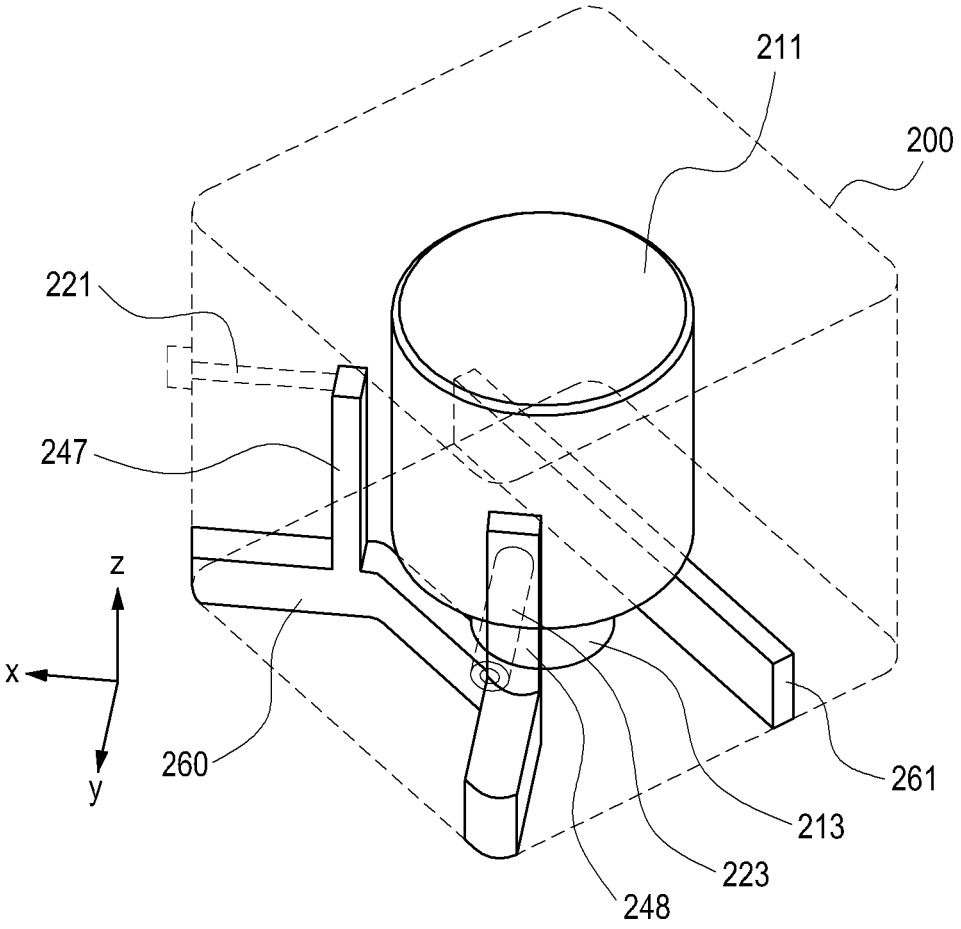
FIGS. 50-52 are diagrams illustrating an eighteenth example of a multi-mode resonant filter.
Figure 51:
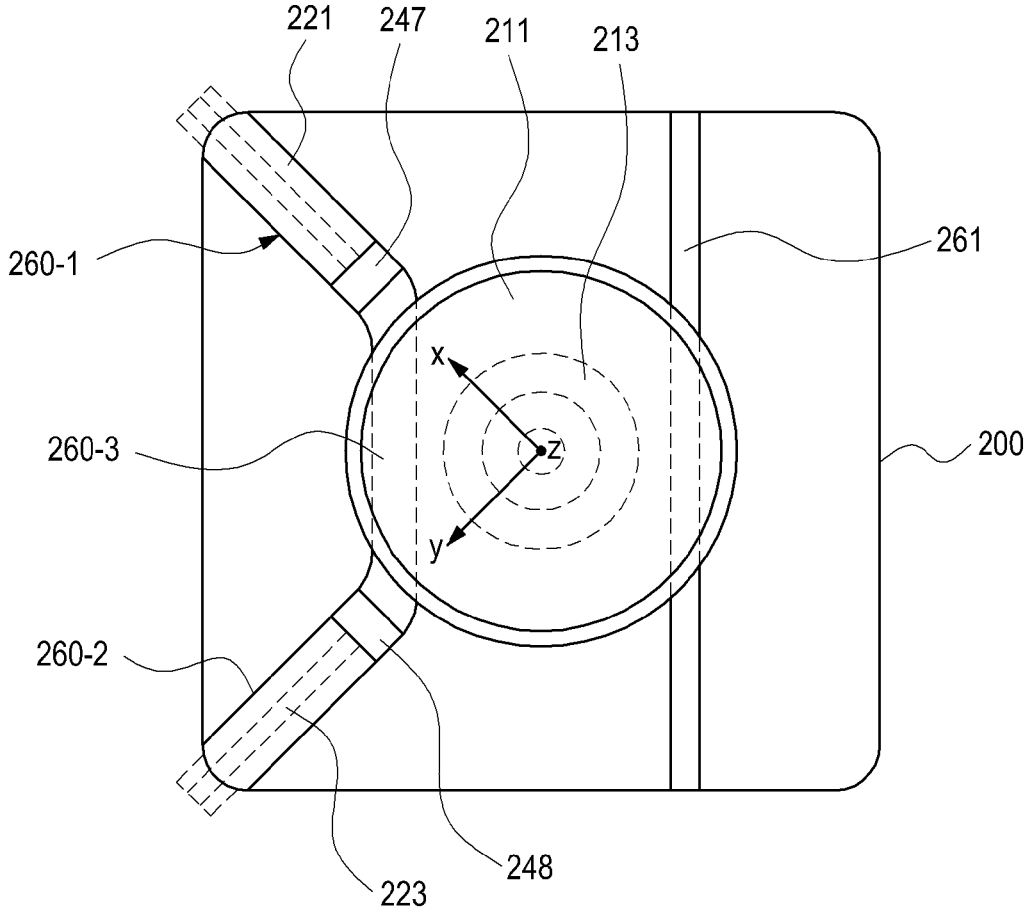
Figure 52:
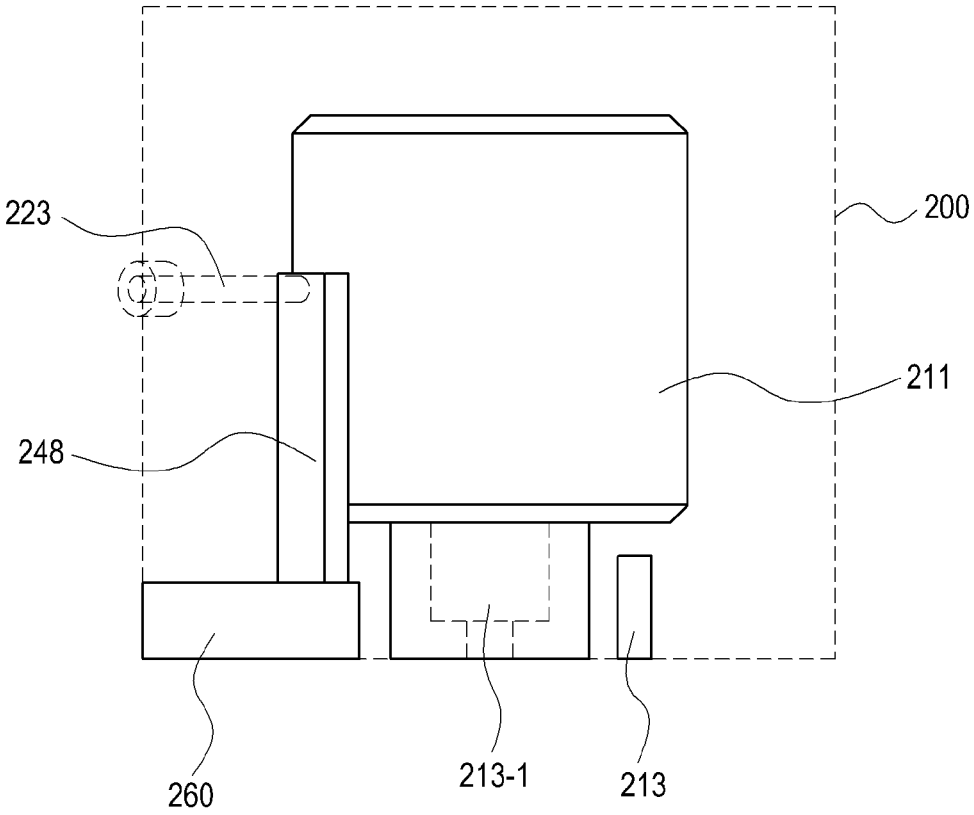

FIGS. 50-52 illustrate an eighteenth example of a multi-mode resonant filter. The multi-mode resonant filter according to the eighteenth example has a similar structure as the multi-mode resonant filter according to the eighth example shown in FIG. 24 except that transmission lines 247-1, 247-2, 248-1, 248-2, 251, 252 are simplified in their forms, and a portion of the transmission lines are formed as a single body with the housing 200.

Referring to FIGS. 50-52, the multi-mode resonant filter according to the eighteenth example includes a housing 200 having a cavity in a substantially rectangular hexahedral shape, a DR element 211 in a substantially cylindrical shape in the cavity of the housing 200, an input probe 221 for connection with an input connector formed on a pole of the x axis, and an output probe 223 for connection with an output connector formed on a pole of the y axis.

In this example, a first end of a first transmission line 247 along the x axis is connected with the input probe 221 arranged on the +x axis. A second end of the first transmission line 247 is extended toward the inner bottom surface of the housing 200 in a vertically direction. The second end of the first transmission line 247 may be spaced apart from or directly connected with the inner bottom surface of the housing 200. According to whether the second end of the first transmission line 247 is be spaced apart from the inner bottom surface of the housing 200 to be electrically open-circuited, or directly connected with the inner bottom surface of the housing 200 to be electrically short-circuited, it may change the positions of notches made by the multi-mode resonant filter.

A first end of a second transmission line 248 along the y axis is connected with the output probe 223 arranged on the +y axis. A second end of the second transmission line 248 is extended toward the inner bottom surface of the housing 200 in a vertically direction. The second end of the first transmission line 248 may be spaced apart from or directly connected with the inner bottom surface of the housing 200. According to whether the second end of the first transmission line 248 is be spaced apart from the inner bottom surface of the housing 200 to be electrically open-circuited, or directly connected with the inner bottom surface of the housing 200 to be electrically short-circuited, it may change the positions of notches made by the multi-mode resonant filter.

A third transmission line 260 is directly connected to the inner bottom surface of the housing 200, and includes a transmission line #3-1 206-1, a transmission line #3-2 206-2 a transmission line #3-3 206-3. The transmission line #3-1 206-1 is arranged in parallel with the x axis. A first end of the transmission line #3-1 206-1 is connected with a first inner corner of the housing 200. A second end of the transmission line #3-1 206-1 is extended toward the support member 213 and spaced apart from the inner bottom surface of the housing 200. The transmission line #3-2 206-2 is arranged in parallel with the y axis. A first end of the transmission line #3-2 206-2 is connected with a second inner corner of the housing 200. A second end of the transmission line #3-2 206-2 is extended toward the support member 213 and spaced apart from the inner bottom surface of the housing 200. The transmission line #3-3 206-3 is arranged between the transmission line #3-1 206-1 and the transmission line #3-2 206-2. A first end of the transmission line #3-3 206-3 is connected with the second end of the transmission line #3-1 206-1. A second end of the transmission line #3-3 206-3 is connected with the second end of the transmission line #3-2 206-2. The first and second transmissions 221, 223 may be connected with the third transmission line 260. The third transmission line 260 may change the positions of notches made by the multi-mode resonant filter and, if necessary, can be omitted from the multi-mode resonant filter. In the support member 213 may be formed a cavity 213-1.

A fourth transmission line 261 is directly connected to the inner bottom surface of the housing 200 and arranged in parallel with the transmission line #3-3 206-3 with the DR element 211 therebetween. Both ends of the fourth transmission line 261 are extended up to the both inner side walls of the housing 200.

The third and fourth transmission lines 260 and 261 may be formed in a single body with the housing 200. The third and fourth transmission lines 260 and 261 may be formed during the process of making a cavity in the housing 200. While cutting the inside of the housing 200 to make a cavity therein, there may remain protruded portions corresponding to the third and fourth transmission lines 260 and 261 on the inner bottom surface of the housing 200.

Figure 53:
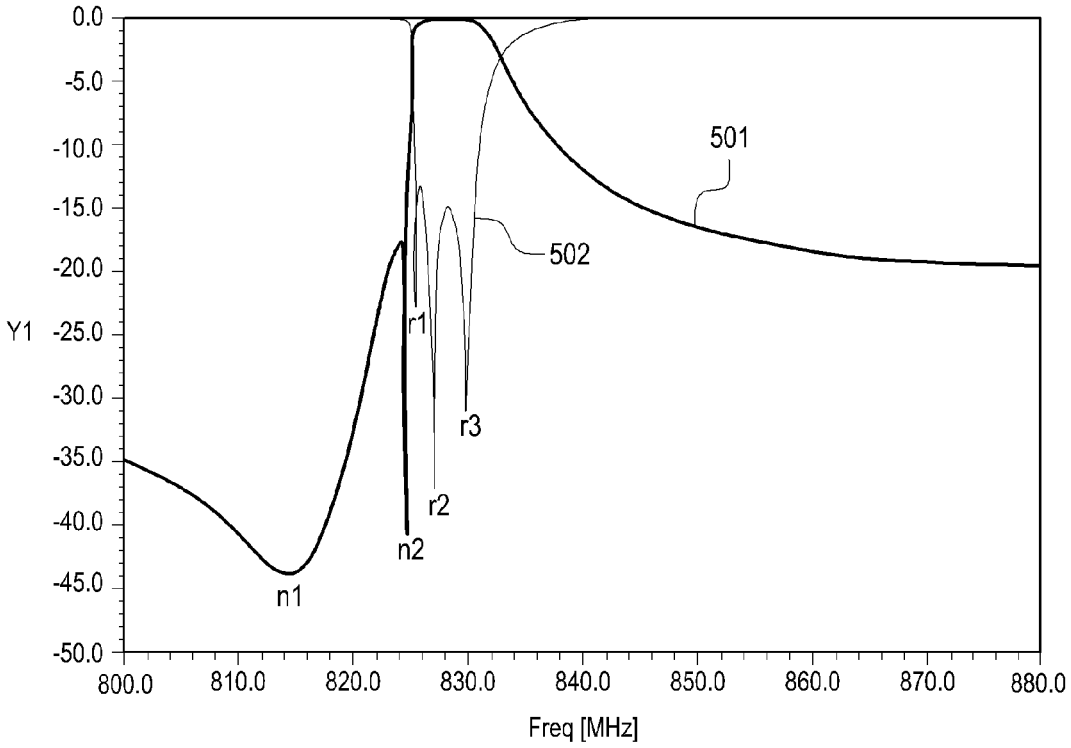
FIG. 53 is a graph illustrating an example of filtering performed by the multi-mode resonant filter shown in FIGS. 50-52.

FIG. 53 is a graph that illustrates an example of filtering performed by the multi-mode resonant filter shown in FIG. 50. In FIG. 53, the horizontal axis indicates frequency [GHz] and the vertical axis Y1 indicates attenuation loss. In FIG. 53, reference numeral 501 indicates a band-pass characteristic of the BPF according to the eighteenth example and reference numeral 502 indicates a reflection characteristic. As shown in FIG. 53, the BPF has a band pass characteristic such that there exists a pass band of about 825-831 MHz, with notches n1 and n2 formed at frequencies lower than the pass band. Also, the reflection characteristic curve 502 having three peaks r1, r2, and r3 illustrates that three resonant modes are coupled.

As described above, the multi-mode resonant filter according to the following description may provide a plurality of resonance frequencies being in substantially identical modes with a single resonator.

Consequently, it is possible to reduce the size, weight, and manufacturing cost of the filter.

Moreover, according to the present invention, a plurality of modes may be coupled by connection between transmission lines in spite of the use of the DR element having a simple structure, and the position and number of notches may be easily adjusted. As shown in the attached graphs, the filter has characteristics that allow it to be used as a filter, a duplexer, or the like.

While the following description has been shown and described with reference to examples thereof, it should be understood by those skilled in the art that various changes in form and details may be made therein without departing from the spirit and scope of the invention as defined by the appended claims.

For example, the DR element may be in various shapes such as a polygonal shape, a quasi-spherical shape, a cylindrical shape, an oval shape, a round shape, and the like. In the multi-mode resonant filter, the housing and its cavity may be in various shapes such as a polygonal shape, a cylindrical shape, and an oval shape as well as a spherical shape and a quasi-spherical shape.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A multi-mode resonant filter, comprising:

a housing comprising a cavity therein;

a Dielectric Resonant (DR) element configured to be received in the housing, the DR element forming at least three resonant modes in different directions;

a first transmission line aligned along a first direction in which a first resonant mode among the at least three resonant modes is formed;

a second transmission line aligned along a second direction in which a second resonant mode among the at least three resonant modes is formed, the second resonant mode being different from the first resonant mode; and a third transmission line aligned along a third direction in which a third resonant mode among the at least three resonant modes is formed, the third resonant mode being different from the first resonant mode and the second resonant mode, wherein the first transmission line, the second transmission line, and the third transmission line couple the first resonant mode, the second resonant mode, and the third resonant mode; the first, second, and third transmission lines each comprise first and second ends and one of the first and second ends of at least one of the first transmission line, the second transmission line, and the third transmission line is directly connected to one of the first and second ends of another one of the first transmission line, the second transmission line, and the third transmission line.

2. The multi-mode resonant filter of claim 1, further comprising:

an input connector fixed to a side of the housing, to which an input signal is input; and an output connector fixed to another side of the housing, from which an output signal is output, wherein:

the first transmission line and the second transmission line are connected to the input connector, and the third transmission line is directly connected to the output connector.

3. The multi-mode resonant filter of claim 1, further comprising:

an input connector fixed to a side of the housing, to which an input signal is input;

an output connector fixed to another side of the housing, from which an output signal is output; and an auxiliary transmission line, wherein:

the first transmission line and the second transmission line are connected to the input connector, the third transmission line is directly connected to the output connector, and the auxiliary transmission line is connected to one of the input connector and the output connector.

4. The multi-mode resonant filter of claim 1, wherein the first resonant mode, the second resonant mode, and the third resonant mode are orthogonal to each other.

5. The multi-mode resonant filter of claim 1, wherein the plurality of resonant modes are substantially identical resonant modes and the first, second, and third directions are formed in different directions.

6. The multi-mode resonant filter of claim 1, wherein the at least three resonant modes are $TE_{01}\delta$ modes.

7. The multi-mode resonant filter of claim 1, wherein the DR element is formed in a substantially spherical, cylindrical, or rectangular hexahedral shape.

8. The multi-mode resonant filter of claim 1, wherein at least one of an inner circumferential surface and an outer circumferential surface of the housing is formed in a substantially spherical, cylindrical, or rectangular hexahedral shape.

9. The multi-mode resonant filter of claim 1, wherein the first transmission line, the second transmission line, and the third transmission line are each formed in a bar shape, a rod shape, or a plate shape.

10. The multi-mode resonant filter of claim 1, wherein the first transmission line, the second transmission line, and the third transmission line are aligned between an inner circumferential surface of the housing and an outer circumferential surface of the DR element.

11. The multi-mode resonant filter of claim 1, wherein a shape of at least a portion of the first transmission line, the second transmission line, and the third transmission line corresponds to a shape of the DR element or the housing.

12. The multi-mode resonant filter of claim 1, further comprising a support member, an end of which is connected to a bottom surface of the DR element and another end of which is connected to an inner circumferential surface of the housing, supporting the housing such that the DR element is positioned at a center inside the housing.

13. The multi-mode resonant filter of claim 1, further comprising:

an input connector fixed to a side of the housing, to which an input signal is input, the input connector being directly connected or coupled with the first transmission line; and an output connector fixed to another side of the housing, from which the input signal coupled according to the at least three coupled resonant modes is output.

14. The multi-mode resonant filter of claim 1, wherein:

an x axis, a y axis, and a z axis are orthogonal to each other with respect to a center of the DR element;

the first end of the first transmission line is positioned on an +x axis and the second end thereof is positioned on a +z axis;

a first end of the second transmission line is connected with the second end of the first transmission line on the +z axis and the second end thereof is positioned on a +y axis; and a first end of the third transmission line is connected with the first end of the first transmission line on the +x axis and the second end thereof is connected with the second end of the second transmission line on the +y axis.

15. The multi-mode resonant filter of claim 1, wherein:

an x axis, a y axis, and a z axis are orthogonal to each other with respect to a center of the DR element;

the first end of the first transmission line is positioned on an +x axis and the second end thereof is positioned on a +z axis;

the first end of the second transmission line is connected with the second end of the first transmission line on the +z axis and the second end thereof is positioned on a +y axis; and a first end of the third transmission line is connected with the second end of the second transmission line on the +y axis and the second end thereof is positioned at a point on a −x axis.

16. The multi-mode resonant filter of claim 1, wherein:

an x axis, a y axis, and a z axis are orthogonal to each other with respect to a center of the DR element;

a first end of the first transmission line is positioned on an +x axis and the second end thereof is positioned on a +z axis;

a first end of the second transmission line is connected with the second end of the first transmission line on the +z axis and the second end thereof is positioned on a +y axis, the first end of the third transmission line is connected with the second end of the second transmission line on the +y axis and the second end thereof extends toward a −x axis; and the multi-mode resonant filter further comprises:

a fourth transmission line which is connected with the first end of the first transmission line and extends toward the −y axis; and an open structure made of a metallic material, the open structure being connected to a first end of the fourth transmission line.

17. The multi-mode resonant filter of claim 16, wherein:

the first transmission line comprises a first sub transmission line and a second sub transmission line which are aligned such that a portion of the first sub transmission line and a portion of the second sub transmission line overlap each other; and the second transmission line comprises a third sub transmission line and a fourth sub transmission line which are aligned such that a portion of the third sub transmission line and a portion of the fourth sub transmission line overlap each other.

18. The multi-mode resonant filter of claim 1, wherein:

an x axis, a y axis, and a z axis are orthogonal to each other with respect to a center of the DR element;

the first transmission line comprises a transmission line #1-1 and a transmission line #1-2;

a first end of the transmission line #1-1 is positioned at a point on an +x axis and a second end thereof is grounded with an inner bottom surface of the housing;

a first end of the transmission line #1-2 is positioned on a point on an +z axis and a second end thereof is grounded with an inner top surface of the housing;

the second transmission line comprises a transmission line #2-1 and a transmission line #2-2;

a first end of the transmission line #2-1 is positioned at a point on an +y axis and a second end thereof is grounded with an inner bottom surface of the housing;

a first end of the transmission line #2-2 is connected with the first end of the transmission line #1-1 on an +x axis and a second end thereof is grounded with an inner top surface of the housing;

the third transmission line comprises a first auxiliary transmission line and a second auxiliary transmission line;

a first end of the first auxiliary transmission line is connected with the first end of the transmission line #1-1 and a second end thereof extends toward an −y axis; and a first end of the second auxiliary transmission line is connected with the first end of the transmission line #2-1 and a second end thereof extends toward an −x axis.

19. The multi-mode resonant filter of claim 18, wherein:

the multi-mode resonant filter further comprises a third auxiliary transmission line; and a first end of the third sub transmission line is connected with the first end of the transmission line #2-1 on an +y axis and a second end thereof extends toward the +z axis.

20. The multi-mode resonant filter of claim 18, wherein:

the housing is formed in a substantially rectangular hexahedral shape; and the DR element is formed in a substantially cylindrical shape.

21. The multi-mode resonant filter of claim 1, wherein:

an x axis, a y axis, and a z axis are orthogonal to each other with respect to a center of the DR element;

the first end of the first transmission line is positioned on an +x axis and the second end thereof extends toward an +z axis;

the second transmission line comprises a transmission line #2-1 and a transmission line #2-2;

a first end of the transmission line #2-1 is positioned on an +y axis and a second end thereof extends toward the +z axis;

a first end of the transmission line #2-2 is positioned on an −y axis and a second end thereof extends toward the +z axis;

the third transmission line comprises a transmission line #3-1 and a transmission line #3-2;

a first end of the transmission line #3-1 is connected with the first end of the transmission line #2-1 on the +y axis and a second end thereof is positioned on an −x axis; and a first end of the transmission line #3-2 is connected with the first end of transmission line #2-2 on the −x axis and a second end thereof is connected with the first end of the first transmission line on the +x axis.

22. The multi-mode resonant filter of claim 21, wherein the second end of the first transmission is positioned on the +z axis.

23. The multi-mode resonant filter of claim 21, further comprising:

an input connector fixed to a side of the housing, to which an input signal is input; and an output connector fixed to another side of the housing, from which an output signal is output, wherein:

the first transmission line comprises a transmission line #1-1 and a transmission line #1-2, a first end of the transmission line #1-1 is connected with the input connector and a second end thereof extends toward the +z axis, and the second end of the transmission line #3-1 is connected with the output connector.

24. The multi-mode resonant filter of claim 21, further comprising:

an input connector fixed to a side of the housing, to which an input signal is input; and an output connector fixed to another side of the housing, from which an output signal is output, wherein:

the first transmission line comprises a transmission line #1-1 and a transmission line #1-2, a first end of the transmission line #1-1 is connected with the input connector and a second end thereof extends toward the +z axis, and a first end of the transmission line #2-1 is connected with the output connector.

25. The multi-mode resonant filter of claim 1, wherein:

an x axis, a y axis, and a z axis are orthogonal to each other with respect to a center of the DR element;

a first end of the first transmission line is positioned on an +x axis and the second end thereof is positioned on an +z axis;

a first end of the second transmission line is connected with the second end of the first transmission line on the +z axis and the second end thereof is positioned on an +y axis;

a first end of the third transmission line is connected with the second end of the second transmission line on the +y axis and the second end thereof is positioned on an −y axis; and the multi-mode resonant filter further comprises:

an input connector connected with the first end of the first transmission line on the +x axis; and an output connector connected with the second end of the third transmission line.

26. The multi-mode resonant filter of claim 1, wherein:

an x axis, a y axis, and a z axis are orthogonal to each other with respect to a center of the DR element;

a first end of the second transmission line is positioned on an +z axis and the second end thereof is positioned on an +y axis;

a first end of the third transmission line is connected with the second end of the second transmission line on the +y axis and the second end thereof is grounded to an inner wall of the housing on an −x axis;

a first end of the first transmission line is positioned on an +x axis and the second end thereof is connected with the second transmission, the second end of the first transmission being spaced apart from the +z axis; and the multi-mode resonant filter further comprises:

an input connector connected with the first end of the first transmission line on the +x axis;

an output connector connected with the second end of the second transmission line on the +y axis; and an auxiliary line connected with the second end of the second transmission line on the +y axis and extends toward the +x axis.

27. The multi-mode resonant filter of claim 1, wherein:

an x axis, a y axis, and a z axis are orthogonal to each other with respect to a center of the DR element;

the first end of the first transmission line is positioned on an +x axis and the second end thereof is positioned on an +z axis;

the first end of the third transmission line is positioned on an +y axis and the second end thereof is grounded to an inner wall of the housing on an −x axis;

the first end of the second transmission line is connected with the first end of the third transmission line on the +y axis and the second end thereof is connected with the first transmission, the second end of the first transmission being spaced apart from the +z axis; and the multi-mode resonant filter further comprises:

an input connector connected with the first end of the first transmission line on the +x axis;

an output connector connected with the second end of the second transmission line on the +y axis; and an auxiliary line connected with the second end of the second transmission line on the +y axis and extends toward the +x axis.

28. The multi-mode resonant filter of claim 1, wherein:

an x axis, a y axis, and a z axis which are orthogonal to each other with respect to a center of the DR element;

the first transmission line comprises a transmission line #1-1 and a transmission line #1-2;

a first end of the transmission line #1-1 is connected with an input probe on an +x axis and a second end thereof extends toward an +z axis;

a first end of the transmission line #1-2 is connected with an output probe on an −x axis and a second end thereof extends toward the +z axis;

the first end of the second transmission line is positioned on an +y axis and the second end thereof extends toward the +z axis;

the third transmission line comprises a transmission line #3-1 and a transmission line #3-2;

a first end of the transmission line #3-1 is connected with the input probe on the +x axis and a second end thereof is positioned on the +y axis; and a first end of the transmission line #3-2 is connected with the second end of the transmission line #3-1 on the +y axis and a second end thereof is connected with the output probe on the −x axis.

29. The multi-mode resonant filter of claim 1, wherein at least one of the first, second and third transmission lines is formed protruded from an inner bottom surface of the housing as a single body with the housing.

30. The multi-mode resonant filter of claim 29, further comprising:

an input connector fixed to a side of the housing, to which an input signal is input; and an output connector fixed to another side of the housing, from which an output signal is output, wherein at least two of the first, second, and third transmission lines are connected to the input connector and at least one of the first, second, and third transmission lines is connected to the output connector.

31. A multi-mode resonant filter, comprising:

a housing comprising a cavity;

a Dielectric Resonant (DR) element received in the cavity of the housing; and a plurality of transmission lines at least one of which has an end connecting a point on one of a first axis, a second axis, and a third axis and another end connecting another point on another one of the first axis, the second axis, and the third axis, wherein the first axis, the second axis, and the third axis are orthogonal to each other with respect to a center of the DR element.

* * * * *